US005593335A

United States Patent [19]

Suzuki et al.

[11] Patent Number: 5,593,335

[45] Date of Patent: Jan. 14, 1997

[54] METHOD OF MANUFACTURING AN ELECTRON SOURCE

[75] Inventors: Hidetoshi Suzuki, Fujisawa; Yoshiyuki Osada; Ichiro Nomura, both of Atsugi; Takeo Ono, Machida; Hisaaki Kawade, Yokohama; Eiji Yamaguchi, Zama; Toshihiko Takeda, Atsugi; Hiroaki Toshima, Tokyo; Yasuhiro Hamamoto, Atsugi; Tatsuya Iwasaki, Atsugi; Aoji Isono, Atsugi; Noritake Suzuki, Atsugi; Yasuyuki Todokoro, Yokohama; Masahiro Okuda, Zama; Katsuhiko Shinjo, Isehara, all of Japan

[73] Assignee: Canon Kabushiki Kaisha, Tokyo, Japan

[21] Appl. No.: 223,528

[22] Filed: Apr. 5, 1994

[30] Foreign Application Priority Data

| | | | |
|---|---|---|---|
| Apr. 5, 1993 | [JP] | Japan | 5-077900 |
| Apr. 5, 1993 | [JP] | Japan | 5-078164 |
| Apr. 5, 1993 | [JP] | Japan | 5-100087 |
| Apr. 5, 1993 | [JP] | Japan | 5-100088 |
| Oct. 28, 1993 | [JP] | Japan | 5-270343 |
| Mar. 25, 1994 | [JP] | Japan | 6-055493 |

[51] Int. Cl.[6] ..... H01J 1/30; H01J 9/02

[52] U.S. Cl. ..... 445/50; 445/51

[58] Field of Search ..... 445/50, 51

[56] References Cited

U.S. PATENT DOCUMENTS

| | | | |
|---|---|---|---|
| 4,983,908 | 1/1991 | Tada et al. | 324/158 P |
| 5,066,883 | 11/1991 | Yoshioka et al. | 313/309 |

FOREIGN PATENT DOCUMENTS

| | | | |
|---|---|---|---|
| 0388984 | 3/1990 | European Pat. Off. . | |
| 0523702 | 7/1992 | European Pat. Off. . | |
| 1-019658 | 1/1989 | Japan . | |
| 1-19656A | 1/1989 | Japan | 445/51 |
| 64-31332 | 2/1989 | Japan . | |
| 1-112631 | 5/1989 | Japan . | |
| 1-276530A | 11/1989 | Japan | 445/50 |
| 2-56822A | 2/1990 | Japan | 445/50 |
| 4-28139 | 1/1992 | Japan . | |
| 4-10325A | 1/1992 | Japan | 445/50 |
| 4-65050A | 3/1992 | Japan | 445/51 |

OTHER PUBLICATIONS

Hartwell, et al., "Strong Electron Emissions from Patterned Tin–Indium Oxide Thin Films", *IEEE Trans. E. D. Conf.*, Dec. 1975, pp. 519–521.

M. I. Elinson, et al., "The Emission of Hot Electrons and the Field Emission of Electrons from Tin Oxide", *Radio Eng. Electron. Phys.*, 10, 1290 (1965) (translated from Russian).

C. A. Mead, "Operation of Tunnel–Emission Devices", *J. Appl. Phys.*, vol. 32, No. 4, 646 (1961).

Spindt, et al., "Physical properties of thin–film field emission cathodes with molybdenum cones", *J. Appl. Phys.*, vol. 47, No. 12, 5248 (1976).

Dyke, et al., "Field Emission", *Advances in Electronics and Electron Physics*, 8, 89 (1956).

Araki, et al., "Electroforming and Electron Emission of Carbon Thin Films", *J. Vac. Soc. Jap.*, vol. 26, No. 1, 519 (1983).

*Primary Examiner*—P. Austin Bradley
*Assistant Examiner*—Jeffrey T. Knapp
*Attorney, Agent, or Firm*—Fitzpatrick, Cella, Harper & Scinto

[57] ABSTRACT

A method of manufacturing an electron source having a plurality of surface-conduction electron-emitting devices arranged on a substrate in row and column directions includes the forming of electron emission portions of the plurality of surface-conduction electron-emitting devices. The forming is carried out by supplying current through the plurality of surface-conduction electron-emitting devices upon dividing them into a plurality of groups. An image forming apparatus passes a current through a plurality of electron sources, which are formed on a substrate and arrayed in the form of a matrix, in dependence upon an image signal, and an image is formed by a light emission in response to electrons emitted from the plurality of electron sources.

37 Claims, 58 Drawing Sheets

(FORMING METHOD 1)

(FORMING METHOD 2)

METHOD OF MANUFACTURING AN ELECTRON SOURCE

BACKGROUND OF THE INVENTION

1. Field of the Invention

This invention relates to an electron source, an image forming apparatus which is an application thereof, and a method of manufacturing the electron source.

2. Description of the Related Art

Two types of electron sources, namely thermionic sources and cold cathode electron sources, are known as electron-emitting devices. Examples of cold cathode electron sources are electron-emitting devices of the field emission type (abbreviated to "FE" below), metal/insulator/metal type (abbreviated to "MIM" below) and surface-conduction emission type (abbreviated to "SCE". Known examples of the FE type are described by W. P. Dyke and W. W. Dolan, "Field emission", Advance in Electron Physics, 8,89 (1956) and by C. A. Spindt, "Physical properties of thin-film field emission cathodes with molybdenum cones", J. Appl. Phys., 47,5248 (1976).

A known example of the MIM type is described by C. A. Mead, "The tunnel-emission amplifier", J. Appl. Phys., 32,616 (1961).

A known example of the SCE type is described by M. I. Elinson, Radio. Eng. Electron Phys., 10 (1965).

The SCE type makes use of a phenomenon in which an electron emission is produced in a small-area thin film, which has been formed on a substrate, by passing a current parallel to the film surface.

Various examples of this surface-conduction electron-emitting device have been reported. One relies upon a thin film of $SnO_2$ according to Elinson, mentioned above. Other examples use a thin film of Au [G. Dittmer: "Thin Solid Films", 9,317 (1972)]; a thin film of $In_2O_3/SnO_2$ (M. Hartwell and C. G. Fonstad: "IEEE Trans. E. D. Conf.", 519 (1975); and a thin film of carbon (Hisashi Araki, et al: "Vacuum", Vol. 26 No. 1, p. 22 (1983).

FIG. 1 illustrates the construction of the device according to M. Hartwell, described above. This device is typical of the surface-conduction electron-emitting device. As shown in FIG. 1, numeral 1 denotes an insulative substrate. Numeral 2 denotes a thin film for forming an electron emission portion. The thin film 2 comprises a thin film of a metal oxide formed into an H-shaped pattern by sputtering. An electron emission portion 3 is formed by an electrification process referred to as "forming", described below. Numeral 4 designates a thin film, which includes the electron emission portion 3. Further, spacing L1 between device electrodes is set to 0.5~1 mm, and W is set to 0.1 mm. It should be noted-that since the position and shape of the electron emission portion 3 is unknown, this is represented schematically.

In these conventional surface-conduction electron-emitting devices, generally the electron emission portion 3 is formed on the thin film 2, which is for forming the electron emission portion, by the so-called "forming" electrification process before electron emission is performed. According to the forming process, a DC voltage or a very slowing rising voltage (e.g., on the order of 1 V/min) is impressed across the thin film 2, which is for forming the electron emission portion, thereby locally destroying, deforming or changing the property of the thin film 2 and forming the electron emission portion 3, the electrical resistance of which is high. The electron emission portion 3 causes a fissure in part of the thin film 2, which is for forming the electron emission portion. Electrons are emitted from the vicinity of the fissures. The thin film 2 for forming the electron emission portion inclusive of the electron emission portion produced by forming shall be referred to as the thin film 4 inclusive of the electron emission portion. In the surface-conduction electron-emitting device that has been subjected to the above-described forming treatment, a voltage is applied to the thin film 4 inclusive of the electron emission portion, and a current is passed through the device, whereby electrons are emitted from the electron emission portion 3. Various problems in terms of practical application are encountered in these conventional surface-conduction electron-emitting devices. However, the applicant has solved these practical problems by exhaustive research regarding improvements set forth below.

Since the foregoing surface-conduction electron-emitting device is simple in structure and easy to manufacture, an advantage is that a large number of devices can be arrayed over a large surface area. Accordingly, a variety of applications that exploit this feature have been studied. For example, electron beam sources and display apparatuses can be mentioned. As an example of a apparatus in which a number of surface-conduction electron-emitting devices are formed in an array, mention can be made of an electron source in which surface-conduction electron-emitting devices are arrayed in parallel (referred to as a "ladder-shaped" array) and both ends of the individual devices are connected by wiring (also referred to as common wiring) to obtain a row, a number of which are provided in an array (for example, see Japanese Patent Application Laid-Open NO. 1-031332, filed by the applicant). Further, in an image forming apparatus such as a display apparatus, flat-type displays using liquid crystal have recently become popular as a substitute for CRTs. However, since such displays do not emit their own light, a problem encountered is that they require back-lighting. Thus, there is a need to develop a display apparatus of the type that emits its own light. An image forming apparatus that is a display apparatus comprising a combination of an electron source, which is an array of a number of the surface-conduction electron-emitting devices, and phosphors that produce visible light in response to the electrons emitted by the electron source is comparatively easy to manufacture, even as an apparatus having a large screen. This apparatus is a display apparatus capable of emitting its own light and has an excellent display quality (for example, see U.S. Pat. No. 5,066,883, issued to the applicant).

However, the following problems are encountered in the above-described electron source having a number of the surface-conduction electron-emitting devices arrayed on a substrate, in the method of manufacturing an image forming apparatus using the electron source, and particularly in the aforesaid forming process:

In the image forming apparatus, the number of electron-emitting devices needed to obtain high-quality image or picture is very large. In the forming process used when manufacturing the electron-emitting devices, a plurality of the surface-conduction electron-emitting devices are connected, and the current that flows through the wiring (the aforementioned common wiring), which supplies power to each device from an external power supply, becomes large. This gives rise to the following shortcomings:

1) Owing to a voltage drop produced by the resistance of the common wiring, the voltage applied to each device develops a gradient and therefore a disparity occurs in the voltage applied to the devices in the forming process. As a consequence, the electron emission portions formed also change and the device characteristics become non-uniform.

2) Since the forming process is carried out by electrification, namely by passing electric current, using the common wiring, power in the wiring due to electrification is expended as heat, and a temperature distribution is produced on the substrate. This impresses a distribution upon the device temperature of each portion and the electron emission portions formed also undergo a change. A variance in characteristics from one device to another thus tends to occur.

3) Since formation of the electron emission portions is carried out by passing of current using the wiring, power in the wiring due to electrification is expended as heat, the substrate experiences heat damage and strength against impact declines.

Though these problems have been described in the case of the ladder-shaped arrangement of the plurality of electron-emitting devices on the substrate, similar problems occur as set forth below also in the case of a simple matrix arrangement, described later.

Problem 1) mentioned above will be described in further detail with reference to FIGS. 3A, B, C and FIGS. 4A, B, C. In both of these diagrams, A is an equivalent circuit diagram which includes electron-emitting devices, wiring resistors and a power supply, B is a diagram illustrating potential on high- and low-potential sides of each device, and C is a diagram showing a difference voltage, namely applied device voltage, between the high- and low-potential sides of each device.

FIG. 3A illustrates a circuit in which N-number of parallel-connected electron-emitting devices $D_1$~$D_N$ and a power supply VE are connected through wiring terminals TH, TL. The power supply and device $D_1$ are connected, and the ground side of the power supply is connected to the device $D_N$. The common wiring connecting the devices in parallel includes resistance components r between mutually adjacent devices, as illustrated. (In an image forming apparatus, pixels that are the targets of electron beams usually are arrayed at an even pitch. Accordingly, the electron-emitting devices also are arrayed so as to be evenly spaced apart. The wiring connecting the devices has approximately equal resistance values between the devices as long as width and film thickness do not develop variance in terms of manufacture.)

Further, the electron-emitting devices $D_1$~$D_N$ are assumed to have approximately equal resistance values of Rd.

In case of a circuit of the kind shown in FIG. 3A, a voltage which is greater closer to the two end devices ($D_1$ and $D_N$) is applied, as evident from FIG. 3C, with the applied voltage being lowest at the devices in the vicinity of the center.

FIGS. 4A, B, C are for a case in which the positive and negative electrodes of the power supply are connected to one side [the side of device $D_1$ in FIG. 4A] of the array of parallel-connected devices. The voltage applied to each device is greater closer to the device $D_1$, as illustrated in FIG. 4C.

The degree of variance in the applied voltage from one device to another as indicated in the two above-described examples differs depending upon the total number N of parallel-connected devices, the ratio (=Rd/r) of the device resistance Rd to the wiring resistance r or the position at which the power supply is connected. In general, however, variance becomes more prominent the larger the value of N and the smaller the value of Rd/r. Further, the method of connection in FIGS. 4A, B, C results in greater variance in the voltage applied to the devices than the method of connection shown in FIGS. 3A, B, C. Furthermore, though the arrangement is different from those of the two above-described example, simple matrix wiring of the kind illustrated in FIG. 5 also develops a variance in terms of the applied voltage of each device owing to a voltage drop that occurs across wiring resistors $r_x$ and $r_y$. In a case where a plurality of devices are connected by common wiring, the applied voltage of each device develops a variance unless the wiring resistance is made sufficiently small in comparison with the device resistance Rd.

The inventors have discovered the following facts as a result of intensive research: Specifically, in a case where forming is carried out in the process of forming an electron emission portion of an electron-emitting device, forming is performed at the same voltage or power if the shape of device is the same, i.e., if the material and film thickness of the thin film 2 for forming the electron emission portion of FIG. 1, as well as W, L, are the same. The voltage or power specified to the device is referred to as device forming voltage $V_{form}$ or $P_{form}$, respectively. When it is attempted to carry out the forming process by applying a voltage or power much higher than $V_{form}$ or $P_{form}$ to an device, the electron emission portion of the device undergoes a great change in form and the electron emission characteristic deteriorates. If the applied voltage or power is less than $V_{form}$ or $P_{form}$, it goes without saying that the electron emission portion cannot be formed.

On the other hand, in a case where a plurality of devices connected by common wiring are formed simultaneously by supply of voltage through the common wiring from an external power supply, a disparity in the voltage applied to each device occurs owing to a voltage drop in the wiring, and devices are produced in which the voltage or power applied thereto exceeds the forming voltage $V_{form}$ or forming power $P_{form}$. It known qualitatively that the electron emission portions of these devices deteriorate and that the electron emission characteristics of a plurality of devices develop a large variance. A quantitative approach will be discussed in an embodiment set forth below.

Accordingly, in order to prevent a variance is applied device voltage in the forming process, it is necessary that the common wiring connecting a plurality of devices and introducing electric power to them be made wiring having a low resistance. This demand regarding wiring becomes even more important as the number of devices connected to the common wiring increases. This imposes a great limitation upon degree of freedom in terms of manufacturing and designing the electron source and image forming apparatus and in terms of the manufacturing process. One result is an apparatus of high cost.

Problems 2) and 3) mentioned above will now be described in detail.

In the forming process, an electron emission portion is formed in an device by passing electric current. Owing to such electrification, however, power is expended in the common wiring and in the devices and is converted to Joule heat. This is accompanied by a rise in the temperature of the substrate. Meanwhile, a change in form at the formation of the electron emission portion of the device is susceptible to the influence of temperature. Accordingly, a variance and fluctuation in the temperature of the substrate have an influence upon the electron emission characteristic of the device. In particular, in an electron source and image forming apparatus in which a plurality of devices are disposed, an increase in the devices to undergo forming simultaneously is accompanied by a problem even greater than the occurrence of variance owing to the voltage drop in the common-wiring. For example, a distribution is produced in the rising temperature at the central portion of the substrate and at the edges thereof where the heat escapes. The temperature of the central portion rises above that of the edge portions and a variance is produced in the electron emission characteristic. As a result, in a case where an image forming apparatus is manufactured, the variance in the electron emission characteristics of the devices leads to various inconveniences, such as a difference in luminance. This leads to a decline in picture quality.

At the same time, the heat produced subjects the substrate to thermal shock or deformation. This leads to safety-related problems such as rupture in an image forming apparatus constituting an evacuated apparatus in a case where the apparatus makes use of a vessel that must withstand the pressure of the atmosphere.

The following difficulties also arise in addition to the problems described above:

(1) The number of devices capable of being connected by common wiring is essentially limited.

(2) In order to reduce wiring resistance, it is necessary to use comparatively expensive materials such as gold or silver. This raises expenditures for raw materials.

(3) In order-to reduce wiring resistance, it is required that thick wiring electrodes be formed. This lengthens the time required for the manufacturing process, namely the formation of the electrodes and patterning, and raises the cost of the related equipment and facilities.

SUMMARY OF THE INVENTION

Accordingly, an object of the present invention is to provide an electron source exhibiting uniform electron emission characteristics, as well as an image forming apparatus having a high picture quality.

According to the present invention, the foregoing object is attained by providing a method of manufacturing an electron source having a plurality of surface-conduction electron-emitting devices arranged on a substrate, wherein a step of forming electron emission portions of the surface-conduction electron-emitting devices has an electrification forming step of subjecting the plurality of surface-conduction electron-emitting devices to forming upon dividing them into a plurality of groups.

Further, the foregoing object is attained by providing a method of manufacturing an electron source having a plurality of surface-conduction electron-emitting devices arranged on a substrate and connected by wiring, wherein a step of forming electron emission portions of the surface-conduction electron-emitting devices has an electrification forming step carried out by supplying electric power from electrical connecting means arranged to contact the wiring.

Further, the foregoing object is attained by providing a method of manufacturing an electron source having a plurality of surface-conduction electron-emitting devices arranged on a substrate and connected by wiring, wherein a step of forming electron emission portions of the surface-conduction electron-emitting devices has an electrification forming step carried out by supplying electric power to each of the devices through the wiring, the electrification forming step having a step of performing control in such a manner that applied power or applied voltage to each of the devices is rendered constant for all devices.

Further, the foregoing object is attained by providing an electron source having a plurality of surface-conduction electron-emitting devices arranged on a substrate, the electron source being manufactured by a method of manufacture according to any of the methods described above.

Further, the foregoing object is attained by providing an image forming apparatus having an electron source, which has a plurality of surface-conduction electron-emitting devices arranged on a substrate, and an image forming member for forming an image by irradiation with electron beams from the electron source, the electron source being manufactured by a method of manufacture according to any of the methods described above.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Figure 1:
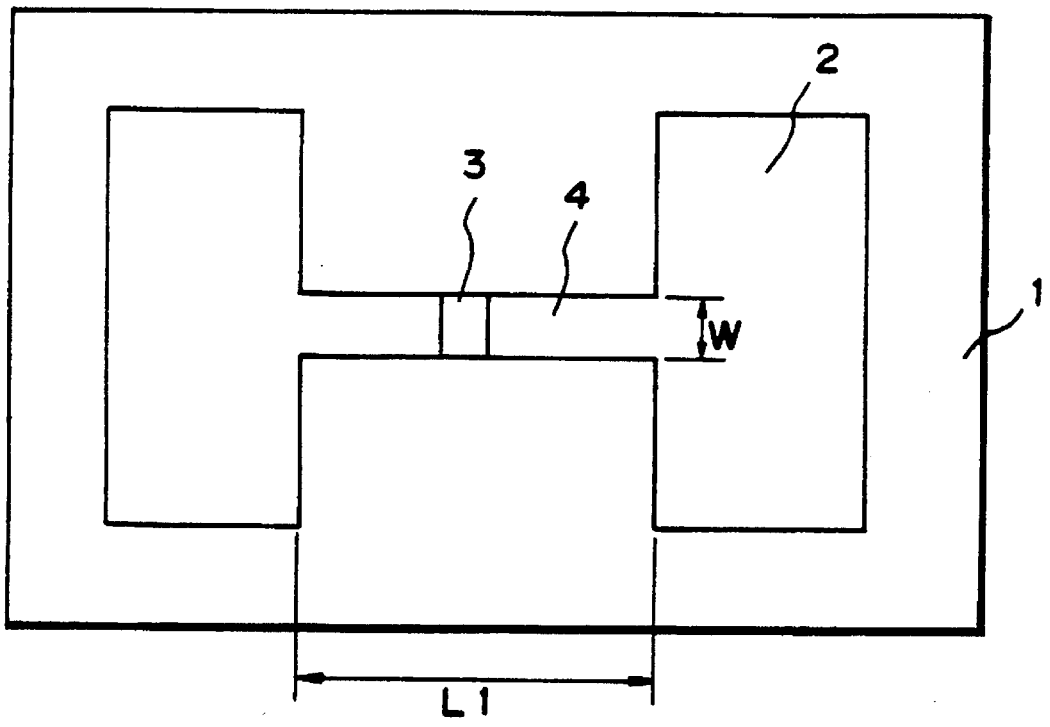
FIG. 1 is a schematic view illustrating a surface-conduction electron-emitting device according to the prior art.

The present invention provides an electron source having a plurality of electron-emitting devices arrayed on a substrate, and image forming apparatus and a method of manufacture. Specifically, in a forming process for forming electron emission portions of a plurality of electron-emitting devices, all of the electron-emitting devices on the substrate are not formed simultaneously. Rather, devices are divided into a plurality of devices and forming is carried out in successive fashion or use is made of electrical connecting means other than wiring, thereby reducing the size of the current that flows through the wiring and solving the aforementioned problems. The means for accomplishing this as follows:

A. An external feeding mechanism is provided in such a manner that voltage is applied only to a group of devices of a desired portion, with no voltage being applied to devices in other groups.

B. A mechanism is provided in which, when the group of devices of the desired portion is formed, each device is electrically formed at substantially the same voltage or the same power.

With regard to A mentioned above, the specific means and method are as follows:

A-1. In a configuration equipped with electron-emitting devices connected horizontally and vertically in rows and columns by simple matrix wiring, forming is carried out by applying a potential V1 to the wiring of at least one row, a potential V2 different from V1 to the wiring of the other rows and the potential V2 to the wiring of all columns. This operation is performed repeatedly.

Further, let $N_x$, $N_y$ represent the numbers of devices arrayed in the row and column directions, respectively, and let $r_x$, $r_y$ represent the wiring resistances per one device in the row and column directions, respectively. The forming method is such that rows or columns are selected in such a manner that forming is carried out in the x direction if the following holds:

$$(N_x \times N_x - a \times N_y) \times r_x \leqq (N_y \times N_y - a \times N_y) \times r_y$$

and in the y direction if the following holds:

$$(N_x \times N_x - a \times N_y) \times r_x > (N_y \times N_y - a \times N_y) \times r_y$$

where a=8: a case in which a power supply potion is disposed on one end, namely the x end or y end; and a=24: a case in which a power supply portion is on both ends, namely the x end or y end.

A-2. In a configuration equipped with electron-emitting devices connected horizontally and vertically in rows and columns by simple matrix wiring, forming is carried out by applying a potential V1 to the wiring of at least one row but less than all rows, a potential V2 different from V1 to the wiring of the other rows, the potential V1 to the wiring of at least one column but less than all columns, and the potential V2 to the wiring of the other columns. This operation is performed repeatedly.

With regard to B mentioned above, the specific means and method are as follows:

B-1. Rather than feeding voltage from the terminals of the common wiring at the time of forming, the forming voltage is applied via separately provided electrical connecting means.

The electrical connecting means is for interconnecting a plurality of locations of common wiring of the devices and a forming power supply through a low impedance. The structure of the electrical connecting means is such that the connection can be readily released upon the completion of forming. Furthermore, the electrical connecting means is composed of a material which exhibits excellent thermal conductivity, and has a mechanism for controlling a temperature rise and cooling by means of a temperature controller.

B-2. At least one of the wiring in the row direction and the wiring in the column direction commonly connecting the electron-emitting devices is either provided with high-impedance portions or divided at predetermined intervals. The forming voltage is applied to this portion and the forming process is carried out, after the completion of the high-impedance portion or divided portion is short-circuited.

B-3. When electron-emitting devices arrayed in one dimension or in two dimensions are electrically formed, a voltage applied to power supply terminals is applied by being controlled in such a manner that the position of a formed device is specified or while sensing the position of an device already electrically formed.

It should be noted that the above-described means A1, A2, B1, B2, B3 of the present invention are effective when implemented singly or in combination. (These means of the present invention shall be referred to as means A1, A2, B1, B2 and B3 hereinafter.)

A preferred embodiment of the present invention will now be described.

The means for solving the aforementioned problems are applicable to an electron source and image forming apparatus having an array of the conventional electron-emitting devices, MIM-type electron-emitting devices or surface-conduction electron-emitting devices. However, these means are particularly effective when applied to surface-conduction electron-emitting devices, described below, devised by the present inventors.

The basic construction of a surface-conduction electron-emitting device according to the present invention essentially is of two types, namely plane type and step type. The plane-type surface-conduction electron-emitting device will be described first.

Figure 6A:
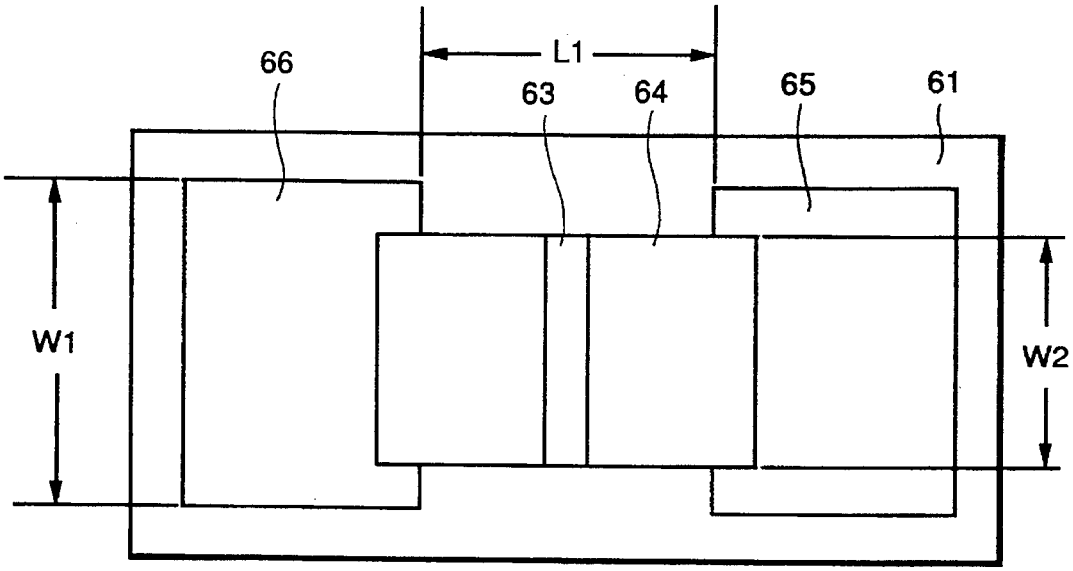
FIGS. 6A, 6B are schematic views illustrating a surface-conduction electron-emitting device according to the present invention.
Figure 6B:
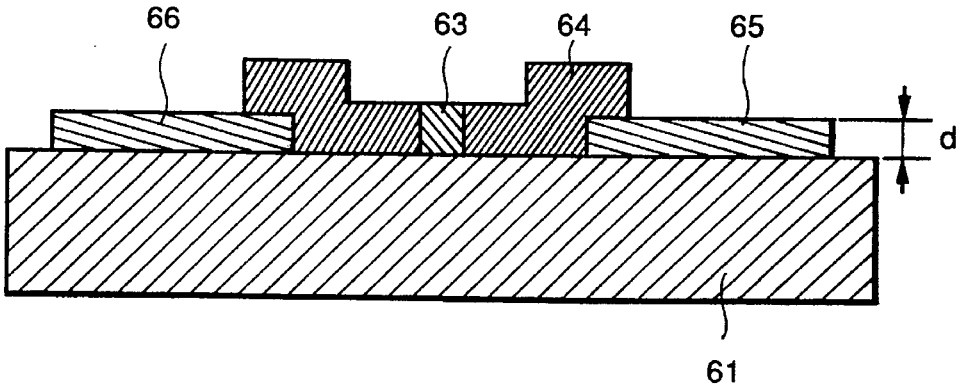

FIGS. 6A, 6B are schematic plan and sectional views, respectively, illustrating the basic construction of a surface-conduction electron-emitting device according to the present invention. The basic construction of an device according to the invention will be described with reference to FIG. 6.

Shown in FIGS. 6A, 6B are a substrate 61, device electrodes 65, 66, and a thin film 64 including an electron emission portion 63.

Examples of the substrate 61 are quartz glass, glass having a reduced impurity content such as of Na, sodalime glass, a glass substrate obtained by depositing a layer of $SiO_2$, which is formed by a sputtering process or the like, on sodalime glass, or a ceramic such as alumina.

Any material may be used for the opposing device electrodes 65, 66 so long as it is electrically conductive. Examples that can be mentioned are the metals Ni, Cr, Au, Mo, W, Pt, Ti, Al, Cu and Pd or alloys of these metals, printed conductors formed from the metals Pd, Ag, Au, $RuO_2$, Pd-Ag or from metal oxides and glass, transparent conductors such as $In_2O_3$-$SnO_2$ and semiconductor materials such as polysilicon.

Spacing L1 between the device electrodes is on the order of several hundred angstroms to several hundred micrometers. This is decided by the basic photolithographic technique of the electrode manufacturing process, namely the capability of the exposure equipment and the etching process, as well as by voltage applied across the device electrodes and the electric field strength capable of producing the electron emission. Preferably, L1 is on the order of several micrometers to several tens of micrometers.

Length W1 and film thickness d of the device electrodes 65, 66 are selected upon taking into consideration the resistance values of the electrodes and problems encountered in placing a number of arrayed electron sources. Ordinarily, the length W1 of the device electrodes is on the order of several micrometers to several hundred micrometers, and the thickness d of the device electrodes 65, 66 is on the order of several hundred Angstroms to several micrometers.

The thin film 64 of the device that includes the electron emission portion 63 is partly laid on the device electrodes 65, 66 as seen in FIG. 6B. Another possible alternative arrangement of the components of the device will be such that the area of the thin film 64 for preparing an electron-emitting region 63 is firstly laid on the substrate 61 and then the device electrodes 65 and 66 are oppositely arranged on the thin film. Still alternatively, it may be so arranged that all the areas of the thin film 64 found between the oppositely arranged device electrodes 65 and 66 operates as an electron-emitting region 63. The film thickness of the thin film 64 that includes this electron emission portion preferably is on the order of several angstroms to several thousand angstroms, with a range of 10 angstroms to 500 angstroms being particularly preferred. This is selected appropriated depending upon the step coverage to the device electrodes 65, 66, the resistance values between the electron emission portion 63 and the device electrodes 65, 66, the particle diameter of the electrically conductive particles constituting the electron emission portion 63 and the electrification process conditions, The resistance value of the thin film indicates a sheet resistance value of from $10^3$ to $10^7\Omega/$.

Specific examples of the material constituting the thin film 64 that includes the electron emission portion are the metals Pd, Pt, Ru, Ag, Au, Ti, In, Cu, Cr, Fe, Zn, Sn, Ta, W and Pb, etc., the oxides PdO, $SnO_2$, $In_2O_3$, PbO and $Sb_2O_3$, etc., the borides $HfB_2$, $ZrB_2$, $LaB_6$, $CeB_6$, $YB_4$ and $GdB_4$, the carbides TiC, ZrC, HfC, TaG, SiC and WC, etc., the nitrides TiN, ZrN and HfN, etc., the semiconductors Si, Ge, etc., and fine particles of carbon.

The term "a fine particle film" as used herein refers to a thin film constituted of a large number of fine particles that may be loosely dispersed, tightly arranged or mutually and randomly overlapping (to form an island structure under certain conditions).

The electron-emitting region 63 is constituted of a large number of the fine conductor particles with a mean particle size of preferably between several angstroms and hundreds of several angstroms and most preferably between 10 and 200 angstroms.

The electron emission portion 63 comprises a number of electrically conductive fine particles having a particle diameter on the order of several angstroms to several hundred angstroms, with a range of 10~500 angstroms being particularly preferred. This depends upon the film thickness of the thin film 64 that includes the electron emission portion and the manufacturing process, such as the conditions of the electrification process. The material constituting the electron emission portion 63 is a substance that is partially or completely identical with the devices of the material constituting the thin film 64 that includes the electron emission portion.

Figure 7A:
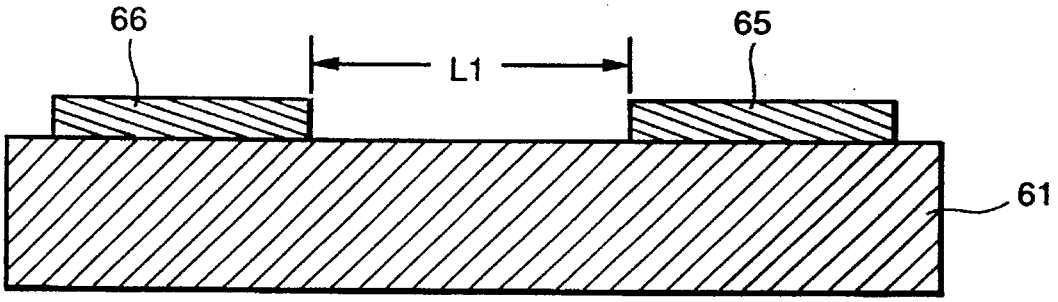
FIGS. 7A~7C are diagrams for describing the basic process for manufacturing a surface-conduction electron-emitting device according to the present invention.
Figure 7B:
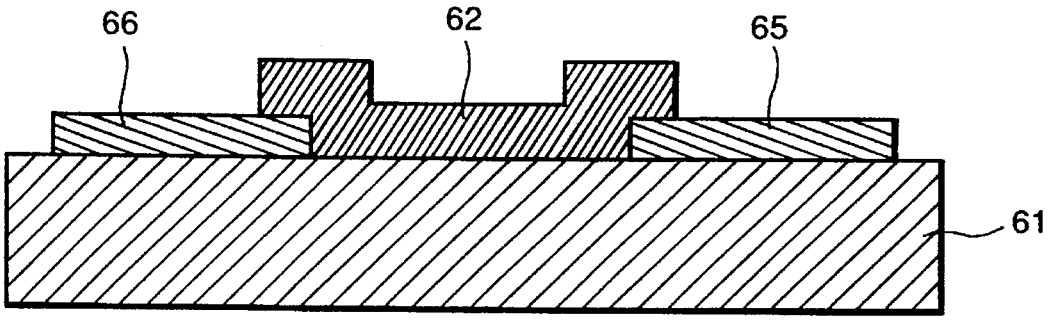
Figure 7C:
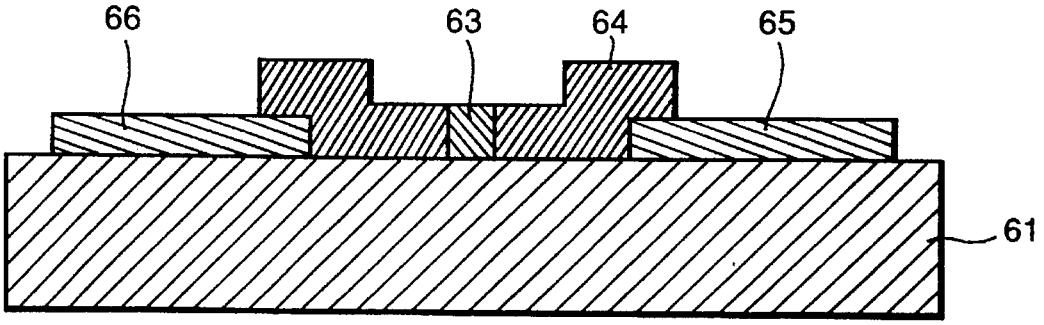

Various processes for manufacturing the electron-emitting device having the electron emission portion 63 are conceivable. One example is shown in FIG. 7, in which numeral 62 denotes a thin film for forming the electron emission portion. An example of the thin film is a film of fine particles.

The manufacturing processing will be described with reference to FIGS. 6 and 7.

1) The substrate 61 is cleaned sufficiently using a detergent, pure water or an organic solvent, after which an device electrode material is deposited by vacuum deposition, sputtering or the like. The device electrodes 65, 66 are formed on the surface of the insulative substrate 61 by photolithography [FIG. 7A].

2) The part of the substrate between the device electrodes 65 and 66 formed thereon is coated with an organic metal solution, which is then left standing. The result is formation of an organic thin metal film. The organic metal solution is a solution of an organic compound whose principal device is a metal such as the aforesaid Pd, Ru, Ag, Au, Ti, In, Cu, Cr, Fe, Zn, Sn, Ta, W or Pb. Thereafter, the organic thin metal film is subjected to a heating and baking treatment and patterning is carried out by lift-off or etching to form the thin film 2 for the electron emission portion [FIG. 7B]. Though formation of the thin film is described as being performed by application of an organic metal film, the invention is not limited to this technique. Formation may be carried out by vacuum deposition, sputtering, chemical vapor deposition, a dispersive coating process, a dipping process, a spinner process, etc.

Figure 8:
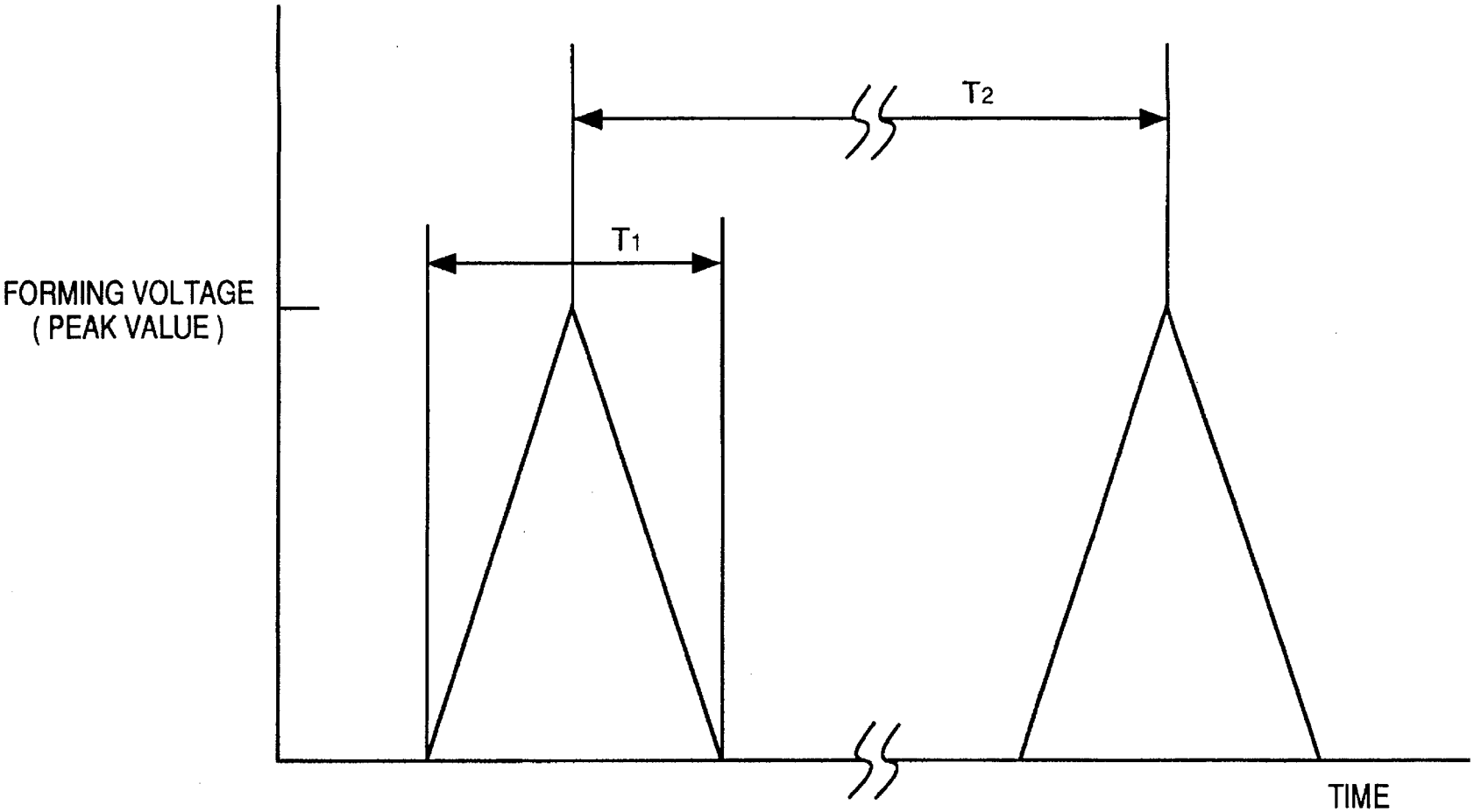
FIG. 8 is a waveform diagram illustrating an example of a forming voltage in a surface-conduction electron-emitting device according to the present invention.

3) Next, an electrification process referred to as "forming" is carried out. Specifically, a voltage is impressed across the device electrodes 65, 66 in pulsed form by means of a power supply (not shown). Alternatively, an electrification process based upon elevating voltage is executed. As a result of electrification, the electron emission portion 63, the structure of which has undergone a change, is formed on the location of the thin film 62 for forming the electron emission portion [FIG. 7C]. Owing to the electrification process, the thin film 62 for forming the electron emission portion is locally destroyed, deformed or changed in property. The resulting region of changed structure is referred to as the electron emission portion 63. As described earlier, the applicants have observed that the electron emission portion 63 is composed of fine conductive particles. FIG. 8 illustrates the voltage waveform in a case where pulses in the forming treatment are applied.

In FIG. 8, T1 and T2 represent the pulse width and pulse interval, respectively, of the voltage waveform. The pulse width T1 is on the order of 1 μsec to 10 msec, the pulse interval T2 is on the order to 10 μsec to 100 msec, and the crest value of the triangular wave (the peak voltage at the time of forming) is selected appropriately. The forming treatment is applied over a period of from several tens of seconds to several minutes under a vacuum of about $10^{-5}$ Torr.

In the formation of the electron emission portion described above, the forming treatment is performed by applying the triangular pulsed voltage across the device electrodes. However, the waveform impressed across the electrodes is not limited to a triangular waveform. Any desired waveform such as a square wave may be used, and the crest value, pulse width and pulse interval thereof also are not limited to the values mentioned above. Desired values may be selected in accordance with the resistance value, etc., of the electron-emitting device so as to form a favorable electron emission portion.

Figure 9:
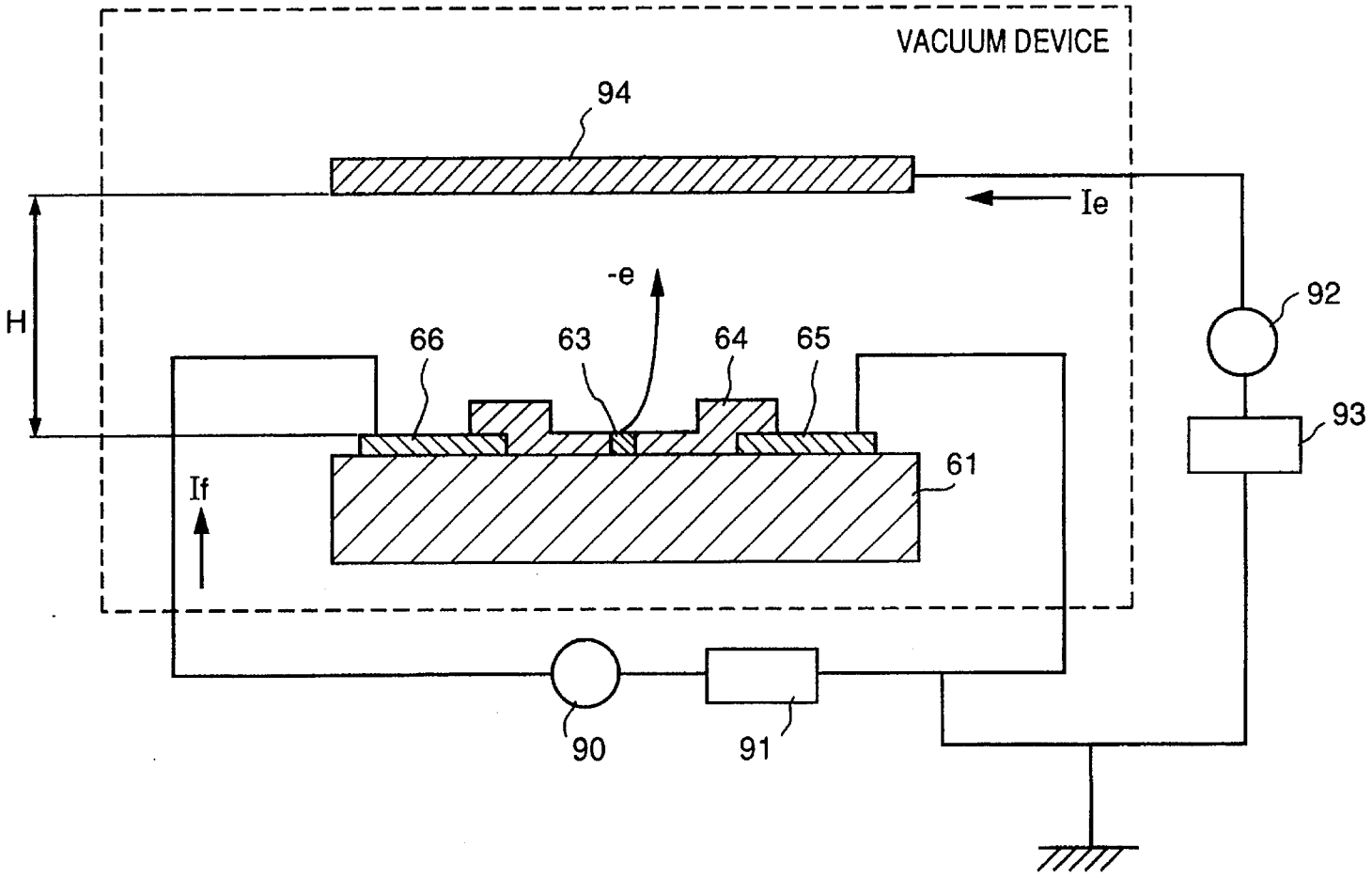
FIG. 9 is a block diagram illustrating the construction of an apparatus for measuring a surface-conduction electron-emitting device according to the present invention.

The electric process following forming is carried out within a measuring apparatus shown in FIG. 9. This apparatus will now be described.

FIG. 9 is a schematic block diagram of a measuring apparatus for measuring the electron emission characteristic of the device having the constitution illustrated in FIGS. 6A and 6B. Shown in FIG. 9 are the substrate 61, the device electrodes 65 and 66, and the thin film 64 for forming the electron emission portion 63. Further, numeral 91 denotes a power supply for applying an device voltage Vf to the device, 90 an ammeter for measuring an device current $I_f$ that flows through the thin film 64 inclusive of the electron emission portion between the device electrodes 65 and 66, 94 an anode electrode for capturing an emission current Ie emitted by the electron emission portion of the device, 93 a high-voltage power supply for applying a voltage to the anode electrode 94, and 92 an ammeter for measuring the emission current Ie emitted by the electron emission portion 63 of the device.

To measure the device current If and emission current Ie of the electron-emitting device, the power supply 91 and ammeter 90 are connected to the device electrodes 65, 66, and the anode electrode 94 to which the power supply 93 and ammeter 92 are connected is placed above the electron-emitting device. The electron-emitting device and anode electrode 94 are placed inside a vacuum apparatus, which is equipped with equipment (not shown) such as an exhaust pump and vacuum gauge and other pieces necessary for vacuum operating chamber. The device is measured and evaluated in the desired vacuum.

Measurement is performed at an anode-electrode voltage of 1~10 kV and with a distance H between the anode electrode and electron-emitting device of 2~8 mm.

Figure 10:
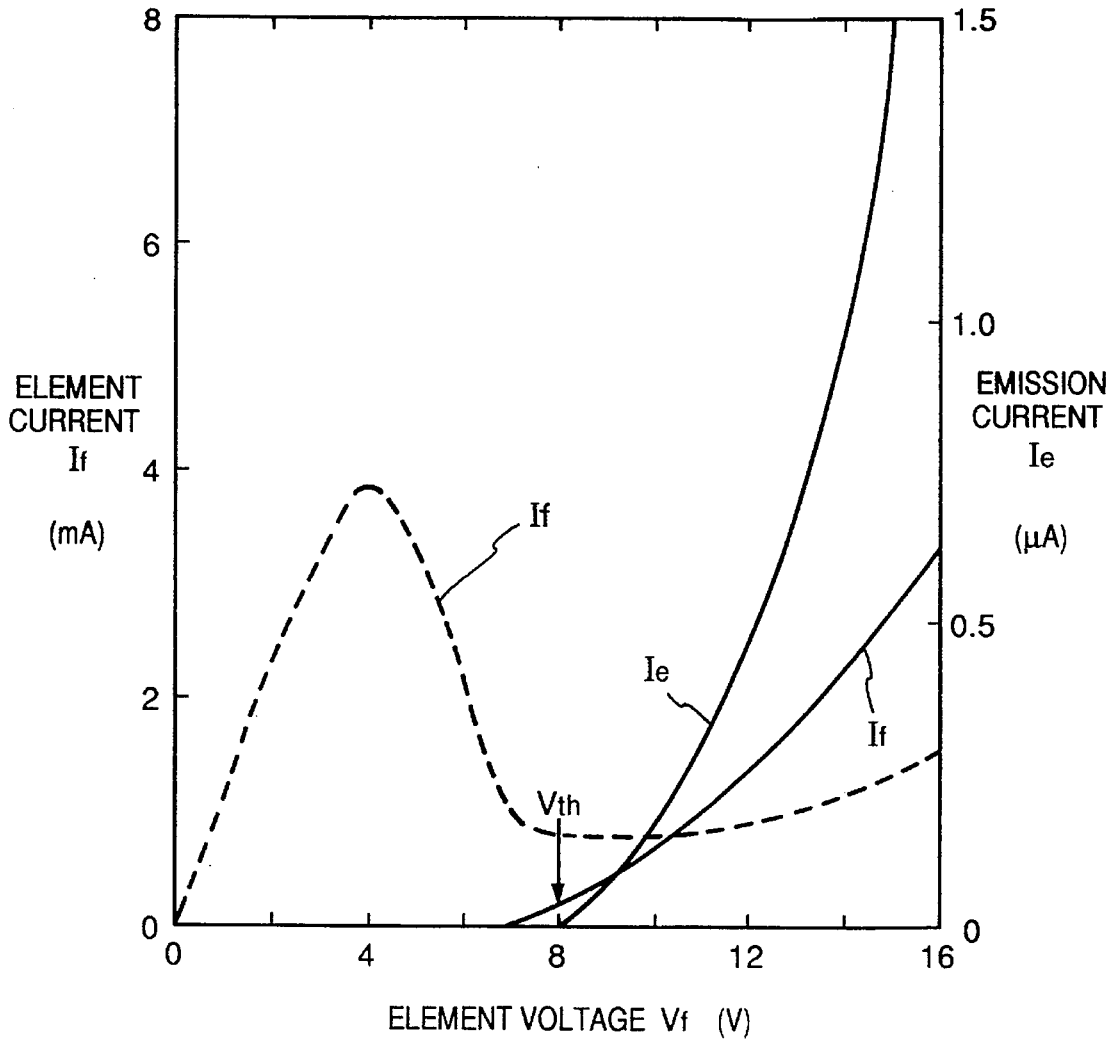
FIG. 10 is a diagram illustrating an example of the characteristics of a surface-conduction electron-emitting device according to the present invention.

FIG. 10 illustrates a typical example of the relationship among the emission current Ie, device current If and device voltage Vf measured by the measuring apparatus of FIG. 9. FIG. 10 is illustrated using arbitrary units since the emission current Ie is very small in comparison with the device current If. It should be evident from FIG. 10 that this electron-emitting device has three features with respect to emission current Ie.

First, when an device voltage greater than a certain voltage (referred to as a threshold voltage, indicated by Vth in FIG. 7) is applied to the device, the emission current Ie suddenly increases. When the applied voltage is less than the threshold voltage Vth, on the other hand, almost no emission current Ie is detected. In other words, the device is a non-linear device having the clearly defined threshold voltage Vth with respect to the emission current Ie.

Second, since the emission current Ie is dependent upon the device voltage Vf, it is capable of being controlled by the device voltage Vf.

Third, the emitted electric charge captured by the anode electrode 94 is dependent upon the time over which the device voltage Vf is applied. That is, the amount of electric charge captured by the anode electrode 94 is capable of being controlled based upon the time over which the device voltage Vf is applied.

Since the characteristics of the surface-conduction electron-emitting device set forth above are such that the device current If and emission current Ie monotonously increase with respect to the applied device voltage, the electron-emitting device according to the present invention can be applied in a wide variety of ways.

An example of the characteristic in which the device current If increases monotonously with respect to the device voltage Vf (this is referred to as an MI characteristic) is indicated by the solid line If in FIG. 10. However, there are also cases in which the device current If exhibits a voltage-controlled negative resistance characteristic (referred to as a VCNR characteristic) with respect to the device voltage Vf (see the dashed line in FIG. 10). These characteristics of the device current are believed to be dependent upon the manufacturing method and the measurement conditions when measurement is performed. In this case also the electron-emitting device has the three features, in terms of its characteristics, set forth above.

Furthermore, in a surface-conduction electron-emitting device, part of the basic manufacturing process for the basic device construction of the invention may be changed.

Figure 2:
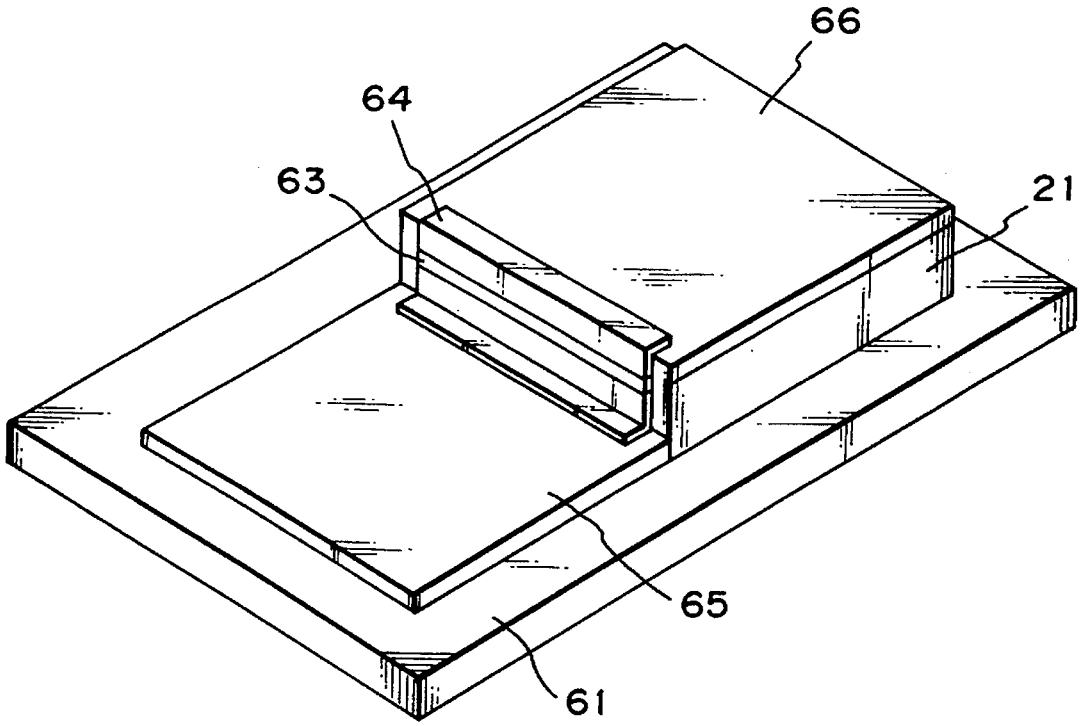
FIG. 2 is a diagram showing the basic construction of a vertical-type surface-conduction electron-emitting device according to the present invention.
Figure 3A:
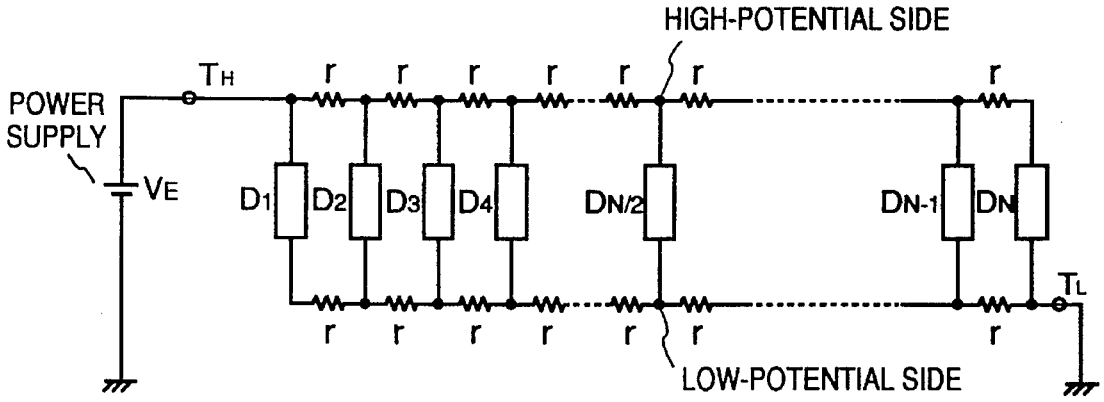
FIGS. 3A~3C are diagrams for describing problems that arise in forming according to an example of the prior art.
Figure 3B:
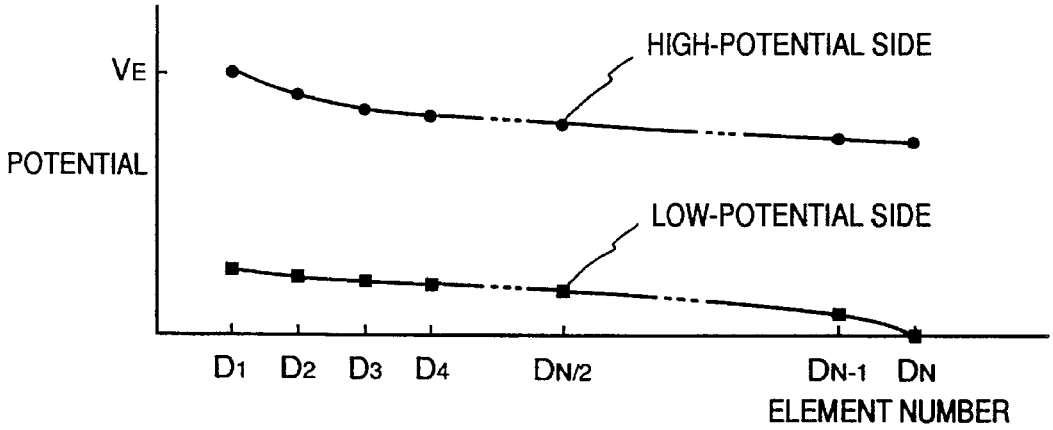
Figure 3C:
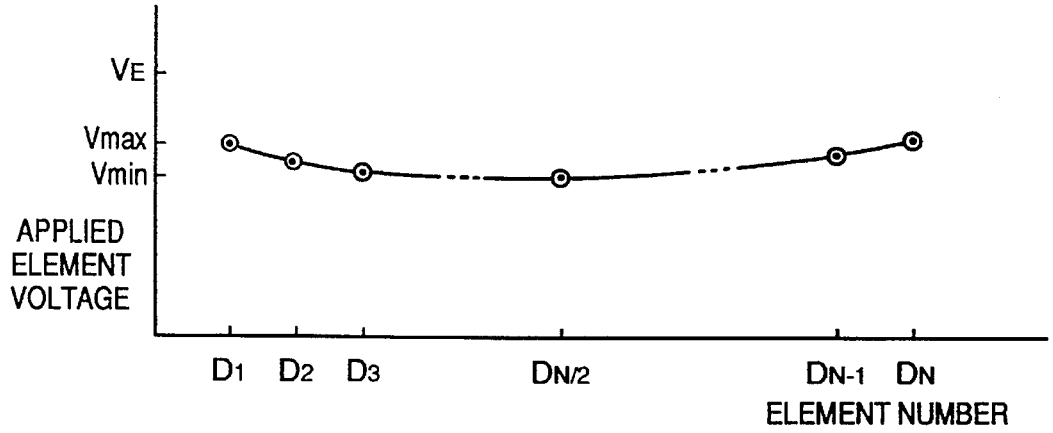
Figure 4A:
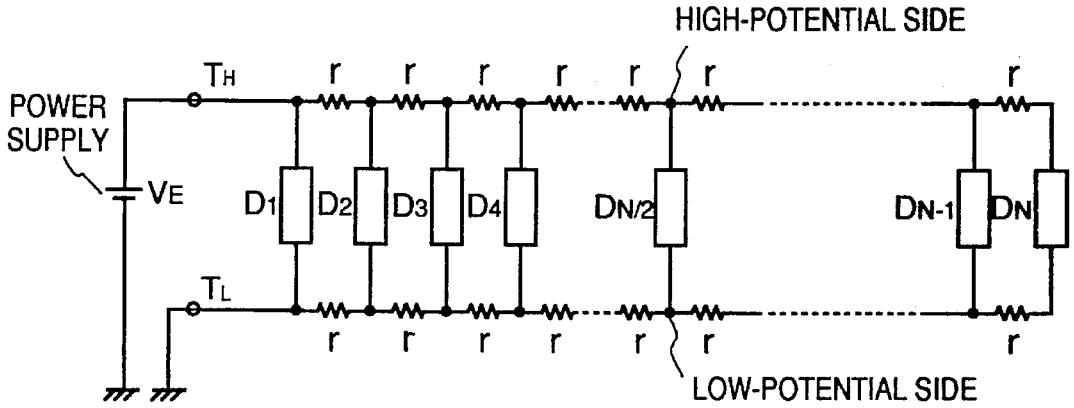
FIGS. 4A~4C are diagrams for describing problems that arise in conventional forming according to another example of the prior art.
Figure 4B:
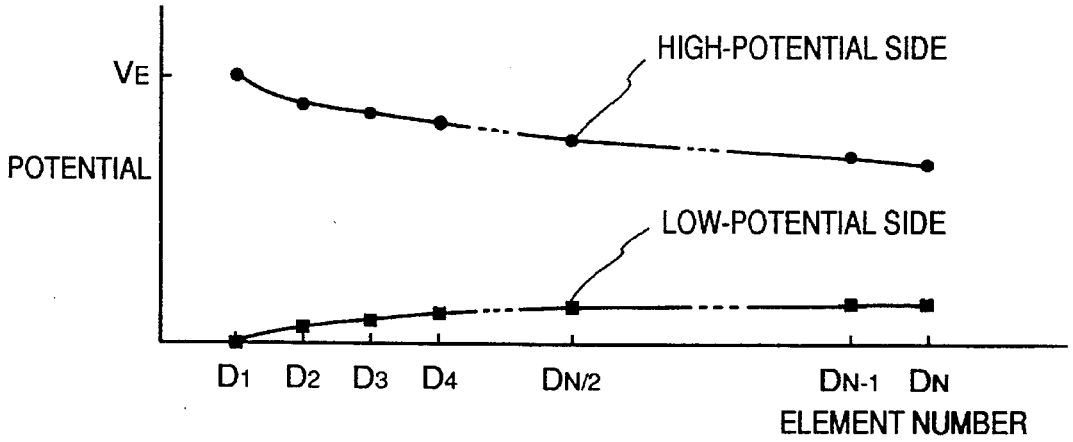
Figure 4C:
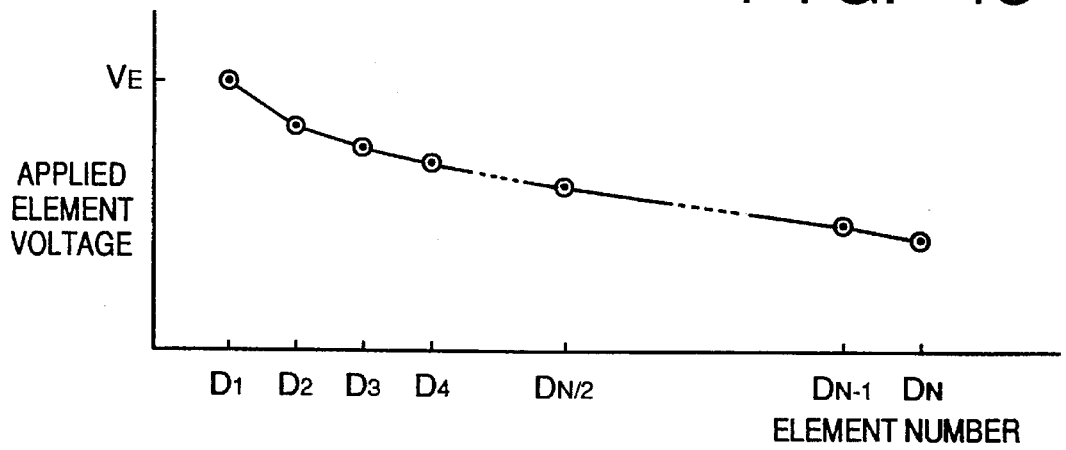
Figure 5:
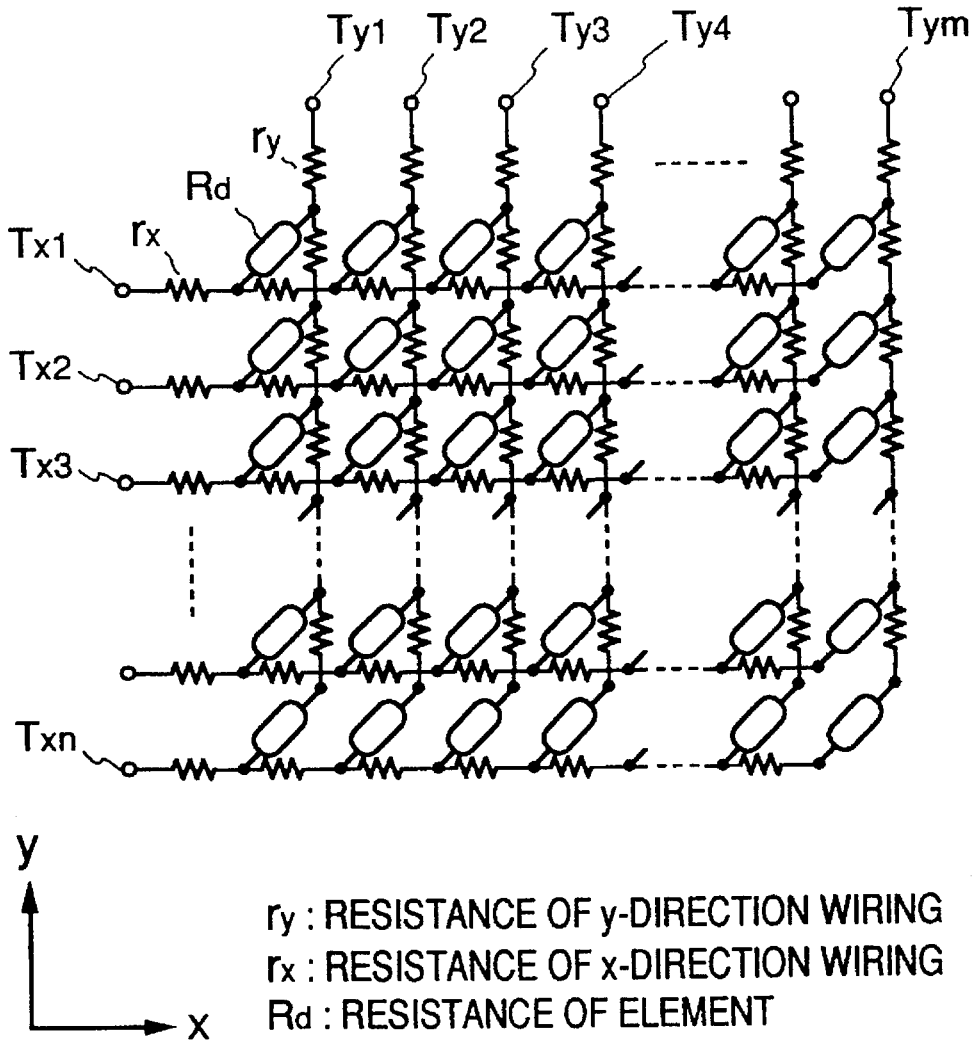
FIG. 5 is a diagram illustrating an example of simple matrix wiring.

Next, the step-type surface-conduction electron-emitting device, which is the other type of surface-conduction electron-emitting device according to the present invention, will be described. FIG. 2 is a schematic view illustrating the construction of a basic step-type surface-conduction electron-emitting device according to the present invention.

Shown in FIG. 2 are a substrate 61, device electrodes 65 and 66, a thin film 64 that includes an electron emission portion 63, and a step forming portion 21.

The substrate 61, the device electrodes 65 and 66, the thin film 64 that includes the electron emission portion and the electron emission portion 63 consist of materials similar to those use in the plane-type surface-conduction electron-emitting device described above. The step forming portion 21 and the thin film 64 including the electron emission portion, which characterize the step-type surface-conduction electron-emitting device, will now be described in detail.

The step forming portion 21 consists of an insulative material such as $SiO_2$ formed by vacuum deposition, printing, sputtering, etc. The thickness of the step forming portion 21 which corresponds to the electrode spacing L1 of the plane-type surface-conduction electron-emitting device described earlier, is on the order of several hundred angstroms to several tens of micrometers. The thickness is set depending upon the manufacturing method of the step forming portion, the voltage applied across the device electrodes and the electric field strength capable of producing the electron emission. Preferably, the thickness is on the order of several thousand angstroms to several micrometers.

Since the thin film 64 that includes the electron emission portion is formed after the device electrodes 65, 66 and step forming portion 21 are fabricated, it is formed on the device electrodes 65, 66. In some cases the thin film 64 is given a predetermined shape devoid of an overlapping portion that carries the electrical connections of the device electrodes 65, 66. Further, the film thickness of the thin film 64 that includes the electron emission portion depends upon the manufacturing process thereof. There are many cases in which film thickness at the step portion and film thickness of the portions formed on the device electrodes 65, 66 differ. The film thickness at the step portion generally is less. It should be noted that though the electron emission portion 63 is shown as being linear on the step forming portion 21 in FIG. 2, this does not place a limitation upon its shape and position. The shape and position are dependent upon the fabrication conditions, the forming conditions, etc.

Though the basic construction and manufacturing process of the surface-conduction electron-emitting device has been described, the scope of the invention is such that the invention is not limited to the foregoing construction so long as it possesses the three features described above in connection with the characteristics of the surface-conduction electron-emitting device. The surface-conduction electron-emitting device is applicable also to an electron source and an image forming apparatus such as a display apparatus described later.

The electron source and an image forming apparatus according to the present invention will now be described.

An electron source or an image forming apparatus can be constructed by arraying a plurality of the electron-emitting devices of the invention on a substrate.

One example of a method of arraying the electron-emitting devices on the substrate is the ladder array. Here, as in the prior art, a number of surface-conduction electron-emitting devices are arrayed in parallel and both ends of the individual devices are connected by wiring to form a row of the electron-emitting devices. A number of these rows are arrayed along the row direction. Control electrodes (referred to as a grid) are arranged in the space above the electron source in a direction (referred to as the column direction) perpendicular to the wiring of the rows. This arrangement is called a ladder arrangement and in this arrangement, the electrons are controlled by the control electrodes. Another example is referred to as a simple matrix arrangement. Here n-number of Y-direction wires are placed upon m-number of X-direction wires via an interlayer insulating layer, and the X- and Y-direction wires are connected to respective ones of the pair of device electrodes of each surface-conduction electron-emitting device. The simple matrix arrangement will now be described in detail.

A surface-conduction electron-emitting device according to the present invention has three basic features in terms of its characteristics.

First, when an device voltage greater than a certain voltage (referred to as a threshold voltage, indicated by Vth in FIG. 10) is applied to the device, the emission current Ie suddenly increases. When the applied voltage is less than the threshold voltage Vth, on the other hand, almost no emission current Ie is detected. In other words, the device is a non-linear device having the clearly defined threshold voltage Vth with respect to the emission current Ie.

Second, since the emission current Ie is dependent upon the device voltage Vf, it is capable of being controlled by the device voltage Vf.

Third, the emitted electric charge captured by the anode electrode 94 is dependent upon the time over which the device voltage Vf is applied. That is, the amount of electric charge captured by the anode electrode 94 is capable of being controlled based upon the time over which the device voltage Vf is applied.

In accordance with the foregoing, the electrons emitted by the surface-conduction electron-emitting devices, even when they have the form of the simple matrix array, are controlled by the peak value and width of a pulsed voltage applied across the opposing device electrodes at a voltage above the threshold value. Almost no electrons are emitted at an applied voltage below the threshold value. In accordance with this characteristic, surface-conduction electron-emitting devices can be selected in accordance to an input signal if a pulse voltage is suitably applied to the individual devices even in a case where a number of the devices are placed in an array. This makes it possible to control the amount of electron emission.

The construction of an electron-source substrate produced on the basis of this principle will now be described with reference to FIG. 11, in which there are shown an insulative substrate 111, X-direction wiring 112, Y-direction wiring 113, surface-conduction electron-emitting devices 114 and connections 115. It should be noted that the surface-conduction electron-emitting devices 114 may be of the plane or step type.

Figure 11:
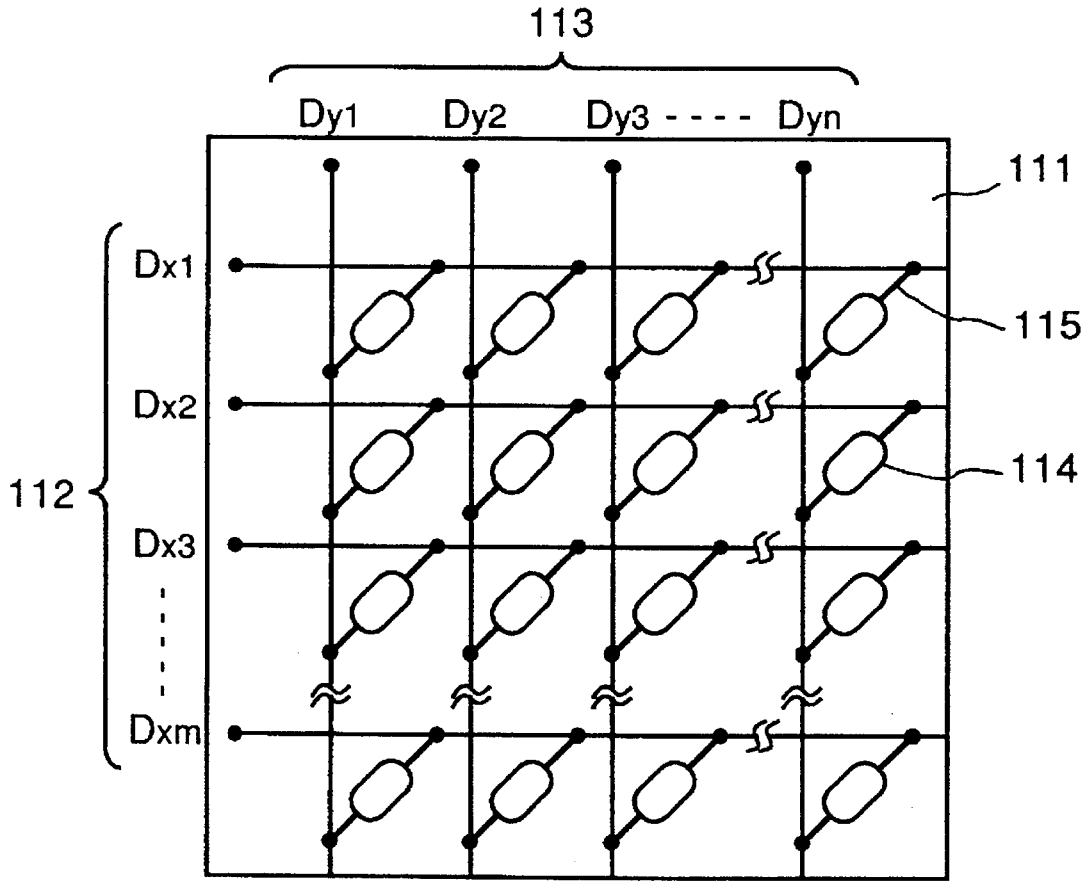
FIG. 11 is a diagram showing an example of a circuit in which electron sources are arrayed in the form of a matrix according to the invention.

In FIG. 11, the insulative substrate 111 is the above-mentioned glass substrate or the like, the size and thickness of which are suitably set depending upon the number of surface-conduction electron-emitting devices placed on the substrate 111, the shape of the individual devices in terms of design and, if the substrate 111 is a part of a vessel which is constructed for the purpose of using the devices as an electron source, the conditions for maintaining the interior of the vessel in an evacuated state. The X-direction wires 112 comprise m-number of wires $D_{X1}$, $D_{X2}$, . . . $D_{Xm}$. These consist of an electrically conductive metal in desired patterns formed on the insulative substrate 111 by vacuum deposition, printing or sputtering, etc. The material, film thickness and wiring width are set in such a manner that a substantially uniform voltage will be supplied to a number of the surface-conduction electron-emitting devices. The Y-direction wires 113 comprise n-number of wires $D_{Y1}$, $D_{Y2}$, . . . $D_{Yn}$. Like the X-direction wiring 112, these consist of an electrically conductive metal in desired patterns formed on the insulative substrate 111 by vacuum deposition, printing or sputtering, etc. The material, film thickness and wiring width are set in such a manner that a substantially uniform voltage will be supplied to a number of the surface-conduction electron-emitting devices. An interlayer insulating layer (not shown) is placed between the m-number X-direction wires 112 and n-number of Y-direction wires 113 to electrically isolate them and construct matrix wiring (it should be noted that m, n are positive integers).

The interlayer insulating layer (not shown) is a material such as SiO2 formed by vacuum deposition, printing or sputtering or the like. The layer is formed in a desired shape on the entire surface, or on a part thereof, of the insulative substrate 111 on which the X-direction wiring 112 has been formed. The film thickness, material and method of manufacture are suitably selected so that the insulating layer will be capable of withstanding the potential difference at the points of intersection between the X-direction wiring 112 and Y-direction wiring 113. The wires constituting the X-direction wiring 112 and Y-direction wiring 113 are led out as external terminals.

Further, as set forth earlier, the opposing electrodes (not shown) of the surface-conduction electron-emitting devices 114 are electrically connected by the m-number of X-direction wires 112 and n-number of Y-direction wires 113 and by the wires 115 comprising an electrically conductive metal or the like formed by vacuum deposition, printing or sputtering, etc.

The electrically conductive metal of the m-number of X-direction wires 112, the n-number of Y-direction wires 113, the wires 115 and the opposing device electrodes may consist of the same devices in whole or in part, or the metals may differ. The electrically conductive metal is suitably selected from the metals Ni, Cr, Au, Mo, W, Pt, Ti, Al, Cu and Pd or alloys of these metals, printed conductors consisting of the metals Pd, Ag, Au, $RuO_2$, Pd-Ag or metal oxides and glass, transparent conductors such as $In_2O_3$-$SnO_2$ and semiconductor materials such as polysilicon. Further, the surface-conduction electron-emitting devices may be formed on the insulative substrate 111 or on the interlayer insulating layer, not shown.

More specifically, scanning-signal generating means (not shown) is electrically connected to the X-direction wiring 112, as will be described later. The scanning-signal generating means applies a scanning signal for scanning, in dependence upon the input signal, the rows of the surface-conduction electron-emitting devices arrayed in the X-direction. On the other hand, modulating-signal generating means (not shown) is electrically connected to the Y-direction wiring 113, as will be described later. The modulating-signal generating means applies a modulating signal for modulating, in dependence upon the input signal, each column of the columns of the surface-conduction electron-emitting devices arrayed in the Y-direction. Furthermore, the driving voltage applied to each device of the surface-conduction electron-emitting devices is supplied as a difference voltage between the scanning signal and modulating signal applied to the devices.

In the arrangement described above, individual devices can be selected and driven independently merely by simple matrix wiring.

Current is fed to the device through the above-described wiring when the aforementioned surface-conduction electron-emitting devices are formed by the forming process. However, owing to the problems mentioned earlier, the voltage applied at the time of the forming process causes a distribution in the amount of electron emission of each device owing to a distribution in the potential drop resulting from the wiring and heat damage in the wiring. When the surface-conduction electron-emitting devices are used as an electron source, it is difficult to obtain a uniform quantity of electrons with a simple driver. In a case where the surface-conduction electron-emitting devices are used as an image forming apparatus, a shortcoming is that a distribution in luminance occurs.

This problem is solved by using the above-described process for forming the plurality of electron-emitting devices according to the present invention. Preferred means will be described below for each and every means.

Means A-1 will be described first.

In the electron source having the simple matrix arrangement of FIG. 11, a potential V2 is applied to all wiring terminals $D_{X1}$ to $D_{Xm}$ in the X direction, a potential V1 different from V2 is applied to at least one arbitrarily selected wiring terminal $D_{Yi}$ in the Y direction, and the potential V2 is applied to all of the remaining Y-direction wiring terminals. In accordance with the present invention, forming is carried out by applying a voltage of V1–V2 [V] solely to the surface-conduction electron-emitting devices connected to the arbitrarily selected Y-direction wiring, and applying a voltage of V1–V2=0 [V] to the other unselected surface-conduction electron-emitting devices. Forming is concluded by repeating this process successively. (This process shall be referred to as "line forming".)

More specifically, the unselected surface-conduction electron-emitting devices do not attain a floating state (a state of unstable potential) and the voltage applied to the devices (while forming is in progress) is not diverted by the matrix wiring. As a consequence, the surface-conduction electron-emitting devices not undergoing the forming treatment are not damaged or destroyed by static electricity and the electron emission portions can be prevented from deteriorating owing to the influence of the voltage being applied to the devices undergoing forming. This makes it possible to obtain uniform characteristics for each device.

The aforementioned potentials V1 and V2 are not necessarily limited to a fixed potential (DC) that does not fluctuate with time. These potentials can be pulsed waveforms such as triangular or square waves. Further, both of the potentials V1, V2 may be DC waveforms or pulsed waveforms or only one may be a pulsed waveform. At this time the difference voltage V1–V2 [IV] applied to surface-conduction electron-emitting devices that are to be subjected to the forming treatment can be supplied as a voltage waveform sufficient to form the electron emission portions by the forming treatment. In the case of a pulsed waveform, the difference voltage V1–V2 [V] is a peak voltage. Further, a column arbitrarily selected in order to carry out the forming treatment may be one column or a plurality of columns simultaneously. In a case where a plurality of columns are selected, the temperature distribution within the substrate, which is caused by the evolution of heat at forming, is taken into consideration. Accordingly, it is preferred that the columns be selected in, say, a zigzag manner to uniformalize the temperature distribution. In a case where a plurality of columns are subjected to forming simultaneously, the time required for forming is shortened but this requires that the voltage supply have a large current capacity. Accordingly, in working the present invention, it is preferred that forming be carried out by selecting the number of columns giving the best economical effects upon taking into consideration the time required for forming and the current capacity of the voltage supply.

Furthermore, which of the X- and Y-direction wiring is selected to perform line forming should be decided in the manner described below.

Figure 12:
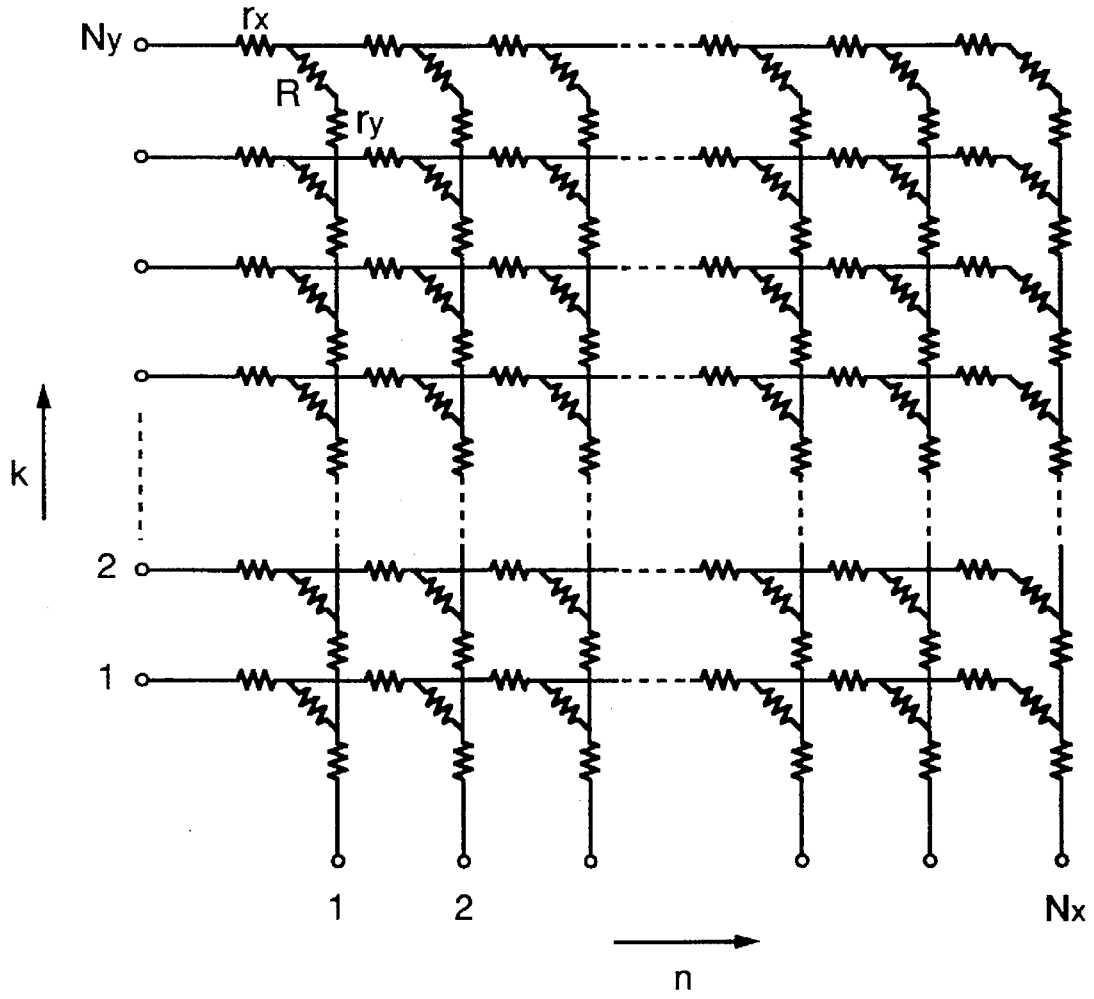
FIG. 12 is an equivalent circuit diagram of a circuit in which electron sources are arrayed in the form of a matrix according to the invention.
Figure 13:
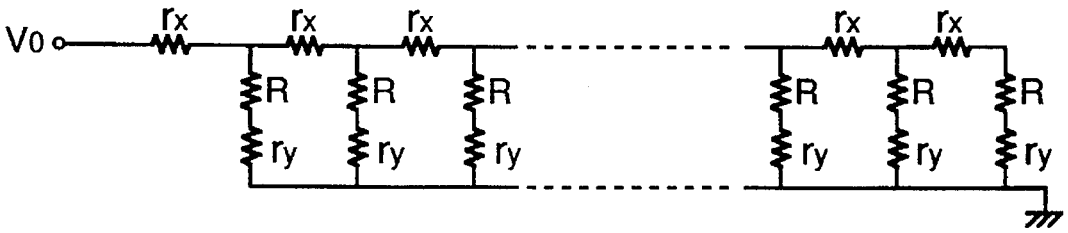
FIG. 13 is an equivalent circuit diagram showing a state which prevails at the time of line forming.
Figure 14:
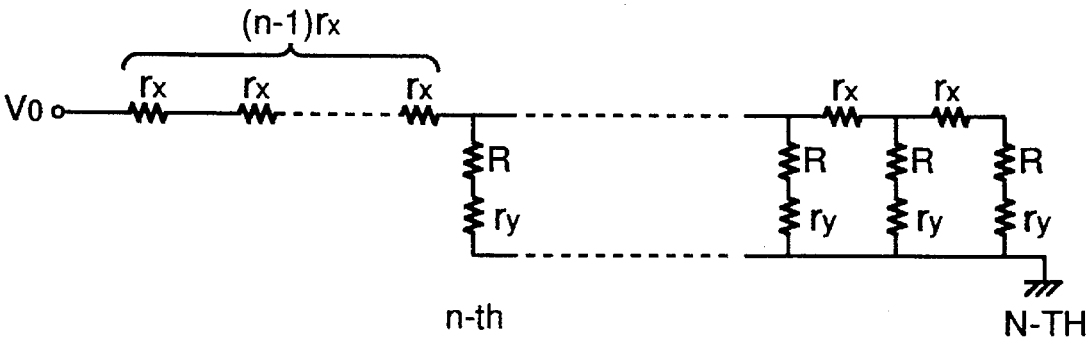
FIG. 14 is an equivalent circuit diagram at the time of forming an n-th device in line forming.

FIG. 12 illustrates an equivalent circuit of a simple-matrix display apparatus using surface-conduction electron-emitting devices. Here R represents device resistance and $r_x$, $r_y$ represent wiring resistance, in the horizontal and vertical directions, per pixel. Further, let $N_x$ represent the number of devices in the horizontal direction and $N_y$ the number of devices in the vertical direction. When this display apparatus is subjected to the forming treatment, electric forming usually is carried out one column at a time or one row at a time. This so-called "line forming" means carrying out forming by supplying electric power to a number of devices from a predetermined power supply portion (one or a plurality of locations); it does not necessarily mean forming a number of devices simultaneously. FIG. 13 is an equivalent circuit schematically illustrating line forming. Here the impedance of the wiring, etc., outside the apparatus is negligible in comparison with $r_x$, $r_y$, R. FIG. 13 shows an example in which forming is carried out collectively in the horizontal direction (the k-th line from ground). If the device resistance R and wiring resistances $r_x$, $r_y$ do not exhibit variance, the potential division at the devices is such that the device nearest the power supply portion always is the highest, as evident from FIG. 13. In addition, the resistance of a formed device is more than two or three digits greater that the resistance R prior to the forming treatment. Accordingly, when line forming is carried out, devices are electrically formed (=cut off) successively from the power supply portion side. FIG. 14 is an equivalent circuit for when devices are electrically formed up to the (n−1)th device and the n-th device is subjected to forming. More specifically, in this state also, the n-th device nearest the power supply portion is electrically formed and the equivalent circuit at the next point in time becomes a ladder-shaped configuration having one less device than in the circuit of FIG. 14. If a constant voltage $v_0$ is applied to the power supply portion in a state in which devices up to the (n−1)th device are electrically formed, the voltage impressed upon the n-th device will be given by the following equation:

$$v(k,n)=[1-k\times r_y/R-n\times(Nx-n+1)\times r_x/R]v_0 \quad (1)$$

This equation can readily be evaluated as a series of N-n stages of an ordinary four-terminal matrix. Here $r_x$, $r_y$ are made sufficiently small in comparison with R. If this is expressed in terms of power, then the power applied to the n-th device will be given by the following equation:

$$p(k,n)=[1-2\times k\times r_y/R-2\times n\times(Nx-n+1)\times r_x/R]\times v_0\times v_0/R \quad (2)$$

Figure 15:
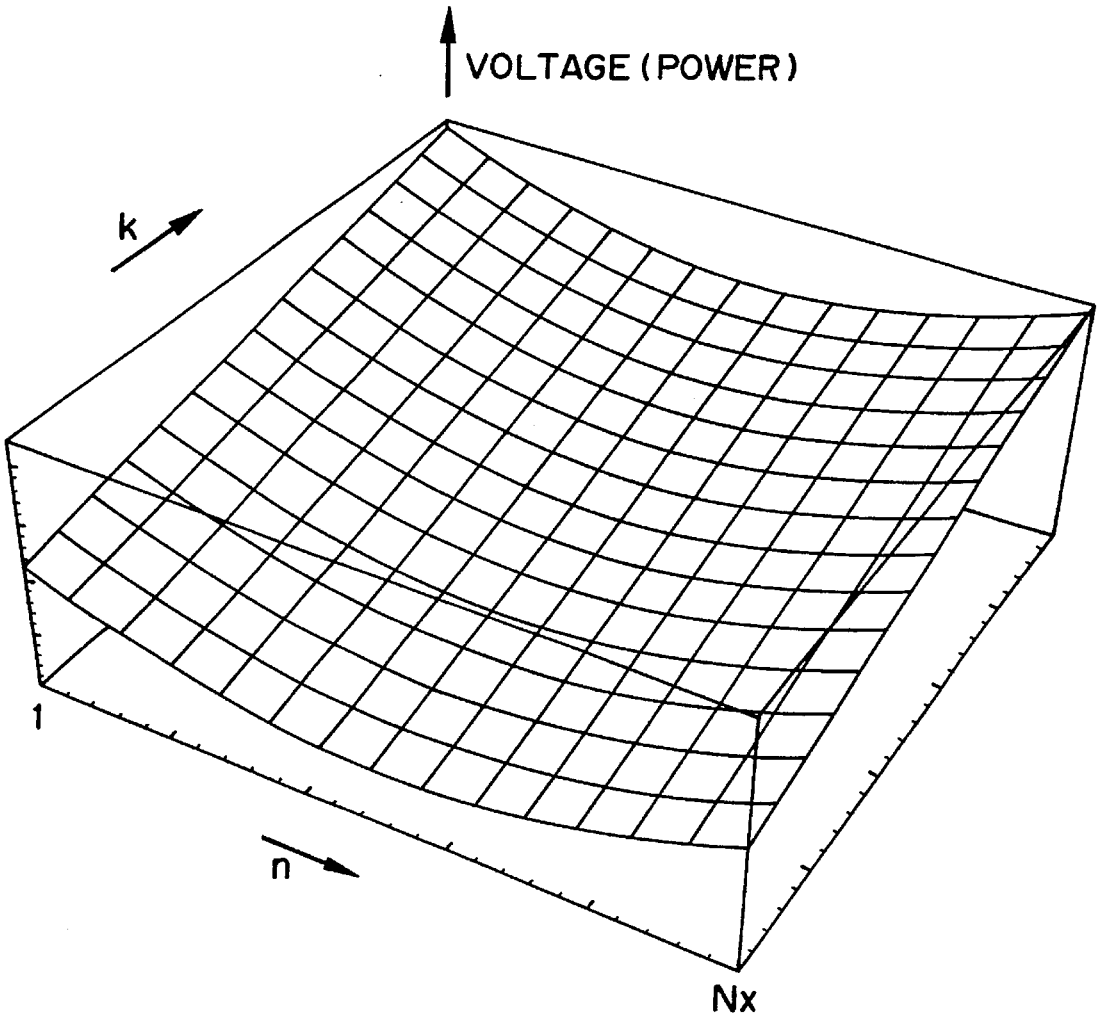
FIG. 15 is a diagram showing distribution of applied voltage of each device at the time of line forming.

In other words, it may be appreciated that v, p are functions of k, n and vary as a second degree function of the device address n in the line-forming direction and as a first degree function of the device address k in the other direction. FIG. 15 is a schematic view of voltage or power distribution within this example.

The line-forming method described above leads to the following problem: As will be understood from FIG. 15, even if a constant voltage is applied to the power supply portion, a difference develops, depending upon the device address, in the voltage and power applied when the device is electrically formed. This phenomenon has a great influence when the number of devices is large and when the wiring resistance becomes large in comparison with the device resistance. The difference between maximum and minimum, in the n direction, of power applied immediately before each device is electrically formed is given by Equation (3) below. Specifically, maximum power is developed at the power supply end (n=1) and minimum power is developed at the central portion (n=Nx/2). If $p0=v_0\times v_0/R$, we have $$p(k,1)-p(k,N_x/2)\sim N_x\times N_x/2\times(r_x/R)\times p0 \quad (3)$$

wherein $N_x>>1$.

Further, the difference between maximum and minimum in the k direction is given by the following equation since the maximum is developed at the power supply portion end (k=1) and the minimum is developed at the ground end ($k=N_y$).

$$p(1,n)-p(N_y,n)\sim 2\times N_y\times(r_y/R) \quad (4)$$

wherein $N_y>>1$.

When the number of elements (devices) in the line-forming direction increases, a difference in the forming conditions between elements (devices) suddenly develops, as indicated by the two equations given above. Accordingly, adverse effects that cannot be ignored arise when a panel is made for an image forming apparatus. The example of FIG. 15 is for a case in which the power supply portion is at one end of the row (or column). In a case where power supply portions are at both ends, the power applied immediately before each device is electrically formed becomes large, owing to the symmetry of the system, at both ends and at the central portion of the line (or column) subjected to line forming, and becomes small in the vicinity of a length of one-quarter of the line from both ends. Thus, a variance occurs depending upon the device address.

In the end, therefore, in a case where a simple matrix is subjected to line forming, the power applied to the n-th device is as given by the following equation when a constant voltage $v_0$ is applied to the power supply portion:

In order to generalize a method of power supplying in the embodiment, N' is introduced. The relation N'=N holds in case of power supplying on one side, and the relation N'=N/2 holds in case of power supplying on both sides $$p(k,n)=[1-2\times k\times r_y/R-2\times n\times(N'n+1)\times r_x/R]p0;p0=v_0\times v_0/R \quad (5)$$

Difference between maximum and minimum power in n direction:

$$\Delta p=N'\times N'/2\times(r_x/R)\times p0 \quad (6)$$

Difference between maximum and minimum power in k direction:

$$\Delta p=2\times N_y\times(r_y/R)\times p0 \quad (7)$$

wherein the relation $n>N_x/2$ is corresponding to $n\leqq N_x/2$ in case of power supplying on both sides.

Figure 16A:
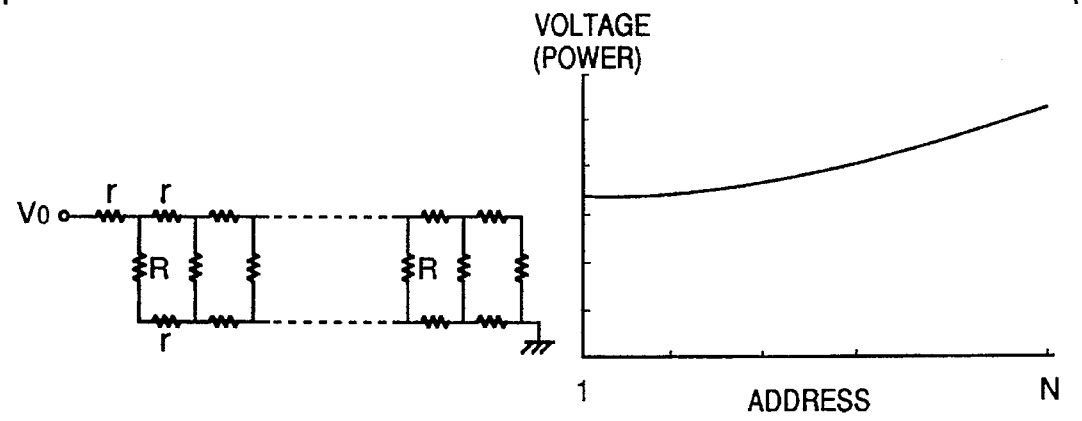
FIGS. 16A~16C are diagrams for describing an equivalent circuit at the time of forming of devices connected in a ladder array, as well as the distribution of voltage applied to each device.

Furthermore, the same problem occurs also in a case where the surface-conduction electron-emitting devices are arrayed in the shape of a one-dimensional ladder rather than a simple matrix. FIGS. 16A, B, and C illustrate examples of equivalent circuits and examples of the difference, due to the device address, in applied power immediately before each device is electrically formed in a case where a constant voltage is applied to the power supply portion.

Let N represent the number of devices, r the wiring resistance per device and R the device resistance.

FIG. 16A is an example in which the power supply portion is placed at one location at one end of the ladder line and the grounded portion is placed at one location at the other end. When a voltage $v_0$ is applied to the power supply portion, devices are electrically formed up to the (n−1)th device and the power applied when the n-th device is electrically formed is a function of n, as follows:

$$p(n)=[1+(n\times n+n-N\times N-3\times N-2)\times(r/R)]\times p0;p0=v_0\times v_0/R \quad (8)$$

The difference between maximum and minimum becomes $$\Delta p=p(N)-p1(1)=(N+2)\times(N-1)\times p0 \quad (9)$$

Figure 16B:
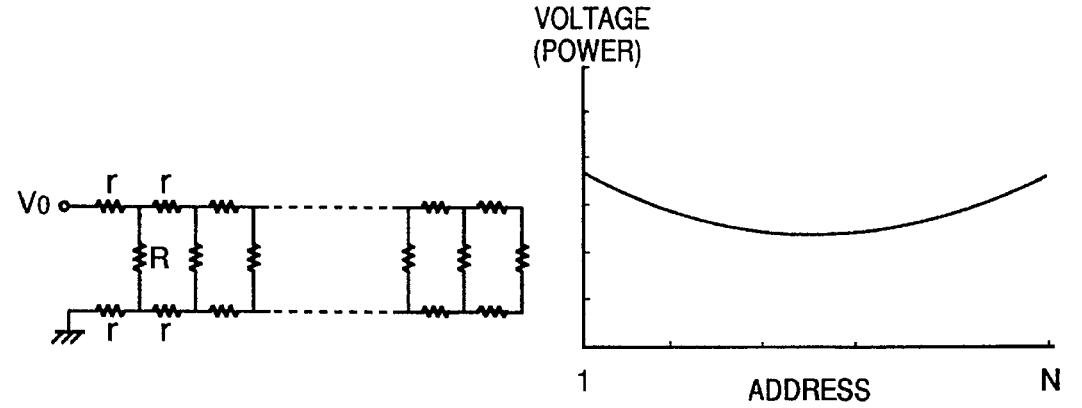

FIG. 16B is an example in which the power supply portion and the grounded portion are placed at one end on the same side of the ladder line.

Figure 16C:
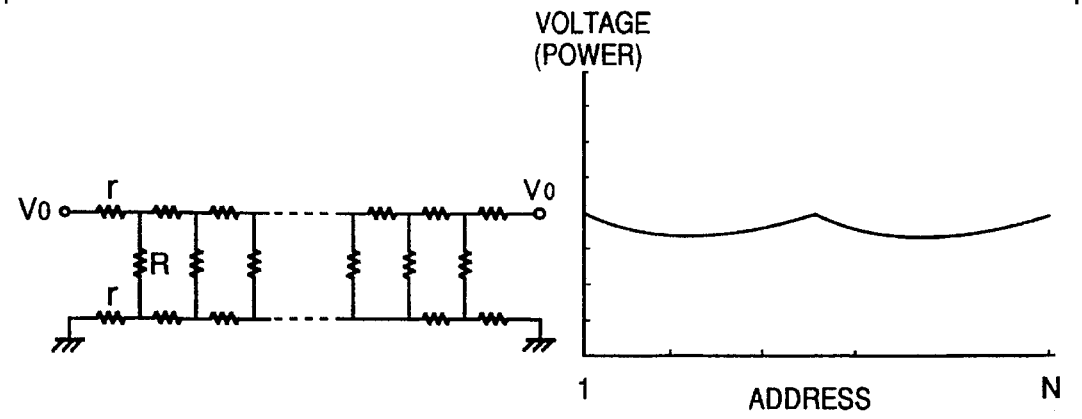

FIG. 16C is an example in which the power supply portions and the grounded portions are each placed at one respective position on both sides of the ladder line. As in the case of FIG. 16A, we obtain p(n), Δp as follows:

$$p(n)=[1-4\times n\times(N'n+1)\times(r/R)]\times p0;p0=v_0\times v_0/R \quad (10)$$

$$\Delta p=p(1)-p(N'/2)=N'\times N'\times(r/R)\times p0 \quad (11)$$

The relation N'=N holds in case of FIG. 16B, and the relation N'=N/2 holds in case of FIG. 16C (n is considered to be symmetrical in relation to N/2).

As will be understood from FIG. 16A~16C, even if a constant voltage is applied to the power supply portion, even in the case of a one-dimensional array, power applied immediately before each device is electrically formed will develop a variance owing to the device address.

Accordingly, when an apparatus having surface-conduction electron-emitting devices in a two-dimensional array is subjected to electrification forming one line at a time, good results will be obtained if forming can be carried out by selecting the direction (row or column direction) that will reduce the variance in power applied to each device.

More specifically, this is a forming method for multiple electron sources characterized in that forming is carried out in the x direction if the following holds:

$$(N_y\times N_x-a\times N_x)\times r\leqq(N_y\times N_y-a\times N_y)\times r_y \quad (12)$$

and forming is carried out in the y direction if the following holds:

$$(N_x\times N_x-a\times N_x)\times r>(N_y\times N_y-a\times N_y)\times r_y \quad (13)$$

where x and y are the two-dimensional directions, $N_x$, $N_y$ represent the numbers of pixels in the respective directions and $r_x$, $r_y$ represent the wiring resistances per device in the respective directions.

Here a=8 holds in a case where a power supply portion is at one end of x or y, and a =24 holds in a case where power supply portions are at both ends of x or y. It should be noted that the direction is decided by the power applied when each device is electrically formed. The equations representing the foregoing conditions will now be described in simple terms.

Since forming by electrification is considered to a thermal phenomenon, the power applied to each device represents a problem. Accordingly, the equation set forth above may be considered as follows $$p(k,n)=[1-2\times k\times r'/R-2\times n\times(N-n+1)\times r/R]\times p0;p0=v_0\times v_0/R \quad (14)$$

Figure 17A:
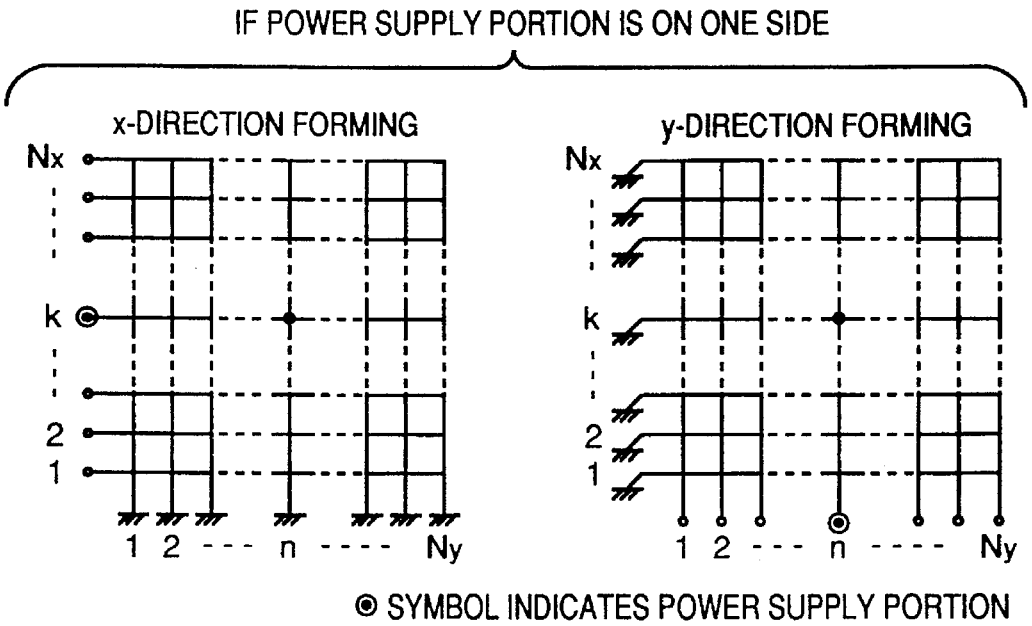
FIG. 17A is diagram for describing a state in which forming is carried out by passing current from one side.

In this case, if the forming is performed in X direction, then $r=r_x$, $r'=r_y$ and $N=N_x$. If the forming is performed in Y direction, then $r=r_y$, $r'=r_x$ and $N=N_y$. Then, if the power supply portion is on only one end of x or y, as illustrated in FIG. 17A, the following can be written using the above-defined device numbers $N_x$, $N_y$ in the x and y directions, device address (x,y)=(n,k), device resistance R and wiring resistances $r_x$, $r_y$:

(1) In case of line forming in x direction $$p(k,n)=[1-2\times n\times(N_x-n+1)\times(r_x/R]-2\times k\times(r_y/R)]\times p0;p0=v_0\times v_0/R \quad (15)$$

Here p becomes maximum when n=k=1 holds and minimum when n=Nx/2, k=Ny hold.

Maximum value of the power of electric forming all of devices on a substrate:

$$p(1,1)/p0=1-2\times N_x\times(r_x/R)-2\times(r_y/R) \quad (16)$$

Minimum value of the power:

$$p(N_x/2,N_y)/p0\sim 1-N_x\times N_x/2\times(r_x/R)-2\times N_y(r_y/R) \quad (17)$$

Variance of the power:

$$Px=[p(1,1)-p(N_x/2,N_y)]p0\sim(N_x\times N_x/2-2\times N_x)\times(r_x/R)+2\times N_y(r_y/R) \quad (18)$$

(2) In case of line forming in y direction $$p(k,n)=[1-2\times n\times(r_x/R-2\times k\times(N_y-k+1)\times(r_y/R)]\times p0;p0=v_0\times v_0/R \quad (19)$$

Here p becomes maximum when n=k=1 holds and minimum when $n=N_x$, $k=N_y/2$ hold.

Maximum value within surface:

$$p(1,1)/p0=1-2\times(r_x/R)-2\times N_y\times(r_y/R) \quad (20)$$

Minimum value within surface:

$$p(N_x,N_y/2)/p0\sim1-2\times N_x\times(r_x/R)-N_y\times N_y/2\times(r_y/R) \quad (21)$$

Variance within surface:

$$Py=[p(1,1)-p(N_x,N_y/2)]p0\sim2\times N_x\times(r_x/R)+(N_y\times N_y/2-2\times N_y)\times(r_y/R) \quad (22)$$

Accordingly, if px<Py holds, i.e., if $(N_x\times N_x-8\times N_x)\times r_x<(N_y\times N_y-8\times N_y)\times r_y$ holds, it is better to perform forming collectively in the x direction. If px>Py holds, i. e., if $(N_x\times N_x-8\times N_x)\times r_x>(N_y\times N_y-8\times N_y)\times r_y$ holds, it is better to perform forming collectively in the y direction.

Figure 17B:
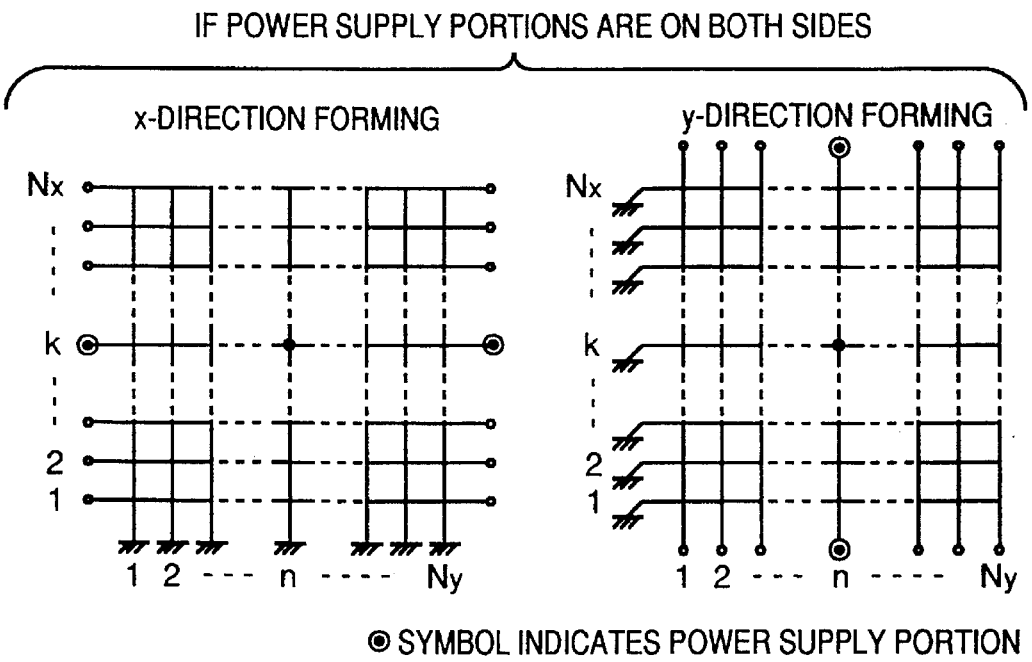
FIG. 17B is diagram for describing a state in which forming is carried out by passing current from both sides.

In a case where power supply portions are at both ends of x or y, as shown in FIG. 17B, the expression of the condition is as follows if this arrangement is considered to be symmetrical with respect to the center of a line formed collectively:

The condition is set based on whether $(N_x\times N_x-\times 24\times N_x)\times r_x$ or $(N_y\times N_y-24\times N_y)\times r_y$ is larger.

Thus, as set forth above, the direction suited to line forming is decided by the relationship between the wiring resistance and number of devices in two directions.

The voltage waveforms of the forming process are similar to those of FIG. 8 and are set in an appropriate manner.

Means A-2 will now be described.

Figure 18:
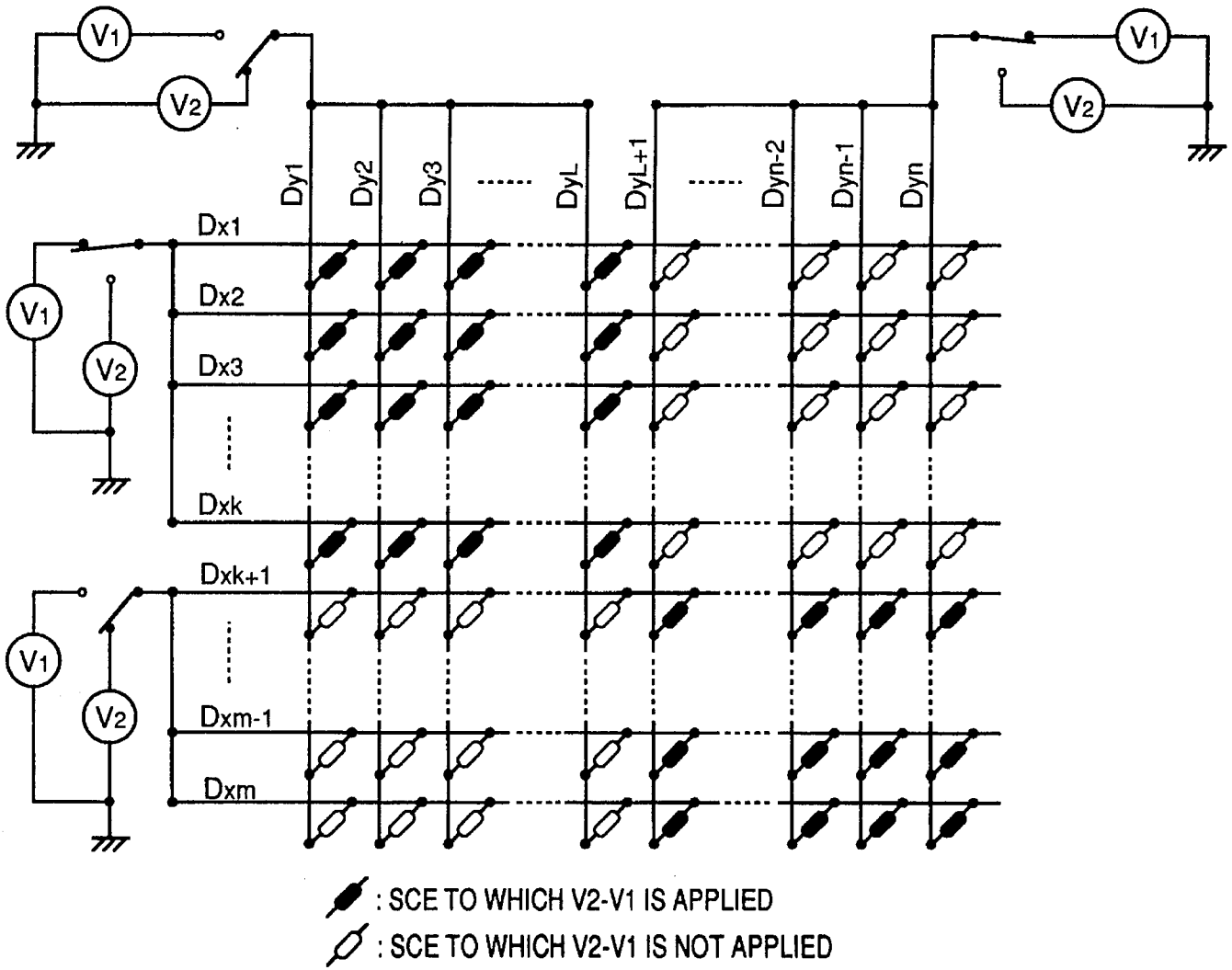
FIG. 18 is a diagram for describing forming in row and column directions according to the present invention.

Forming is carried out upon connecting a forming power supply (a potential of V1 or V2) to row wiring ($D_{X1-m}$) and column wiring ($D_{Y1\cdot n}$) by the arrangement shown in FIG. 18. At this time V1 is applied to k-number of the wires among the entirety of row wires, V2 is applied to the remaining (m−k)-number of row wires, V2 is applied to one wire among the entirety of column wires, and V1 is applied to the remaining (n−1)-number of the column wires. As a result, k×1+(m−k)×(n−1)-number of the surface-conduction electron-emitting devices among the entirety thereof are selected. In the selected surface-conduction electron-emitting devices, the voltage V2−V1 is applied across the device electrodes 65, 66 of FIG. 6, and electron emission portions 63, in which there is a change in structure at parts of the thin film for forming the electron-emitting devices, are formed.

Next, by interchanging the potentials V1 and V2 connected to the column wiring (or row wiring), the remaining surface-conduction electron-emitting devices not selected earlier are selected and forming is carried out in similar fashion. Waveforms of the kind shown in FIG. 8 are used as the voltage waveforms of the forming process.

The difference between this means A-2 and means A-1 is that whereas forming is performed in line units according to means A-1, here forming is carried out in block units. The effects are similar to those of A-1. Specifically, voltage is not diverted to the surface-conduction electron-emitting devices that have not been subjected to forming. Further, the number of devices to which the forming voltage is applied is reduced to one half, as a result of which the value of the current that flows through the wiring is reduced. As a consequence, a variance in the characteristics of the surface-conduction electron-emitting devices owing to a drop in the potential of the wiring can be suppressed.

Means B-1 will be described next.

The features of the manufacturing process will now be described with reference to the block diagram of FIG. 19A, the circuit diagram of FIG. 19B and the sectional view of an individual device of FIG. 19C.

Figure 19A:
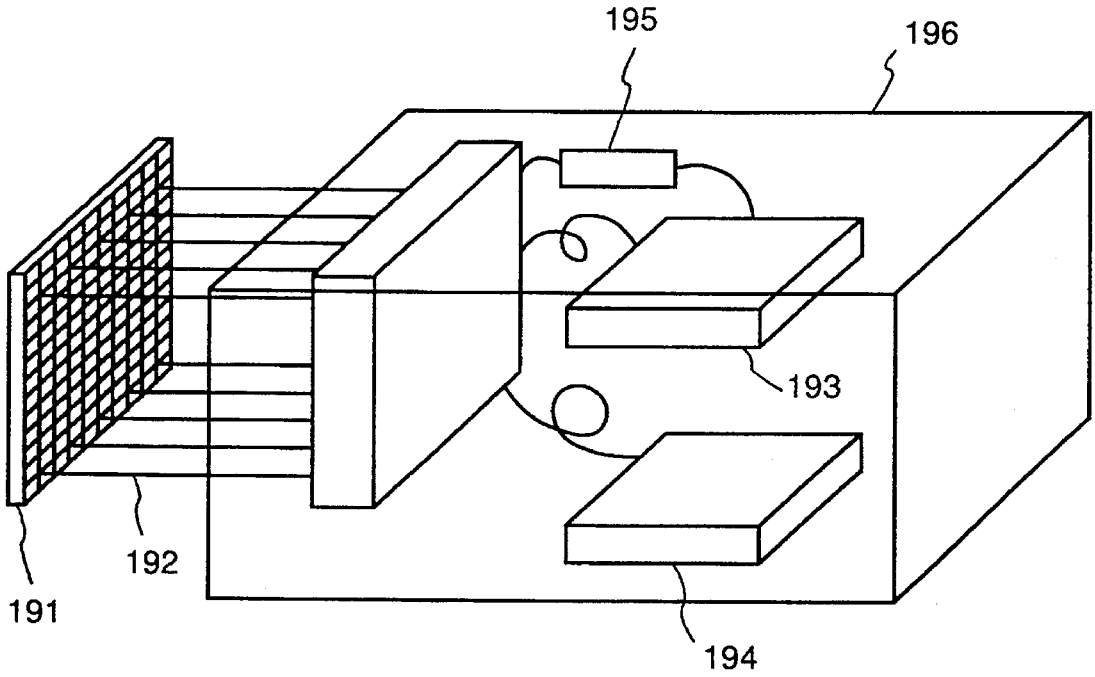
FIGS. 19A~19C are diagrams for describing forming according to the present invention.
Figure 19B:
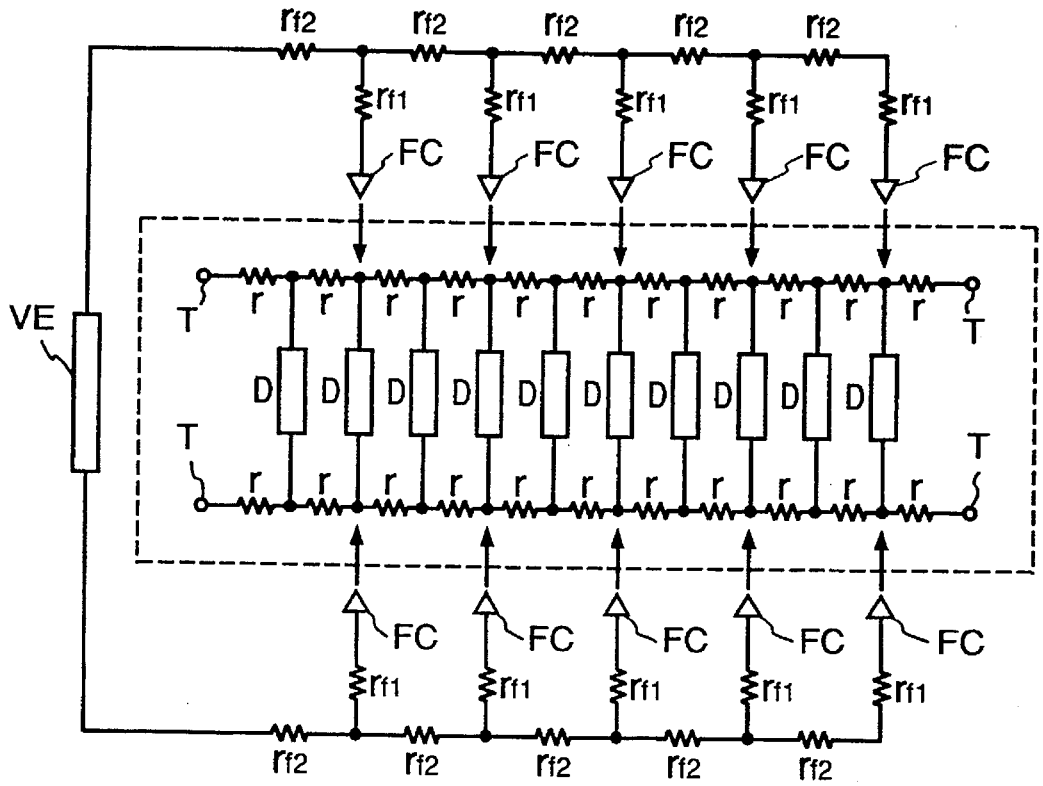
Figure 19C:
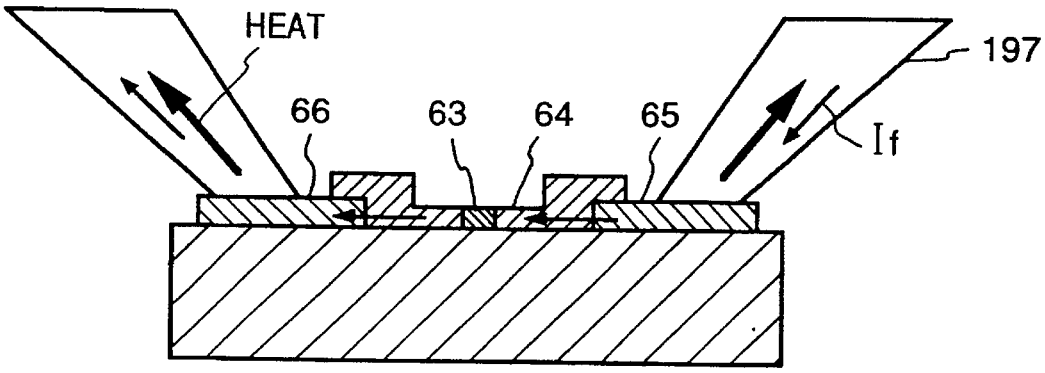

In FIG. 19A, numeral 191 denotes a multiple electron source, 192 electrical connecting means, 193 a temperature controller, 194 a forming power supply and 195 a temperature sensor. The portion enclosed by the solid line represents an electrification treatment apparatus according to the present invention. The multiple electron source 191 is an apparatus in which a plurality of the above-described electron-emitting devices are arrayed. The devices are connected by common wiring. The electrical connecting means 192 has a mechanism for performing an electrical connection at a plurality of portions of the electron-emitting devices arrayed in the multiple electron source 191. The connecting means is connected to each portion of the multiple electron source via resistors rf1, rf2, as shown in FIG. 19B). Since the electrical connecting means is not restricted in terms of shape (film shape and size within one pixel if this apparatus is an image forming apparatus) such as with regard to the common wiring of the electron-emitting devices, the resistances rf1, rf2 are made sufficiently small in comparison with the resistance r of the common wiring between devices. When a connection is made at a plurality of portions of the electron-emitting devices arrayed in one row and a voltage is supplied from a power supply VE, as shown in FIG. 19B, the value of a potential drop across the resistance rf2 is sufficiently small since the number of parallel wires is small and the resistance is minute. The voltage impressed upon the connecting portions to the common wiring is substantially equal. Further, the parallel resistances as seen from the junctions are all equal values since equal numbers of devices on the left and right are connected. As a result, the variance in voltage directly applied to each device can be made very small in comparison with the case in which electrification is carried out using the common wiring.

Furthermore, the arrangement is such that a material having excellent thermal conductivity is used as connecting mechanisms FC, a component having a large thermal capacity is provided in the succeeding state, heating and cooling mechanisms are provided as well as a mechanism for controlling them. According to this arrangement, the connecting mechanisms FC are not only for passing current through the devices but also act as conduction paths for heat and function to change the temperature of the electron emission portions through the device electrodes. A schematic sectional view of a connecting portion is shown in FIG. 19C. Numeral 195 denotes a substrate, 65, 65 the device electrodes for obtaining the electrical connection, 64 the thin film including the electron emission portion 63, and 197 electrical connecting means serving as the path for thermal conduction. Though the electrical connecting means 197 is shown to be connected on the device electrodes, it goes without saying that they can be connected on the wiring.

Examples of the material that can be used to construct the connecting means 197 are metals such as aluminum, indium, silver, gold, tungsten and molybdenum and alloys such as brass and stainless steel. In order to reduce the contact resistance with respect to the wiring and suppress a distribution in the contact resistance at a plurality of contact portions, it is preferred that the connecting means provided have its surface, which is a highly rigid metal, coated with a metal exhibiting a low resistance, and that each connecting means be equipped with load applying means (not shown) by applying a load in excess of several tens of grams to the contacting wiring. The load applying mechanism comprises a resilient member. For example, a coil spring or leaf spring, etc., may be used.

The above-mentioned electrical connecting means is connected to one or a plurality of columns of the matrix wiring and the forming treatment is applied to one row or a plurality of rows simultaneously, after which the rows connected are shifted so that the forming treatment is applied to all rows successively. If the number of electrical connecting means is made large, it is also possible to form all of them simultaneously.

Furthermore, in a case where the electrical connecting means is provided on the wiring of the layer below the insulating layer in the simple matrix arrangement described above, it is preferred that a contact window be formed in the contact portion and that the portion of contact between the wiring of the lower layer and the electrical connecting means be coated with a low-resistance metal. Further, in a combination of this means with means A-1, satisfactory effects can be expected by provided the X-direction wiring or Y-direction wiring, namely only the wiring of a row or column selected in order to apply the forming voltage, with a plurality of electrical connecting means, and merely applying a voltage from the terminals to the unselected wiring in the same direction and the wiring in the other direction.

Though forming means in an electron source having a simple matrix array has been described thus far, it is possible to utilize means B-1 in an electron source having a ladder array as well.

When the forming voltage is applied while the device electrodes are being cooled in the arrangement described above, the temperature of the film 64 rises owing to Joule heat produced by the forming current If. The temperature profile at this time is steep in comparison with that of the prior art, in which cooling is not carried out. The reason for this is that the heat produced by the devices escapes in a larger amount from the metal electrodes 65 and 66 than from the quartz or glass constituting the substrate 67. By cooling the metal electrodes 65 and 66 through the connecting means 197, the efficiency with which the heat escapes by conduction is greatly improved.

The inventors have verified that an electron emission portion is produced at the peak position of the temperature profile of the device by the heat of electrification. The inventors believe that this temperature is the cause of fissures formation.

Conventionally, the temperature profile is broadened when the electrode spacing exceeds 10 μm. It is believed that the electron emission portion develops a large variance for this reason. Accordingly, if the electrode temperature is controlled to be low to make the temperature profile steep, as is done in this invention, it becomes possible to make the variance of the electron emission portion small even if the electrode spacing is enlarged.

In actuality, when forming is carried out while controlling temperature through the electrification process of the present invention, the temperature profile of the film becomes steep and the width of the peak region is narrowed, even if the electrode spacing is made greater than 10 μm. As a result, the variance in the electron emission portion is kept small.

Furthermore, it is possible to perform control in such a manner that each portion of the plurality of arrayed electron-emitting devices in the above-described arrangement is kept at a constant temperature. The aforementioned problem of the prior art, namely the temperature difference at the central portion and edge portions of the multiple electron source apparatus, is eliminated. As a result, variance in the electron emission portions at the time of forming becomes small.

Next, means B-2 will be described.

First, methods of implementation will be described for an arrangement in which at least one of the row wiring or column wiring commonly connecting a plurality of electron-emitting devices is divided at predetermined intervals, or for an arrangement in which a high-impedance portion is provided at predetermined intervals.

Figure 20A:
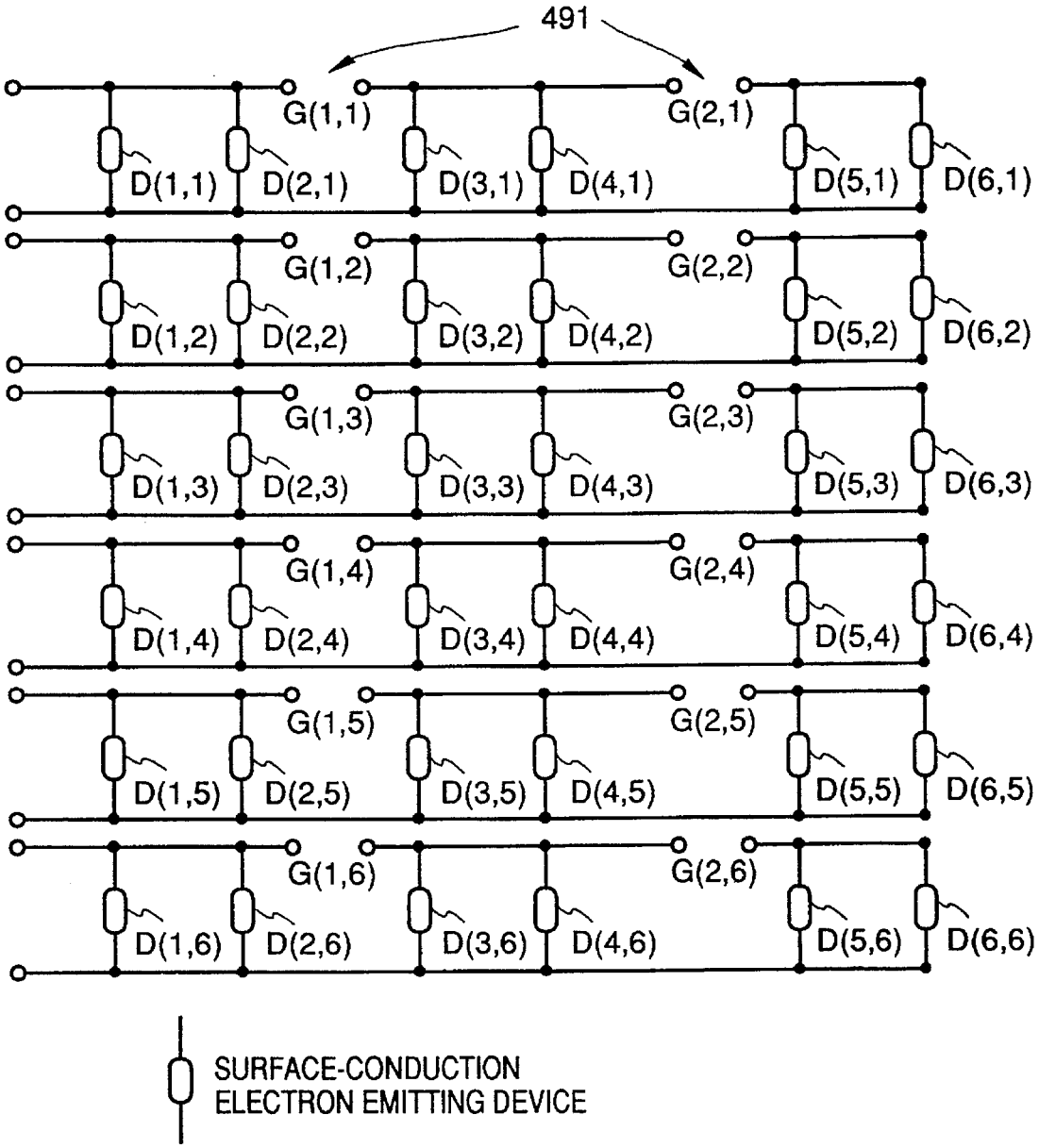
FIG. 20A is a diagram illustrating an example of ladder wiring which is divided.
Figure 20B:
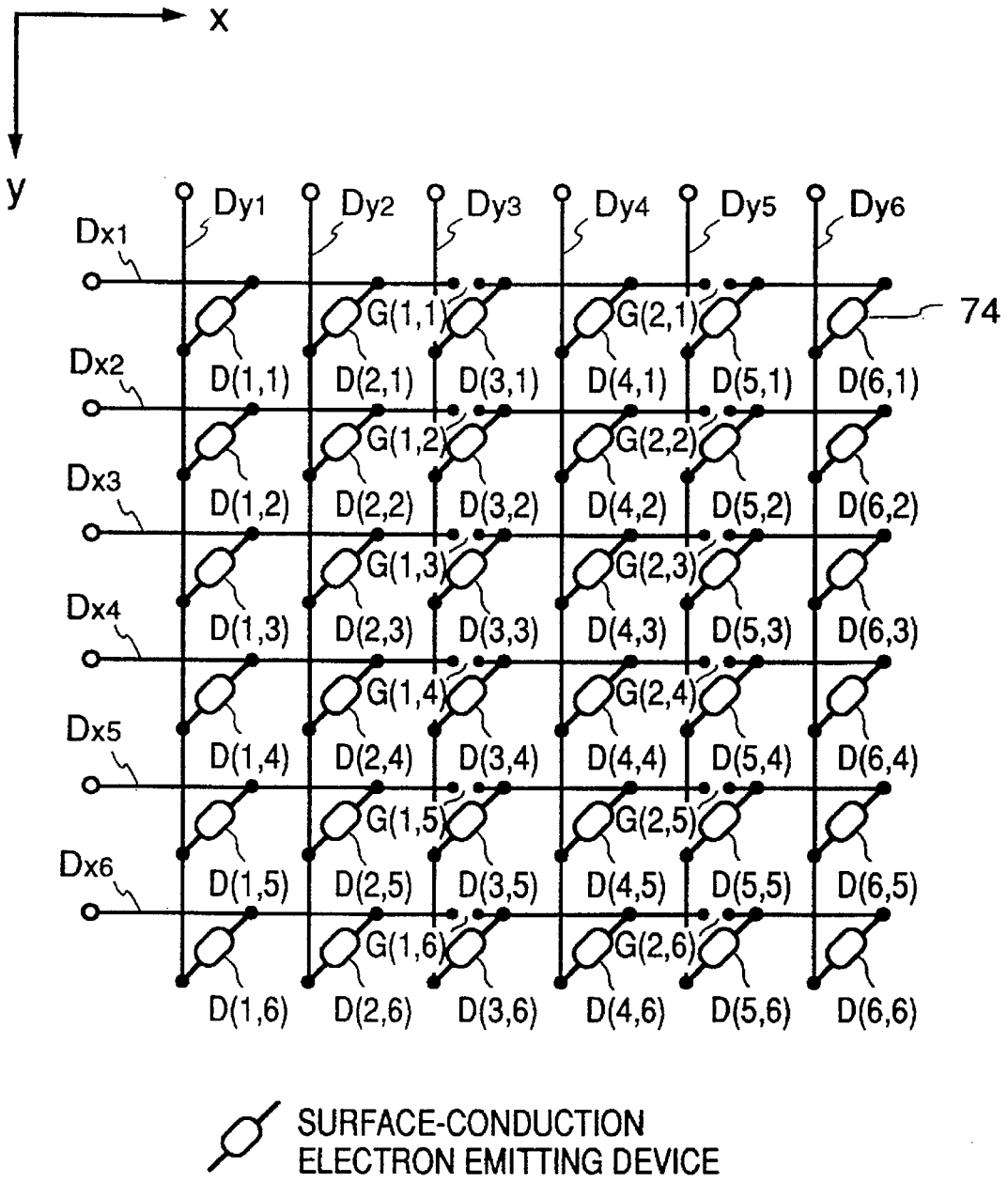
FIG. 20B is a diagram illustrating an example in which part of a simple matrix is divided.

FIG. 20A illustrates ladder-shaped wiring, and FIG. 20B shows part of a simple matrix in divided form. The wiring is fabricated by photolithography or printing. In either case, if the masking pattern is provided with dividing gaps in advance, wiring having dividing gaps at predetermined intervals can be obtained with ease. Of course, wiring having the gaps at predetermined intervals may be obtained also by forming continuous wiring and then severing the wiring by melting it using a YAG laser or by mechanical means relying upon a dicing saw.

A method of providing high-impedance portions is as follows:

A metal having a high resistivity, such as a thin film of nickel-chrome alloy, is vacuum-deposited on the gaps, obtained as set forth above, thereby to produce patterns of the film. Continuous wiring (FIG. 20) is fabricated and the wiring width at a portion thereof is made very narrow. Alternatively, wiring fabricated uniformly is partially reduced in thickness to form thin-film portions by a milling technique. The high-impedance portions are thus obtained.

Next, the forming treatment is applied by feeding a current to this substrate and applying a forming voltage to specific elements (devices). The power supplying method mentioned here involves feeding current from the end of the wiring and applying the forming treatment from devices within the divided regions close to the end of the wiring. Current may be fed using means similar to the special electrical connecting means used in means B-1 described above.

After forming is applied to the predetermined portions, the dividing gap portions or high-impedance portions are short-circuited. This method will now be described.

One method is to achieve the short circuit simply by using wire bonding or ribbon bonding consisting of Au or Al.

Another method is as follows: one side of the gap portion, or the vicinity of the high-impedance portion, or part of the high impedance-portion, is coated is provided with a film of gold-silver paste or with a low melting-point metal that includes In or Bi by application using a microdispenser or by relying upon photolithography. The paste or low melting-point metal is heated and fused by laser light or infrared radiation to fill the gaps or high-impedance portions with the molten metal and achieve short-circuiting. Alternatively, electric current is caused to concentrate in the high-impedance portions, thereby raising the temperature of the high-impedance portions to obtain effects similar to those of the heating method described above.

The means B-3 will now be described.

According to this method, one row or one column of devices is subjected to line forming while a voltage applied to power supply portions is controlled in such a manner that applied power or applied voltage will be rendered constant for all devices at the forming of each device arrayed in a simple matrix, one dimensionally or in the form of a ladder.

In consideration of the problem of the prior art, namely the fluctuation in the voltage supplied to external terminals in order to carry out forming, line forming is implemented by controlling the voltage applied to the power supply portions while sensing up to which device forming has been completed in a row (or column) undergoing line forming. This makes it possible to maintain constant forming conditions with respect to all devices.

In a case where a power supply portion is on one end of a row (or column) in a two-dimensional simple matrix array, the voltage applied to the power supply portion should be made small when forming devices in the vicinity of both ends of the row (or column) undergoing line forming. The voltage applied to the power supply portion should be made large when forming devices in the vicinity of the center. Further, in a case where power supply portions are at both ends of a row (or column), the voltage applied to the power supply portions should be made small when forming devices at both ends and in the vicinity of the center of the row (or column) undergoing line forming. The voltage applied to the power supply portions should be made large when forming devices in the vicinity of one-quarter of a line inward from both ends. Further, in a case where one end (or both ends) of a row (or column) opposing a row (or column) to undergo line forming is grounded, the voltage applied to the power supply portions should be made small if the row (or column) to undergo line forming is near the grounded end. The applied voltage should be made large if the above-mentioned row (or column) is far from the grounded end.

With regard to a case in which devices are arrayed in a one-dimensional ladder, if a power supply portion is placed at one location at one end of the ladder line and a grounded portion is placed at the other end, then the voltage applied to the power supply portion is made small when forming devices in the vicinity of the power supply end. The voltage applied to the power supply portion is made large when forming devices in the vicinity of the grounded end. If a power supply portion and grounded portion are placed at an end on the same side of a ladder line, then voltage applied to the power supply portion is made small when forming devices in the vicinity of both ends, and voltage applied to the power supply portion is made large when forming devices in the vicinity of the central portion of the line. If power supply portions and grounded portions are placed at one location each on both ends of a ladder line, then voltage applied to the power supply portions is made small when forming devices in the vicinity of both ends and in the vicinity of the central portion. The voltage applied to the power supply portions is made large when forming devices in the vicinity of one-quarter of a line inward from both ends.

More specifically, when forming an device at an device address (k,n) in a simple matrix, for example, in X direction, it will suffice to apply a voltage $v_0(k,n)$ to the power supply portion in accordance with the equation $$v_0(k,n)=C'\times[1+k\times r_y/R+n\times(N-n+1)\times r_x/R] \quad (23)$$

Figure 23:
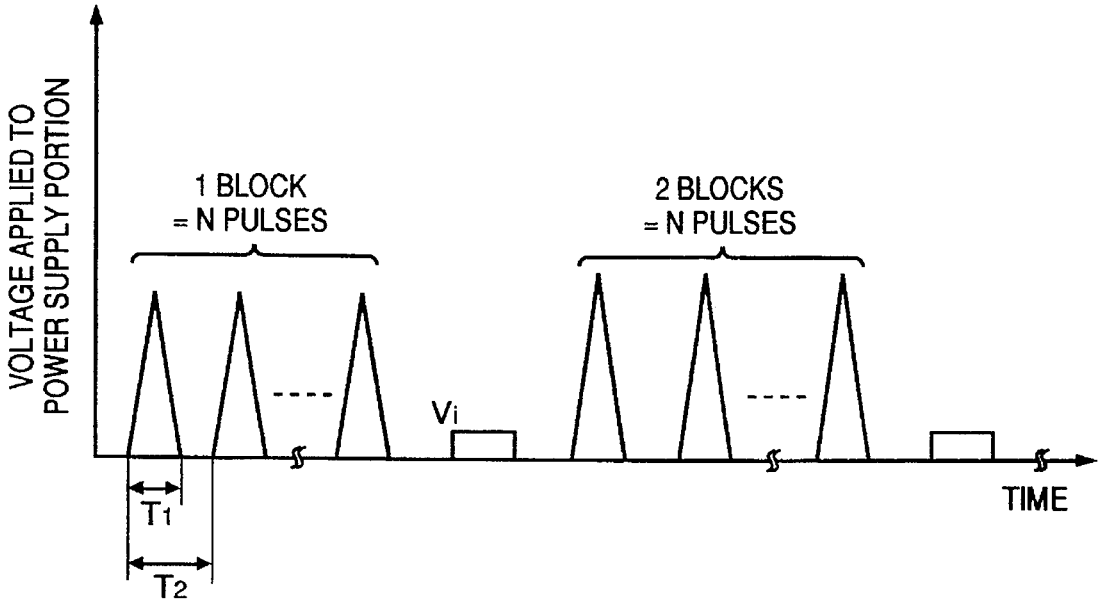
FIG. 23 is a diagram showing an example of forming pulses according to the present invention.

(where C' is a constant)

to compensate for the voltage distribution of Equation (1) and attain a constant voltage. Here C' decides the optimum value experimentally. Further, in order to detect the address of an device that has already undergone forming, it will suffice to measure the impedance between the power supply portion and the grounded portion. The impedance measurement may be carried out by making one or a plurality of forming pulses having a fixed pulse height one block, and inserting a pulse whose voltage is lower than that of forming pulses between blocks. An example of pulse application is shown in FIG. 23. Here T1 is on the order of 1 μs~10 msec, and T2 is on the order of 10 μs~100 msec. Further, N represents 1~100 pulses, and Vi is on the order of 0.1 V.

If the number of blocks (the number of impedance measurements) is small, the algorithm of forming control will be simple and the time needed for forming an entire line can be shortened. If the number of block is large, on the other hand, a variance in forming conditions between devices can be kept small.

It should be noted that the method of applying forming pulses and the method of detecting device addresses are not limited to the foregoing. Detection of device addresses can be dispensed with as long as fixed conditions are imposed.

Figure 24:
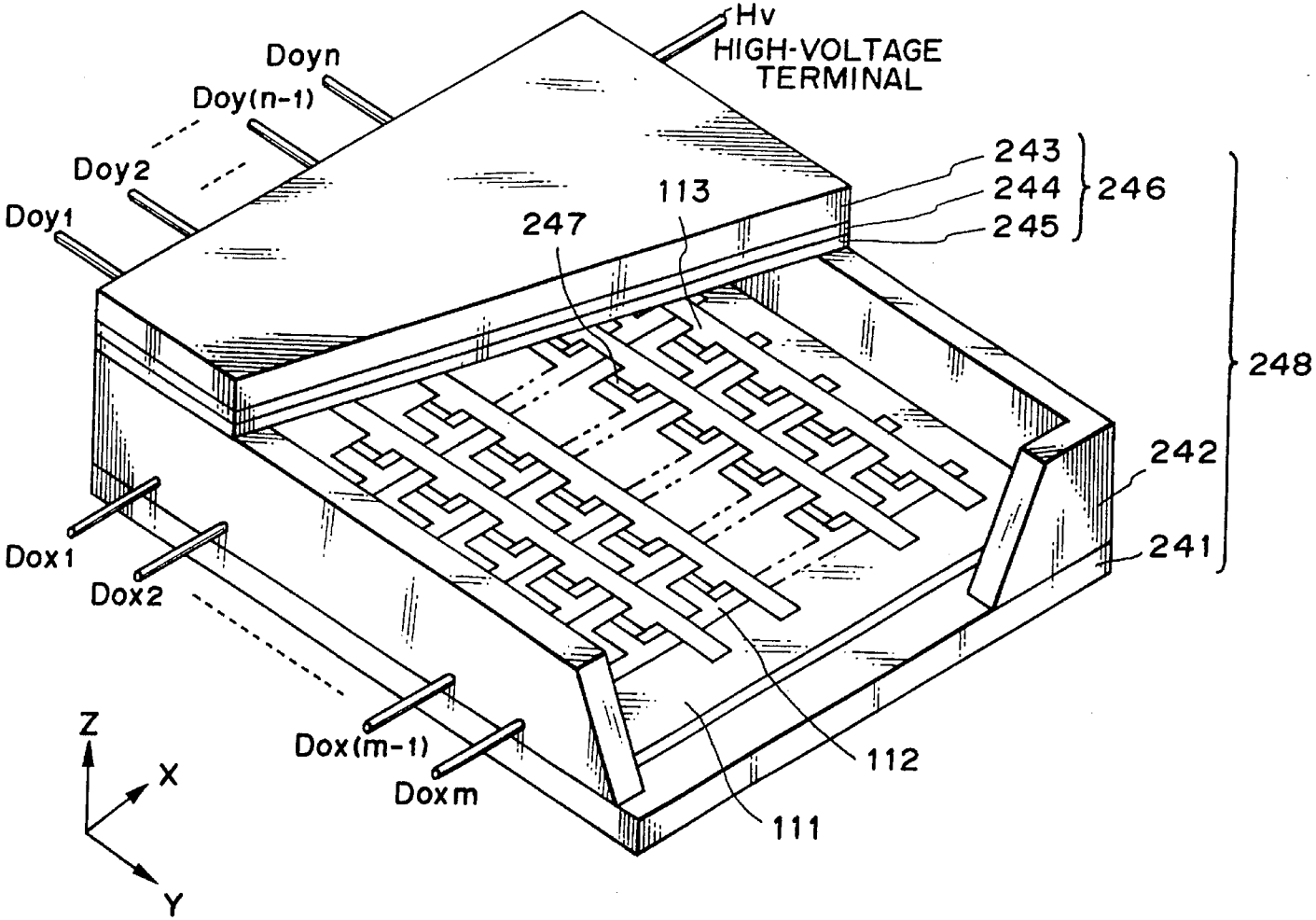
FIG. 24 is a schematic showing the basic construction of an image forming apparatus according to the present invention.
Figure 25A:
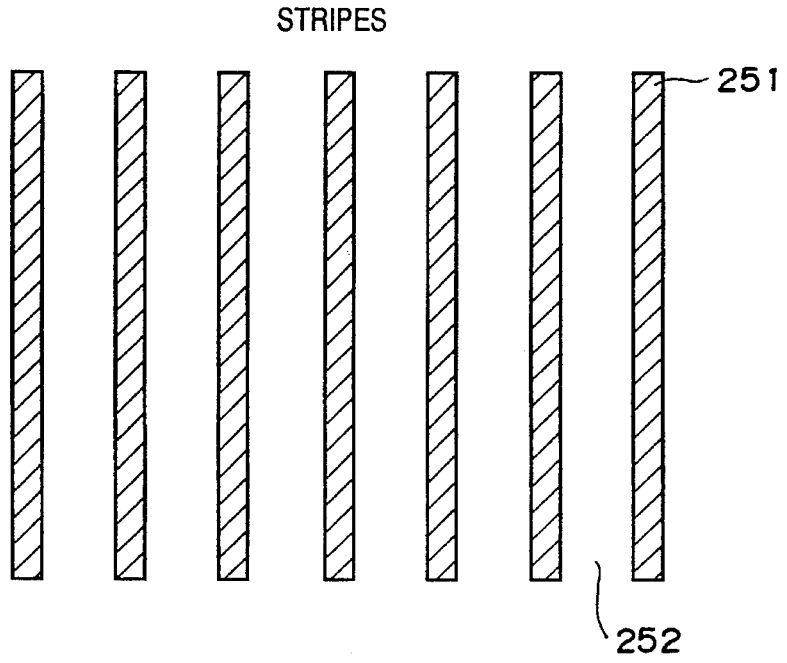
FIGS. 25A, 25B are diagrams showing patterns of fluorescer of an image forming apparatus according to the invention.
Figure 25B:
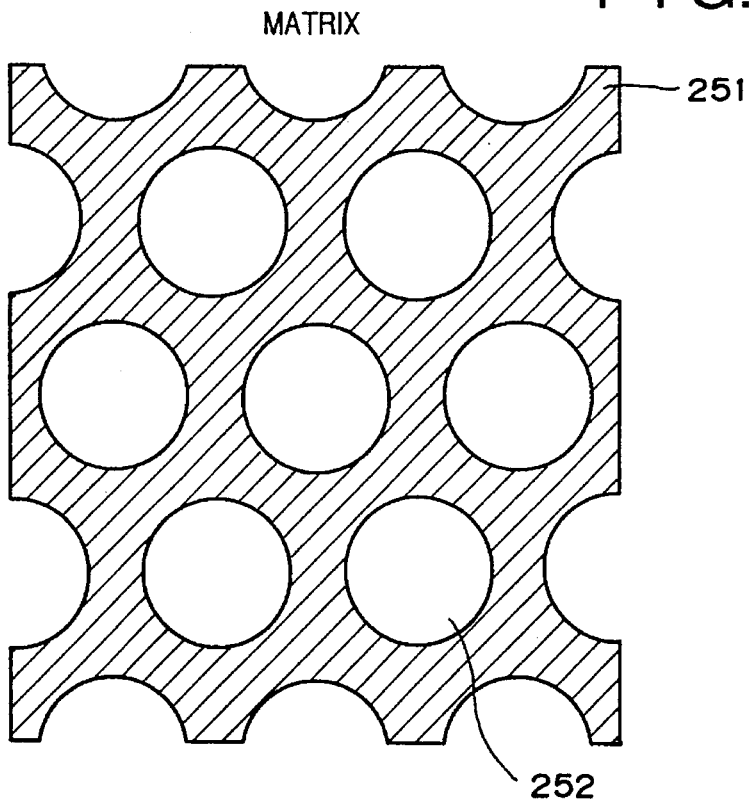

Next, with reference to FIGS. 24 and 25A, B, an image forming apparatus used in a display or the like that employs an electron source fabricated as set forth above will be described with regard first to a simple matrix arrangement. FIG. 24 is a basic structural view showing the image forming apparatus, and FIGS. 25A, 25B show fluorescent films.

Shown in FIG. 24 are an electron-source substrate 111 on which the electron-emitting devices are fabricated as set forth above, a rear plate 241 to which the substrate 111 is secured, a face plate 246 having a phosphor film 244 and a metal back 245 formed on the inner surface of a glass substrate 243, and a supporting frame 242. The rear plate 241, supporting frame 242 and face plate 246 are coated with frit glass or the like, which is then baked in the atmosphere or in a nitrogen environment at 400°~500° C. for more than 10 min to effect sealing and construct a vessel 248.

In FIG. 24, numeral 247 corresponds to the electron emission portion in FIG. 1. Numerals 112, 113 denote X-direction wiring and Y-direction wiring connected to the pairs of device electrodes of the surface-conduction electron-emitting devices. If the device electrodes and wiring are made of identical material, then are cases in which the wiring to the device electrodes will be referred to as device electrodes.

As mentioned above, the vessel 248 is constructed by the face plate 246, supporting frame 242 and rear plate 241. However, since the rear plate 241 is provided mainly for the purpose of reinforcing the substrate 111, it may be dispensed with if the substrate 111 itself has sufficient strength. The supporting frame 242 may be sealed directly on the substrate 111 so that the vessel 248 may be constructed by the face plate 246, supporting frame 242 and substrate 111.

FIGS. 25A, 25B illustrate the fluorescent film 244. The fluorescent film 244 comprises only fluorescer if the apparatus is for monochromatic use. In the case of a fluorescent film for color, however, the fluorescent film comprises a black electrically conductive material 251, referred to as black stripes or a black matrix, and fluorescer 292. The purpose of providing the black stripes or black matrix is to make color mixing and the like less conspicuous by blackening the coated portions between the fluorescer 252, which are fluorescer of the three primary colors necessary to present a color display, and to suppress a decline in contrast caused by reflection of external light at the fluorescent film 244. As for the material constituting the black stripes, use can be made of a substance whose principal ingredient is graphite. However, this does not impose a restriction upon the invention; any material may be used so long as it is electrically conductive and allows but little light to pass through or to be reflected.

As for the methods of coating the glass substrate 243 with the phosphors, a precipitation method or printing method irrespective of whether the display is monochromatic or color.

The inner side of the fluorescent film 244 usually is provided with the metal back 245. The purpose of the metal back 245 is to raise luminance by reflecting the part of the fluorescent light emission that is directed toward the inner surface to the side of the face plate 246, to act as an electrode for applying an accelerating voltage to the electron beams, and to protect the fluorescer against damage due to bombardment of negative ions generated within the vessel. The metal back is fabricated by applying a smoothing treatment (usually referred to as "filming") to the inner surface of the fluorescent film after the fluorescent film is formed, and then depositing aluminum (Al) by vacuum deposition.

In order to improve the conductivity of the fluorescent film 244, there are cases in which the face plate 246 is provided with transparent electrodes (not shown) on the side of the outer surface of the film 244.

When the above-mentioned sealing operation is carried out, it is required that sufficient positioning be carried out since the color fluorescers of the various colors and the electron-emitting devices must be made to correspond in the case of a color display.

The vessel 248 is evacuated to about $10^{-7}$ Torr through an exhaust pipe (not shown) and then sealed. There are cases in which a getter treatment is applied in order to maintain the vacuum after sealing. This is a treatment in which a getter, which has been disposed at a predetermined position (not shown) in the vessel 248, is heated by a heating method such as resistive heating or high-frequency heating immediately before sealing is performed or after sealing, thereby forming a vacuum-deposited film. The principal ingredient of the getter usually is Ba, etc. By way of example, a vacuum on the order of $1\times10^{-5}$~$1\times10^{-7}$ Torr is maintained by the adsorbing action of the vacuum-deposited film.

In the image display apparatus of the invention completed as described above, a voltage is applied to each of the electron-emitting devices through external terminals $D_{ox1}$~$D_{oxm}$, $D_{oy1}$~$D_{oyn}$, whereby electrons are emitted. A high voltage Hv greater than several kV is impressed upon the metal back 245 or transparent electrodes (not shown) through a high-voltage terminal Hv, thereby accelerating the electron beams. The electrons irradiate the fluorescent film 244, thereby exciting the fluorescer into light emission to display an image. It should be noted that the external electrodes $D_{ox1}$~$D_{oxm}$, $D_{oy1}$~$D_{oyn}$ of the vessel are connected to wiring $D_{x1}$~$D_{xm}$, $D_{y1}$~$D_{yn}$, respectively.

The components described above are those necessary to fabricate a preferred image forming apparatus used in a display or the like. The particular parts of the apparatus, such as the materials constituting the various members, are not limited to those set forth above. Materials and parts may be appropriately selected so as to be suitable for application to an image display apparatus.

An image forming apparatus using an electron source having the above-described ladder arrangement will now be described with reference to FIG. 21.

Figure 21:
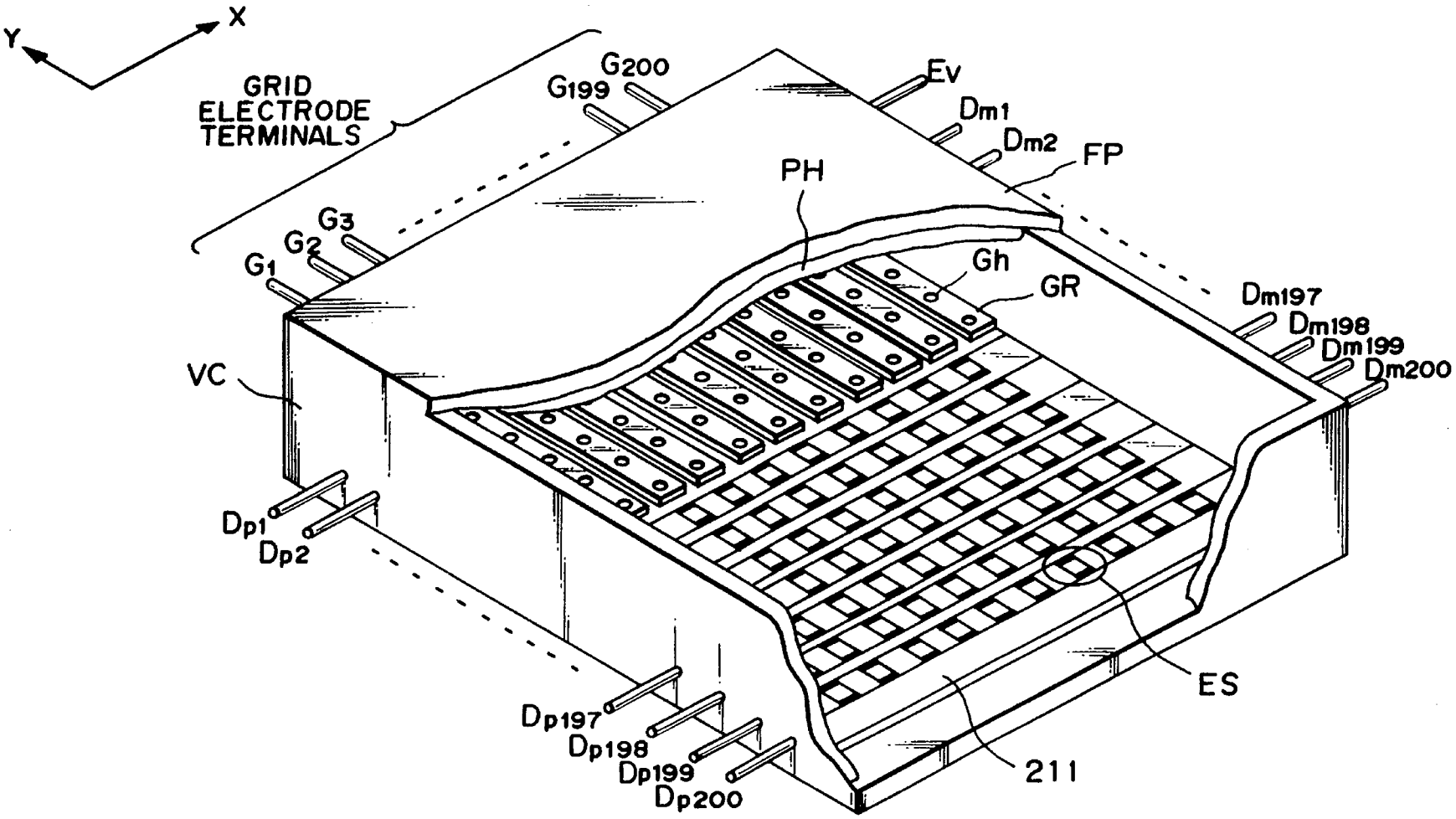
FIG. 21 is a schematic illustrating the construction of an image forming apparatus according to the present invention.

FIG. 21 is a schematic showing the panel structure of an image forming apparatus equipped with a multiple electron source in a ladder array. This differs from the image forming apparatus of the simple matrix array described earlier in that grid electrodes are provided between the electron sources (substrate S) and the face plate. In other aspects the two apparatuses are constructed of identical members and are arranged in the same manner.

Grid electrodes GR (or referred to controlled electrodes) are provided intermediate the substrate S and face plate FP. The grid electrodes are capable of modulating the electron beams emitted by the surface-conduction electron-emitting devices. By way of example, the grid of FIG. 21 is provided with circular openings Gh, each of which corresponds to a device, in order to transmit the electron beams to stripe-shaped electrodes provided perpendicular to the device rows of the ladder array. The shape of the grid and the position at which it is placed need not necessarily be as shown in FIG. 21. In addition, there are instances in which a number of transmission holes are provided as the openings in the form of a mesh. Further, the grid may be provided at the periphery of the surface-conduction electron-emitting devices or near the periphery.

The electrodes of the electron source and the grid electrodes are electrically connected to a control circuit outside the evacuated vessel.

In the image forming apparatus of the invention, modulating signals of one line of an image are applied simultaneously to a row of grid electrodes in synchronism with successive driving (scanning) of the device rows one row at a time, thereby controlling the irradiation of the phosphors with each electron beam and displaying an image one line at a time.

A preferred example of electric circuitry for carrying out a display operation in which the display panel created as described above serves as an image forming apparatus will be exemplified below.

Figure 22:
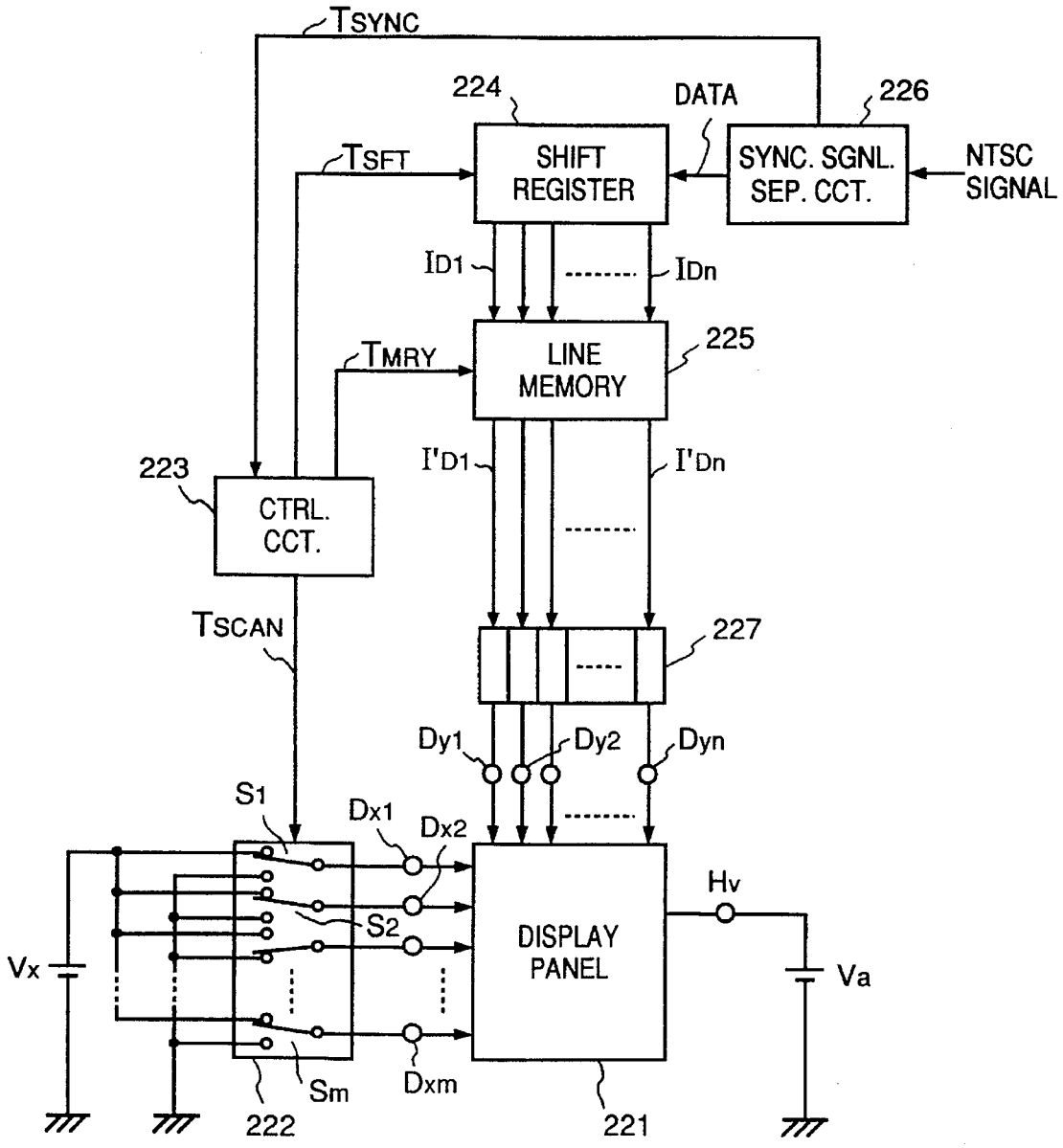
FIG. 22 is a circuit block diagram showing the circuit arrangement of an image forming apparatus according to the present invention.

FIG. 22 is a block diagram showing an image forming apparatus constructed using an electron source in which a plurality of electron-emitting devices are arranged in the form of a simple matrix created by the manufacturing method of the present invention. The image forming apparatus is used as a drive circuit for presenting a television display based upon an NTSC television signal. In FIG. 22, numeral 221 denotes a display panel, 222 a scanning circuit, 223 a control circuit, 224 a shift register, 225 a line memory, 226 a synchronizing-signal separating circuit, and 227 a modulating signal generator. Further, Vx, Va represent DC voltage sources.

The function of each component will be described in due course. First, the display panel 221 is connected to external electric circuitry via terminals $D_{x1}$~$D_{xm}$, terminals $D_{y1}$~$D_{yn}$ and a high-voltage terminal $H_v$. Scanning signals for successively driving, one row (N devices) at a time, the multiple electron-beam sources provided within the display panel, namely the group of surface-conduction electron-emitting devices matrix-wired in the form of an m-row, n-column matrix, are applied to the terminals $D_{x1}$~$D_{xm}$. Modulating signals for controlling the output electron beams of the respective devices of the surface-conduction electron-emitting devices in a row selected by the scanning signals are applied to the terminals $D_{yl}$~$D_{yn}$. A DC voltage of, say 10 KV is supplied to the high-voltage terminal Hv from the DC voltage source Va. This DC voltage is an accelerating voltage for imparting the electron beams, which are delivered by the surface-conduction electron-emitting devices, with enough energy to excite the phosphors.

The scanning circuit 222 will now be described.

The scanning circuit 222 is internally provided with M-number of switching devices (schematically illustrated by S1 through Sm in FIG. 22). Each switching device selects either the output voltage of the DC power supply Vx or 0 V (the ground level) and electrically connects the selected voltage to a corresponding one of the terminals $D_{x1}$ through $D_{xm}$ of the display panel 221. Though the switching devices S1~Sm operate on the basis of a control signal $T_{SCAN}$ output by the control circuit 223, in actuality it is possible to readily realize the switching devices by combining switching devices such as FETs, by way of example.

In this embodiment, the DC voltage supply Vx has been set, based upon the characteristic (the electron-emission threshold voltage) of the surface-conduction electron-emitting devices, so as to output such a constant voltage that the driving voltage applied to an device not being scanned will fall below the electron-emission threshold voltage.

On the basis of an image signal that enters from the outside, the control circuit 223 acts to coordinate the operation of each component so as to present an appropriate display. On the basis of a synchronizing signal $T_{SYNC}$ sent from the synchronizing-signal separating circuit 226 described next, the control circuit 223 generates control signals $T_{SCAN}$, $T_{SFT}$ and $T_{MRY}$ to each of the components.

The synchronizing-signal separating circuit 226 separates a synchronizing signal component and a luminance signal component from an externally entered NTSC television signal. If a frequency separating circuit (filter) is used, the circuit 226 can be readily constructed, as is well known. Though the synchronizing signal separated by the synchronizing-signal separating circuit 226 comprises a vertical synchronizing signal and a horizontal synchronizing signal, as well known, here these signals are expressed by the signal $T_{SYNC}$ for the sake of simplicity. The image luminance signal component separated from the aforementioned television signal is represented by a DATA signal for the sake of simplicity. This signal is applied to the shift register 224.

The shift register 224 is for converting the DATA signal, which enters serially in a time series, into a parallel signal every line of the image. The shift register 224 operates based upon the control signal $T_{SFT}$ sent from the control circuit 103. (That is, the control signal $T_{SFT}$ may be referred to as the shift clock of the shift register 224.) The serial/parallel-converted data of one line of the image (which corresponds to the drive data of N-number of electron-emitting devices) is output from the shift register 224 as N-number of parallel signals $I_{D1}$~$I_{Dn}$.

The line memory 105 is a memory apparatus that stores one line of the image data for a requisite period of time only. .The line memory 105 stores the contents of $I_{D1}$~$I_{Dn}$ suitably in accordance with the control signal $T_{MRY}$ sent from the control circuit 223. The stored contents are output as $I'_{D1}$~$I'_{DN}$, which enter the modulating signal generator 227.

The modulating signal generator 227 is a signal source for appropriately modulating the drive of each of the surface-conduction electron-emitting devices in dependence upon individual items of image data $I'_{D1}$~$I'_{DN}$. The output signals of the modulating signal generator 227 are applied to the surface-conduction electron-emitting devices within the display panel 221 through the terminals $D_{y1}$~$D_{yn}$.

As described again, the electron-emitting devices of the present invention have the following basic characteristics with respect to the emission current Ie: Specifically, as mentioned above, the electron emission has a clearly defined threshold voltage Vth, and an electron emission is produced only when a voltage greater than the threshold voltage Vth is applied.

Further, the emission current also changes in dependence upon a change in the applied voltage of the devices with regard to a voltage greater than the electron emission threshold voltage. There are cases in which the value of the electron-emission threshold voltage Vth and the degree of change in the emission current with respect to the applied voltage are changed by changing the material, construction and method of manufacture of the electron-emitting devices. In any case, the following can be said to hold:

Specifically, in a case where a pulsed voltage is applied to a device, no electron emission takes place even if a voltage below the electron emission threshold value is applied. In a case where a voltage greater than the electron emission threshold value is applied, however, an electron beam is output. First, it is possible to control the intensity of the output electron beam by changing the peak value Vm of the pulse waveform. Second, it is possible to control the total amount of electric charge of the output electron beam by changing the pulse width Pw.

Accordingly, a voltage modulation method and a pulse-width modulation method can be mentioned as methods of modulating the electron-emitting devices in conformity with the input signal. In order to implement voltage modulation, a circuit used as the modulating signal generator 227 employs a voltage modulating method according to which voltage pulses of a fixed width are generated but the peak value of the pulses is suitably modulated in conformity with the input data.

In order to implement pulse-width modulation, a circuit used as the modulating signal generator 227 employs a pulse-width modulating method according to which voltage pulses of a fixed peak value are generated but the width of the voltage pulses is suitably modulated in conformity with the input data.

By virtue of the series of operations described above, a television display is presented using the display panel 221. Though not particularly touched upon above, the shift register 224 and line memory 225 may be of digital or analog type. What is important is that the parallel/serial conversion of the image signal and the storage of the converted signal be performed at a predetermined speed. In a case where a digital arrangement is used, it is necessary that output data DATA of the synchronizing-signal separating circuit 226 be converted to a digital signal. It goes without saying that this can be readily achieved if an A/D converter is provided at the output of the synchronizing-signal separating circuit 226. Further, it goes without saying that the circuit used as the modulating signal generator 227 is slightly different depending upon whether the output signal of the line memory 225 is digital or analog. That is, in case of a digital signal, a well-known D/A converting circuit may be used in the modulating signal generator 227 if modulation is by the voltage modulating method. If necessary, an amplifier circuit or the like may also be provided. In a case where modulation is by the pulse-width modulating method, the modulating signal generator 227 can readily be constructed by one skilled in the art if use is made of circuit that is a combination of a high-speed oscillator, a counter for counting the number of waves output by the oscillator, and a comparator for comparing the output value of the counter with the output value from the above-mentioned memory. If necessary, an amplifier circuit may also be provided for voltage-amplifying the pulse-width modulated signal from the comparator to the driving voltage of the surface-conduction electron-emitting devices.

In case of an analog signal, an amplifier circuit employing a well-known operational amplifier, for example, may be used in the modulating signal generator 227 if modulation is by the voltage modulating method. If necessary, a level-shift circuit or the like may also be provided. In a case where modulation is by the pulse-width modulating method, a well-known voltage-controlled oscillator (VCO) may be used. If necessary, an amplifier circuit may also be provided for voltage-amplifying the pulse-width modulated signal to the driving voltage of the surface-conduction electron-emitting devices.

Examples of the present invention will now be described in detail.

EXAMPLE 1

This example relates to an example of an electron source in which a number of the surface-conduction electron-emitting devices fabricated in accordance with means A-1 are in the form of a simple matrix array.

Figure 26:
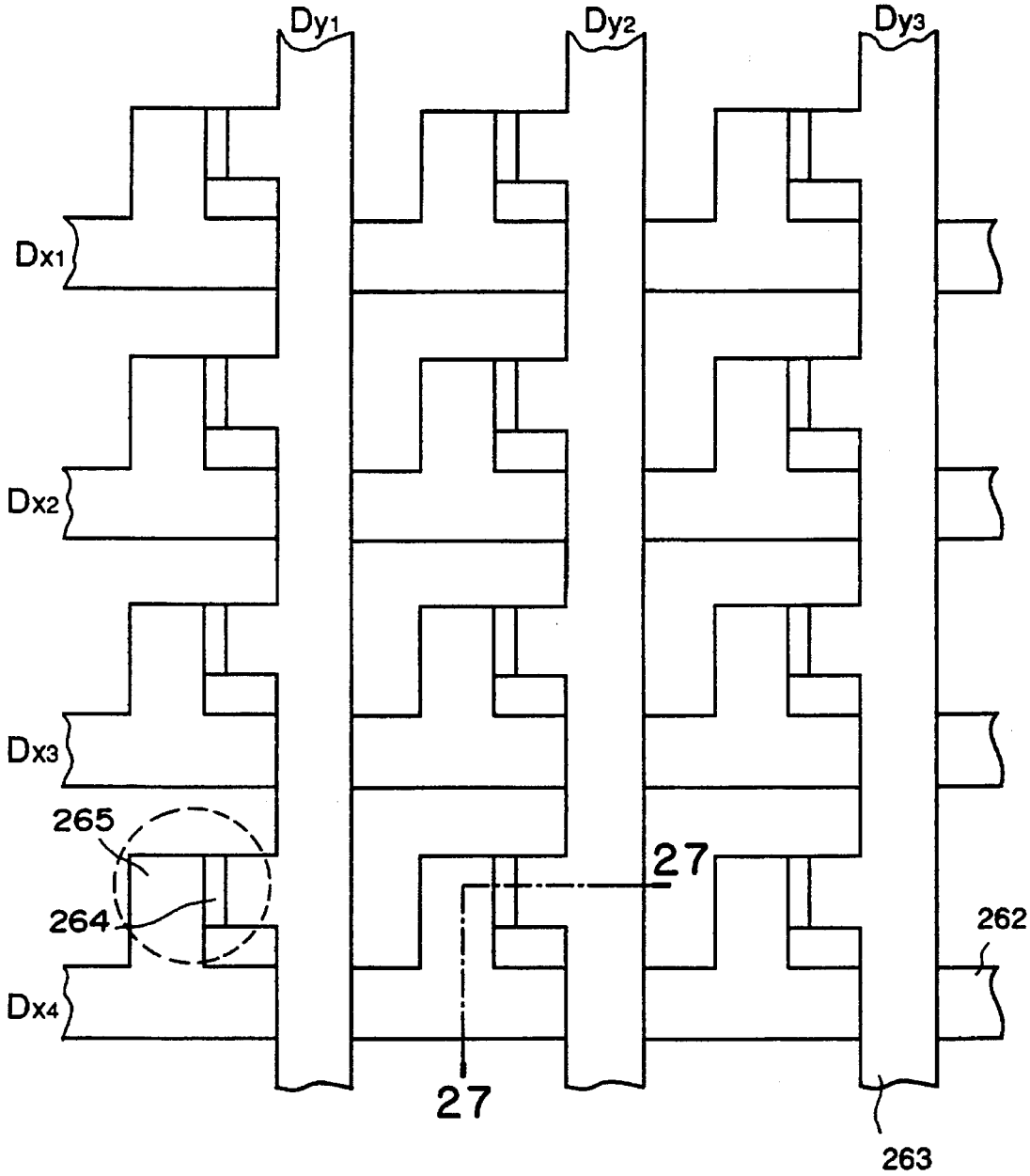
FIG. 26 is a plan view showing part of electron sources arrayed in the form of a matrix according to the invention.
Figure 27:
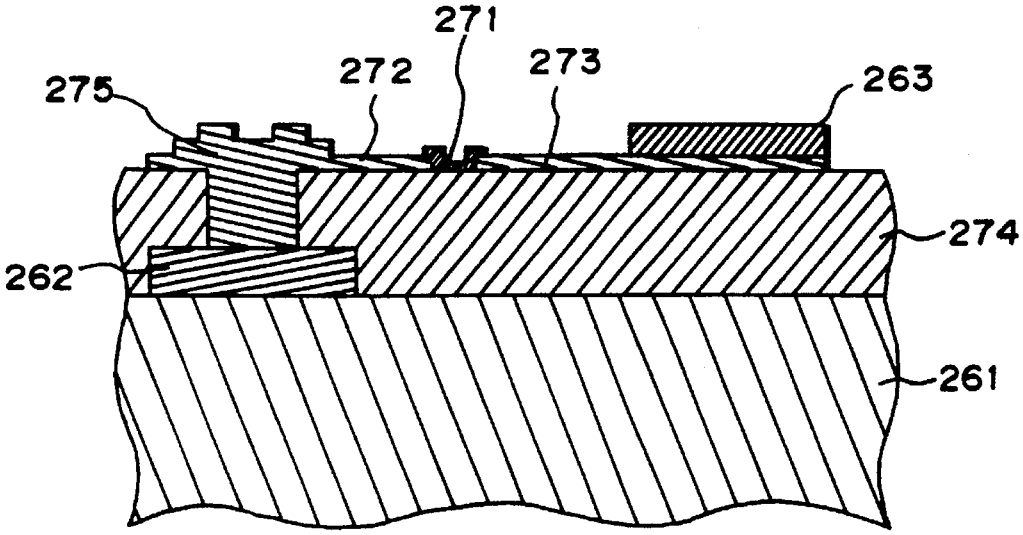
FIG. 27 is a sectional view taken along line A–A' of FIG. 26.
Figure 28A:
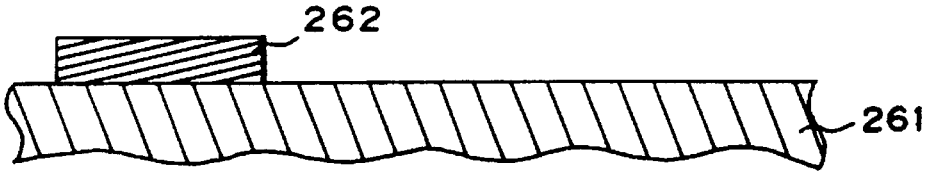
FIGS. 28A~28H are diagrams for describing a process for manufacturing surface-conduction electron-emitting devices according to the invention.
Figure 28B:
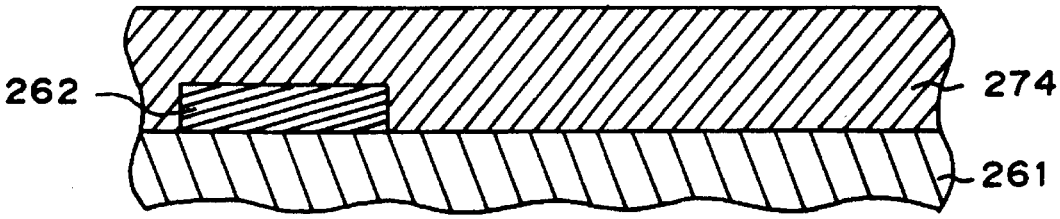
Figure 28C:
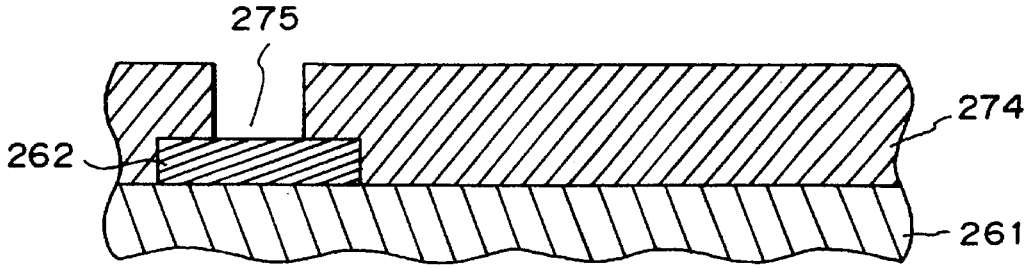
Figure 28D:
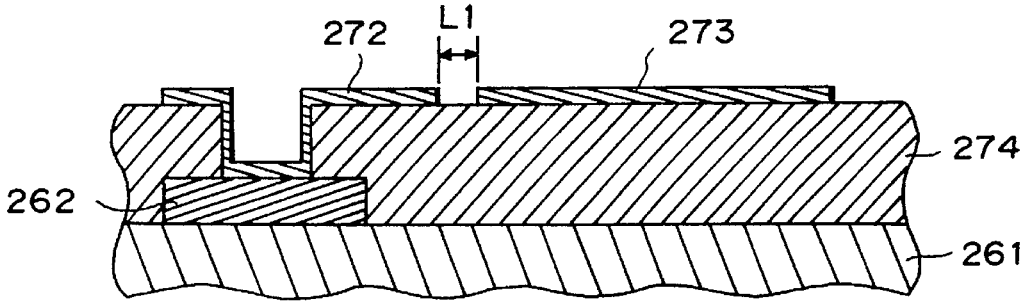
Figure 28E:
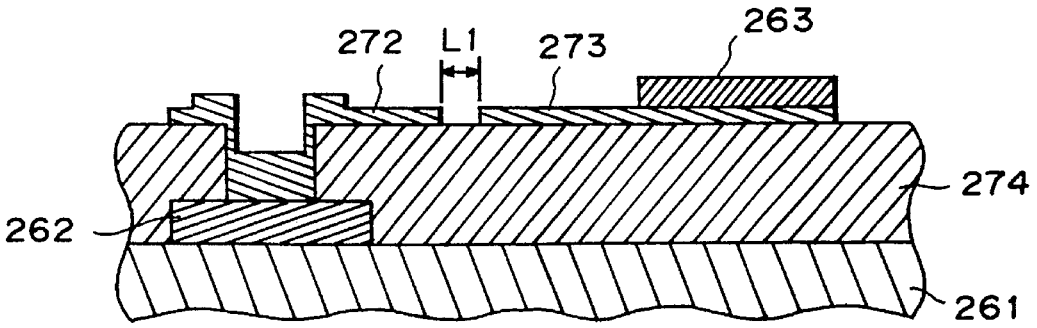
Figure 28F:
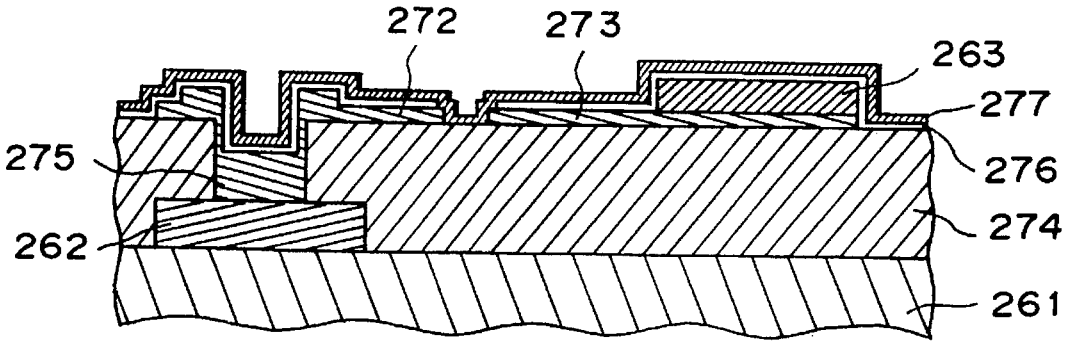
Figure 28G:
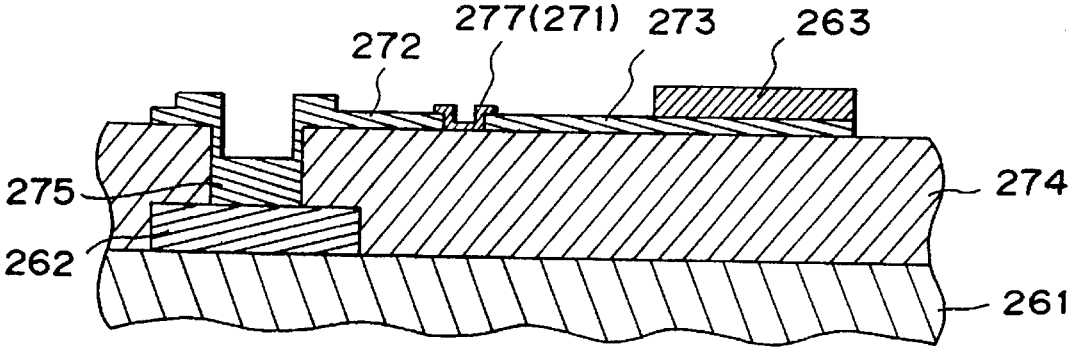
Figure 28H:
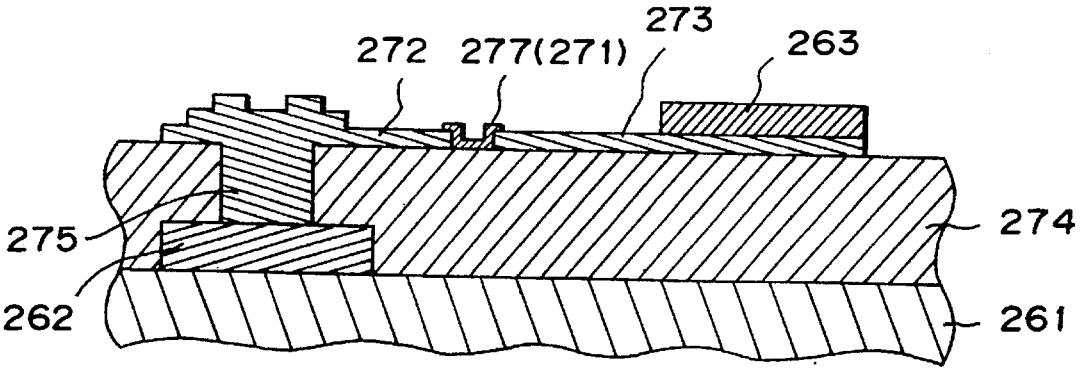

FIG. 26 is a plan view illustrating a portion of an electron source. FIG. 27 is a sectional view taken along line A–A' of FIG. 26. Components in FIGS. 26 and 27 that are identical are designated by like reference characters. Here numeral 261 denotes a substrate, 262 the X-direction wiring (also referred to as "lower wiring") corresponding to Dx in FIG. 24, and 263 the Y-direction wiring (also referred to as "upper wiring") corresponding to Dy in FIG. 24. Numeral 264 denotes a thin film that includes an electron emission portion. Numerals 272, 273 denote device electrodes, 274 an interlayer insulating layer, and 275 a contact hole for electrically connecting the device electrode 272 and the lower wiring 262.

The method of manufacture will now be described in detail in accordance with the process steps while referring to FIGS. 28A~28H.

[Step a]

Cr having a thickness of 50 Å and Au having a thickness of 6000 Å were successively formed by vacuum deposition on the substrate 261, which was obtained by forming a film of silicon oxide to a thickness of 0.5 μm on a cleaned plate of sodalime glass 261 by sputtering. Thereafter, a photoresist (AZ1370, manufactured by Hoechst Japan Ltd.) was rotatively applied by a spinner and then baked. A photomask image was then exposed and developed to form the resist pattern of the lower wiring 262. The deposited film of Au/Cr was then subjected to wet etching to form the lower wiring 262 of the desired shape.

[Step b]

Next, the interlayer insulating layer 274, which comprises a silicon oxide films having a thickness of 0.1 μm, was deposited by RF sputtering.

[Step c]

A photoresist pattern for forming the contact hole 275 in the silicon oxide film, which was deposited at step b, was produced, and the interlayer insulating layer 274 was etched away, using the photoresist pattern as a mask, to form the contact hole 275. The etching method was RIE (reactive ion etching) using $CF_4$ and $H_2$ gas, by way of example.

[Step d]

Next, to obtain the device electrodes 272, 273 and a gap L1 between the device electrodes, a pattern was formed by a photoresist (RD-2000N-41, manufactured by Hitachi Kasei K.K.), after which Ti and Ni were successively deposited to thicknesses of 50 Å and 1000 Å, respectively, by vacuum deposition. The photoresist pattern was dissolved by an organic solvent and the deposited film of Ni/Ti was lifted off to form the device electrodes 272, 273 having the gap L1 between them. Here the gap was 2 μm and the width W1 of the terminal electrode W1 was 220 μm.

[Step e]

After a photoresist for the upper wiring 263 was formed on the device electrodes 272, 273, Ti and Au were successively vacuum-deposited to thicknesses of 50 Å and 5000 Å, respectively. Unnecessary portions were then removed by being lifted off to form tile upper wiring 263 of the desired shape.

[Step f]

Figure 29:
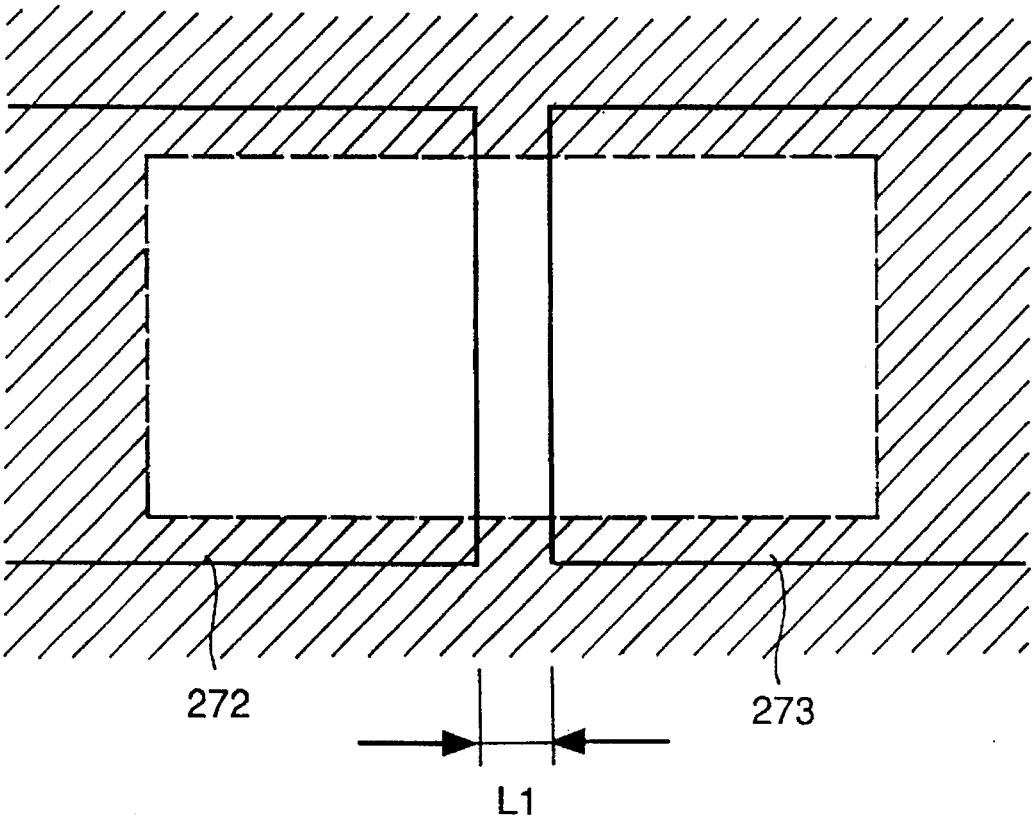
FIG. 29 is a partial plan view showing the mask of surface-conduction electron-emitting devices according to the invention.

FIG. 29 is a partial plan view showing a mask of a thin film 271 for forming the electron emission portion of each surface-conduction electron-emitting device according to this process. This mask has the gap L1 between the device electrodes and openings in the vicinity thereof. By using this mask, a Cr film having a film thickness of 1000 Å was deposited by vacuum deposition and subjected to patterning. Organic Pd (CCP4230, manufactured by Okuno Seiyaku K.K.) was then rotatively applied to the Cr thin film by a spinner, after which a heating and baking treatment was applied for 10 min at 300° C. The thus formed thin film, which is for forming the electron-emitting device, comprising fine particles the principle device of which was Pd had a film thickness of 100 Å. The sheet resistance value was $5\times10^4$ Ω/. The film of fine particles is a film constituted of a large number of fine particles, as set forth earlier. As for the fine structure, the fine particles are not limited to loosely dispersed particles; the film may be one in which the fine particles are tightly arranged or mutually and randomly overlapping (to form an island structure under certain conditions). The fine particles have a mean particle size of preferably between several angstroms and hundreds of several angstroms.

[Step g]

The Cr film 276 and the baked thin film 277 for forming the electron emission portion were subjected to wet etching by an acid etchant to form a desired pattern.

[Step]

A pattern such as will apply a photoresist to portions other than that of the contact hole 275 was formed, after which Ti and Au were successively deposited to thicknesses of 50 angstroms and 5000 angstroms, respectively, by vacuum deposition. By removing unnecessary portions of the photoresist by lift-off, the contact hole 275 was left filled.

Thus, by performing the foregoing process, the lower wiring 262, the interlayer insulating layer 274, the upper wiring 263, the device electrodes 272, 273 and the thin film 277 for forming the electron emission portion were formed on the same insulative substrate 261. The substrate fabricated as set forth above is referred to as an electron-source substrate that has not been subjected to forming.

Next, a detailed example will be described in which, using the electron-source substrate that has not been subjected to the forming treatment, an electron source is fabricated by carrying out the forming treatment according to the present invention.

Figure 30:
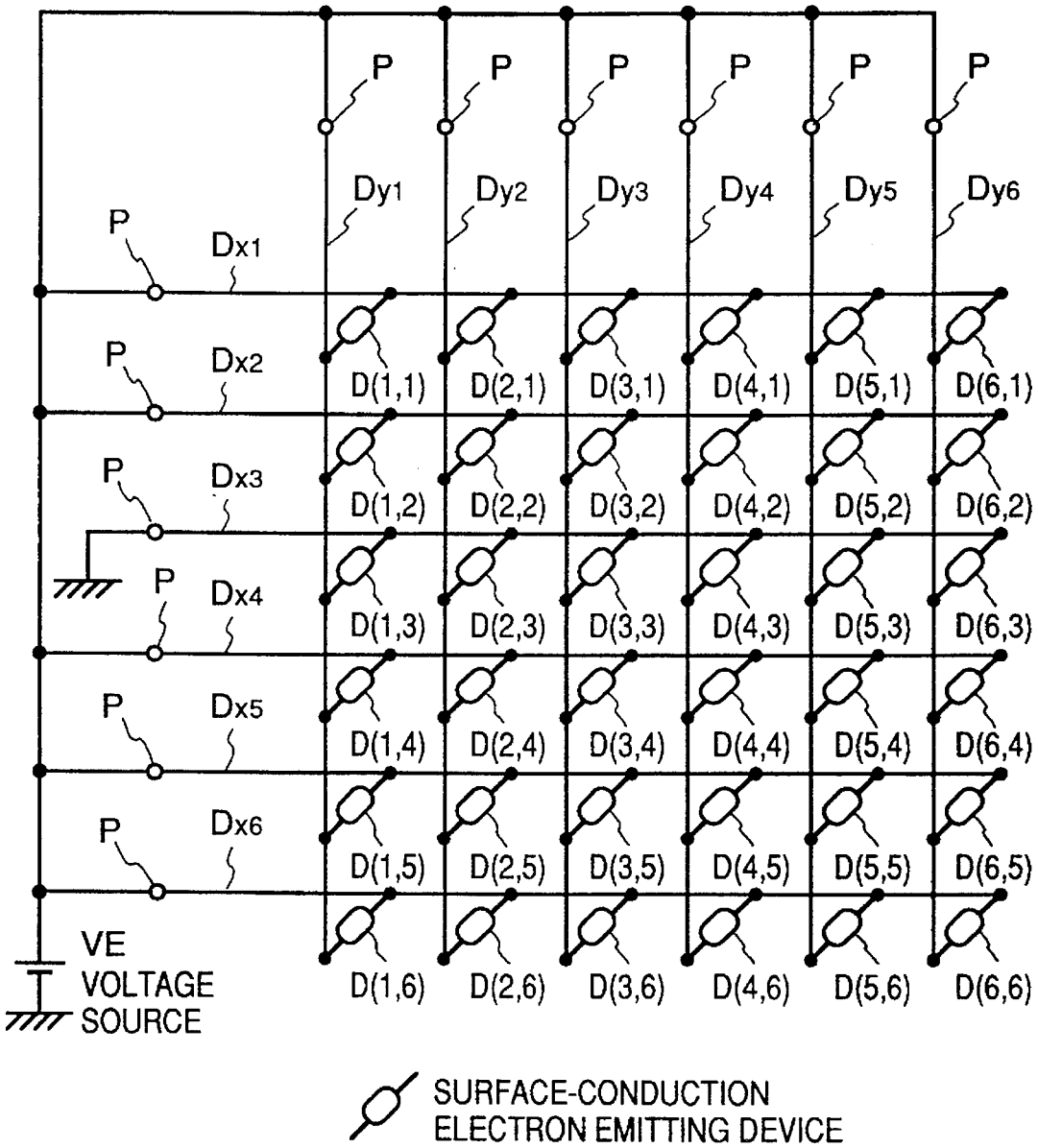
FIG. 30 is a diagram showing electrical connections when forming some of the surface-conduction electron-emitting devices arrayed in the form of a matrix.

FIG. 30 is a diagram for describing this embodiment and shows the electrical connections when forming is applied to part of a group of surface-conduction electron-emitting devices wired in the form of a simple matrix in the manner described earlier. For the sake of convenience, only 6×6 surface-conduction electron-emitting devices are shown to be wired in the form of the simple matrix. According to this embodiment, however, a 300×200 matrix has been fabricated.

In order to distinguish among the surface-conduction electron-emitting devices in the description, the devices are represented by (X,Y) coordinates in the form D(1,1), D(1,2), . . . , D(6,6) in FIG. 30.

Further, $D_{x1}$, $D_{x2}$, . . . , $D_{x6}$ and $D_{y1}$, $D_{y2}$, . . . , $D_{y6}$ in FIG. 30 represent the respective wires of the simple matrix wiring. These wires electrically connect the matrix to the outside via terminals P.

Further, VE represents a voltage source having the capability to generate a voltage necessary for the forming of the surface-conduction electron-emitting devices.

FIG. 30 illustrates a voltage application method for simultaneously forming 300 devices, namely D(1,3), D(2,3), D(3,3), D(4,3), D(5,3), D(6,3), . . . , D(300,3). As shown in FIG. 30, ground level, namely 0 V, is applied to the wire $D_{x3}$. A potential of, say, 6 V from a voltage source $V_{form}$ is applied to the X-direction wiring other than wire $D_{x3}$, namely to wires $D_{x1}$, Dx2, $D_{x4}$, $D_{x5}$, $D_{x6}$, . . . , $D_{x200}$. At the same time, a potential from the voltage source $V_{form}$ is applied to each of the wires $D_{y1}$, $D_{y2}$, $D_{y4}$, $D_{y5}$, $D_{y6}$, . . . , $D_{y300}$.

As a result, the output voltage of the voltage source $V_{form}$ is impressed across the devices D(1,3), D(2,3), D(3,3), D(4,3), D(5,3), D(6,3), . . . , D(300,3) that have been selected from among the plurality of matrix-wired devices. Consequently, these 300 devices are subjected to forming in parallel.

As for the devices other than the above-mentioned 300 devices, a substantially equal potential (the output potential of the voltage source VE) is applied to both ends of each device, so that the voltage across each device is approximately 0 V. Naturally, this means that these devices are not subjected to forming. The thin film comprising the electron emission material does not deteriorate and is not damaged.

The electron emission portions thus fabricated consisted of fine particles, the principle ingredient of which was palladium, in a dispersed state. The average particle diameter of the particles was 30 angstroms.

The resistance of each device was about 1 kΩ, the resistance (in the x direction) of the lower wiring per device was about 0.03Ω, and the resistance (in the y direction) of the lower wiring per device was about 0.1Ω.

In a case where the power supply portion is on one side, we have the following from Equation (12), as set forth earlier:

$$(N_x \times N_x - 8N_x) \times r_x = 2628,\ (N_y \times N_y - 8N_y) \times r_y = 3840$$

Therefore, though the number of devices is large, the devices in the x direction should be subjected to forming.

In order to ascertain the characteristics of a number of plane-type surface-conduction electron-emitting devices fabricated by the foregoing process, the electron emission characteristics were measured using the measuring apparatus of FIG. 9.

As for the measurement conditions, the distance between the anode electrode and the surface-conduction electron-emitting device was made 4 mm, the potential of the anode electrode was made 1 kV, and the degree of vacuum within the evacuated vessel at the time of measurement of the electron emission characteristic was set at $1\times10^{-6}$ Torr.

In a typical surface-conduction electron-emitting device in this embodiment, emission current Ie increased sharply from an device voltage of 8 V. At an device voltage of 14 V, device current If was 2.2 mA, and the emission current Ie was 1.1 μA. Electron emission efficiency=Ie/If (%) was 0.05%.

According to this embodiment, the variance in electron emission efficiency was less than 7% for all devices, indicating that substantially uniform characteristics were obtained.

EXAMPLE 2

Here an example will be described in which an image forming apparatus was constructed using the electron-source substrate, fabricated according to Example 1, that has not been subjected to the forming treatment. This will be described with reference to FIGS. 24 and 25A, 25B.

The electron-source substrate 111, obtained by arranging 300×200 devices, which have not been subjected to the aforementioned forming treatment, was secured to the rear plate 241, after which the face plate 246 (comprising the phosphor film 244, which is an image forming member, and the metal back 245 on the inner surface of the glass plate substrate 243) was disposed 5 mm above electron-source substrate 111 via the supporting frame 242, and the joints of the face plate 246, supporting frame 242 and rear plate 241 were coated with frit glass, which was then baked in the atmosphere at 400° C. for 10 min to effect sealing. Fixing of the electron-source substrate 111 to the rear plate 241 was also accomplished by using frit glass.

The fluorescent film 244 comprises only fluorescer if the apparatus is for monochromatic use. In this embodiment, however, the fluorescent film 244 was fabricated by forming black stripes (as shown in FIG. 25) in advance and applying a coating of various color phosphors between the stripes. As for the material constituting the black stripes, use was made of a substance whose principal ingredient was graphite. The slurry method was used to coat the glass substrate 244 with the phosphors.

The metal back 246 provided on the inner side of the fluorescent film 245 was fabricated by applying a smoothing treatment (usually referred to as "filming") to the inner surface of the fluorescent film after the fluorescent film was fabricated, and then depositing A1 by vacuum deposition. In order to improve the conductivity of the fluorescent film 245, there are cases in which the face plate is provided with transparent electrodes on the side of the outer surface of the film 245. In this embodiment, however, the electrodes were not used since satisfactory conductivity was obtained with the metal back 246 alone. When the above-described sealing operation is performed, sufficient positioning is carried out since the color fluorescer and the surface-conduction electron-emitting devices must be made to correspond in the case of a color display.

The environment within the glass vessel completed as described above was withdrawn through an exhaust pipe (not shown) using a vacuum pump. After a degree of vacuum on the order of $10^{-5}$ Torr was attained, a voltage was applied across the device electrodes through external terminals $D_{OX1}$~$D_{OXm}$, $D_{OY1}$~$D_{OYn}$ according to the scope of Example 1, whereby the above-described electrification treatment (forming treatment) was applied to form the electron emission portions and fabricate the surface-conduction electron-emitting devices.

Next, the exhaust pipe (not shown) was heated by a gas burner in a vacuum on the order of $1\times10^{-6}$ Torr, thereby sealing off the vessel by fusing it.

Finally, a getter treatment was applied in order to maintain the vacuum after sealing. Specifically, a getter of Ba, which was disposed at a predetermined position (not shown) in the image forming apparatus, was heated by a high-frequency heating method after the sealing treatment, thereby forming a vacuum-deposited film.

In the image forming apparatus of the invention completed as described above, scanning signals and modulating signals were applied to each of the surface-conduction electron-emitting devices through the external terminals $D_{OX1}$~$D_{OXm}$, $D_{OY1}$~$D_{OYn}$ by signal generating means (not shown), whereby electrons were emitted. A high voltage greater than several kilovolts was impressed upon the metal back 245 through the high-voltage terminal Hv, thereby accelerating the electron beam. The electrons were thus caused to bombard the fluorescent film 244, thereby exciting the fluorescer into light emission to display an image.

In the image forming apparatus fabricated according to this Example, it was confirmed that the device characteristics were uniform and that a great improvement was achieved in the uniformity of the luminance of the display image owing to the fact that a number of surface-conduction electron-emitting devices wired in the form of a simple matrix could be formed uniformly.

In actuality, two display apparatuses fabricated as described above were prepared. In one apparatus, the power supply portion was provided on one side only and line forming was carried out in the x direction. In the other apparatus, the power supply portion was provided on one side only and line forming was carried out in the y direction. A constant voltage was applied to each pixel, 5 kV was applied to the high-voltage terminal Hv and luminance was measured. Whereas line forming in the x direction resulted in luminance irregularity of less than 7%, line forming in the y direction resulted in luminance irregularity of 15%. In other words, it will be understood that the direction in which line forming should be carried out can be decided prior to forming.

EXAMPLE 3

Described next will be an image forming apparatus fabricated in the same manner as in the Example 2 using means A-1 according to the present invention. In this example, however, the number of devices, the shape of the wiring and the thickness differ from those of Example 2. An electron-source substrate was fabricated in which $N_x=50$, $r_x=0.3\Omega$, $N_y=50$, $r_y=0.1\Omega$, $R=1$ k$\Omega$, using the expressions already described. Further, the image forming apparatus had a structure in which current could be fed from both ends of the wiring in the X and Y directions.

In a case where power supply portions are provided on both sides of each wire, we have the following, as described earlier:

$$(N_x \times N_x - 24N_x) \times r_x = 39,\ (N_y \times N_y - 24N_y) \times r_y = 18$$

That is, it will be appreciated that the surface-conduction electron-emitting devices in the Y direction should be subjected to forming.

As in the Example 2, two panels subjected to the forming treatment by two methods, namely the line forming method in the x direction and the line forming method in the y direction, were compared. It was found that luminance irregularity was 12% with the former and less than 6% with the latter. Clearly, carrying out the forming treatment in the y direction gives less luminance irregularity. In other words, it will be understood that the direction in which line forming should be carried out can be decided prior to forming.

EXAMPLE 4

A treating apparatus for carrying out the forming treatment of means A-1 according to the present invention will now be described.

Figure 31:
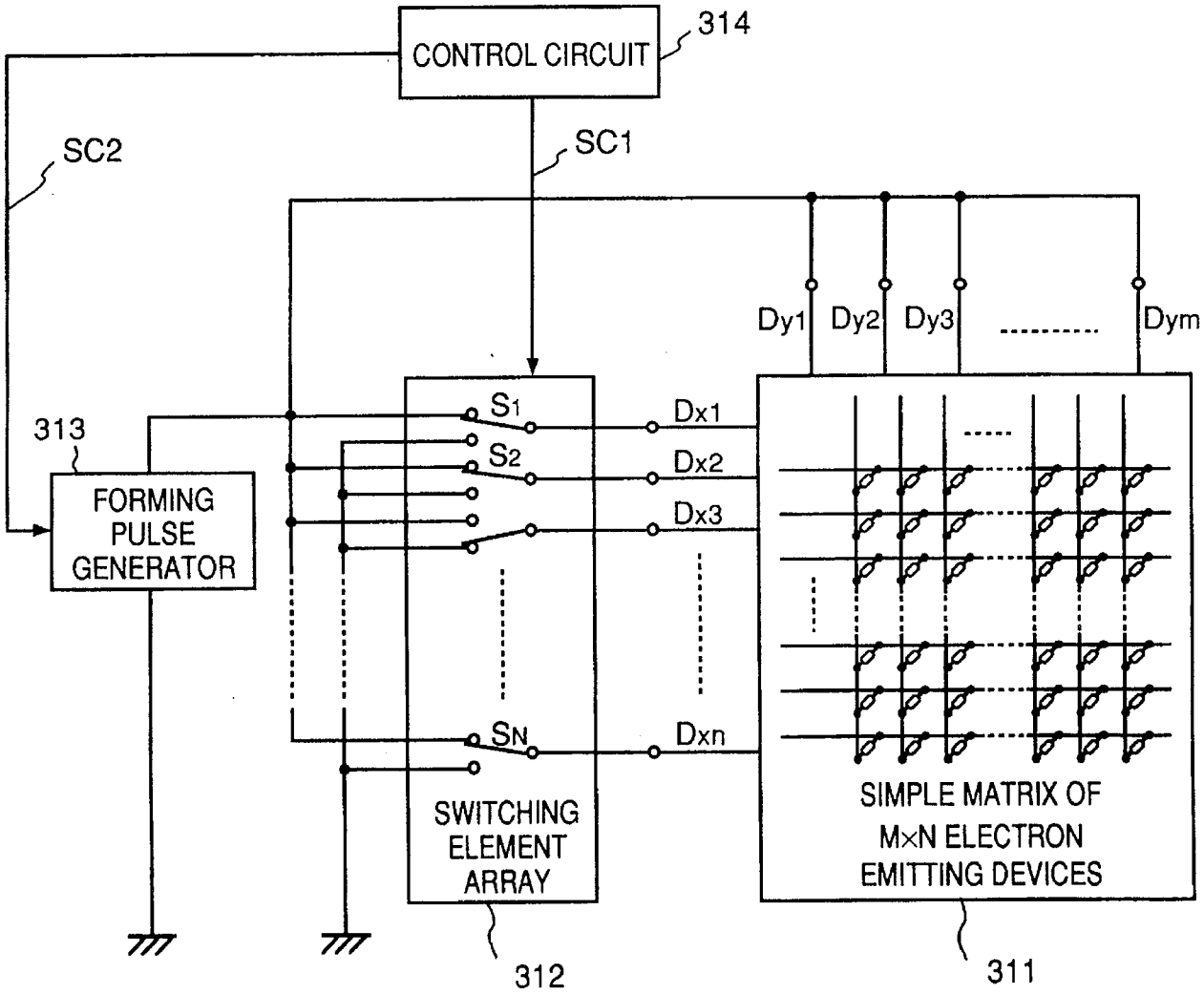
FIG. 31 is a circuit diagram showing the circuit arrangement of a forming apparatus according to the invention.
Figure 32:
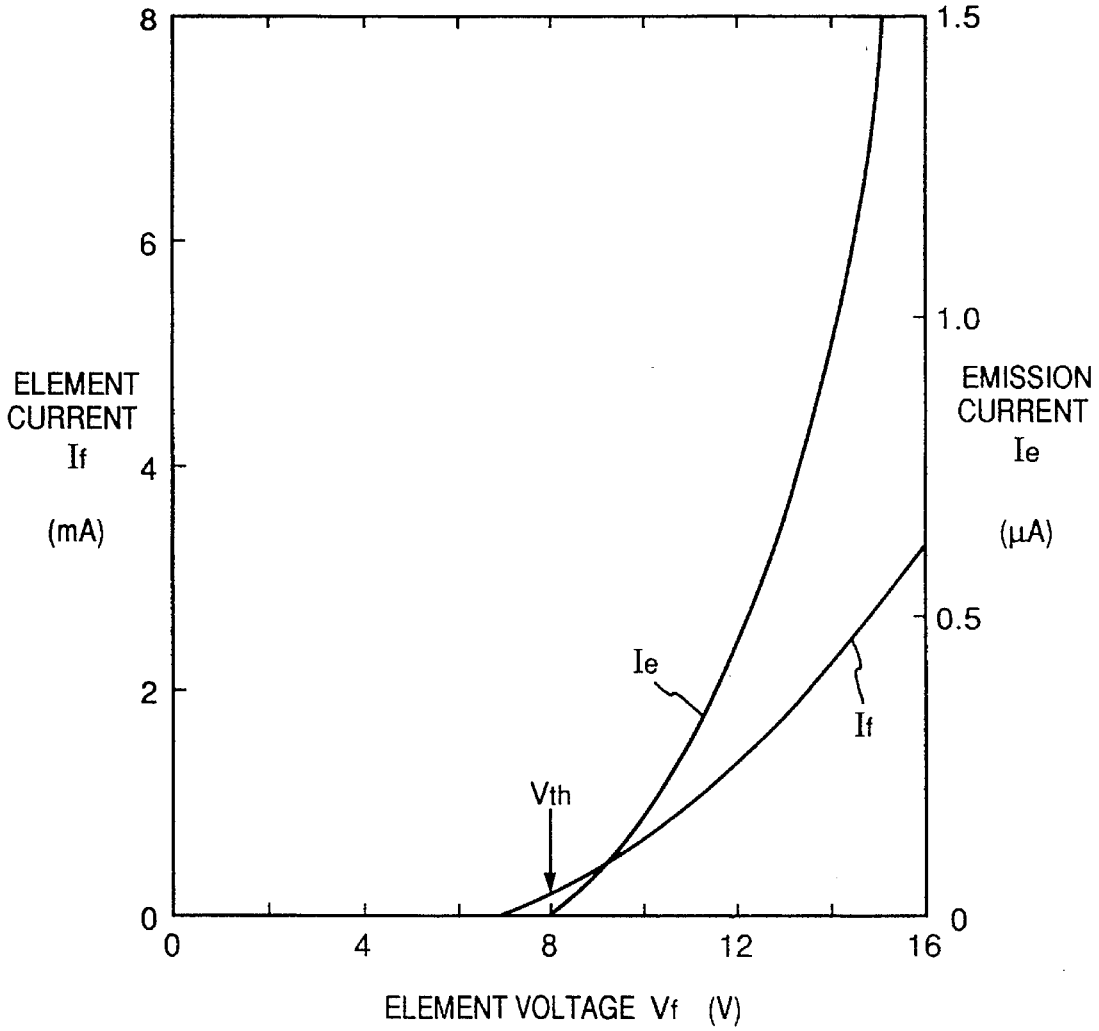
FIG. 32 is a graph showing an example of characteristics of surface-conduction electron-emitting device according to the invention.

FIG. 31 shows an example of an electric circuit arrangement of a forming treating apparatus. Numeral 311 in FIG. 31 denotes an electron-source substrate, which has not been subjected to the forming treatment, obtained by wiring, in the form of a simple matrix, m×n surface-conduction electron-emitting devices fabricated through a process similar to that of Example 1. Numeral 312 denotes a switching device array, 313 a forming pulse generator, and 314 a control circuit.

The electron-source substrate 311 is electrically connected to the peripheral electric circuitry via terminals $D_{x1}$~$D_{xn}$, $D_{y1}$~$D_{ym}$. The terminals $D_{x1}$~$D_{xn}$ are connected to the switching device array 312, and the terminals $D_{y1}$~$D_{ym}$ are connected to the output of the forming pulse generator 313.

The switching device array 312 is internally equipped with n-number of switching devices $S_1$~$S_n$. The switching devices function to connect respective ones of the terminals $D_{x1}$~$D_{xn}$ to the output of the forming pulse generator 313 or to ground level.

Each switching device operates in accordance with a control signal SC1 generated by the control circuit 314.

The timing pulse generator 313 outputs voltage pulses in accordance with a control signal SC2 generated by the control circuit 314. The control circuit 314 is a circuit for controlling the operation of the switching devices and the operation of the forming pulse generator 313, as described above.

The functions-of the various components are as described above. Overall operation will now be described.

First, before forming is started, all of the switching devices of the switching device array 312 are connected to the ground-level side in response to control by the control circuit 314. Further, the output voltage of the forming pulse generator 313 also is held at the ground level of 0 V.

Next, in order to select one row of the device rows and subject them to the forming treatment, as described in connection with FIG. 30, the control circuit 314 generates the control signal SC1 in such a manner that all of the switching devices in the switching device array 312 other than those connected to the row to undergo the forming treatment will be connected to the side of the forming pulse generator 313. (In the example illustrated in FIG. 31, all switching devices excluding S3 are connected to the side of the forming pulse generator 313).

Next, the control circuit 314 sends the forming pulse generator 313 the control signal SC2, in response to which the generator 313 generates voltage pulses suitable for forming.

If forming for the selected row of devices is completed, the control circuit 314 generates the control signal SC2, causing the forming pulse generator 313 to halt pulse generation and sending the output voltage to 0 V. Furthermore, the control signal 314 generates the control signal SC1 so that all of the switching devices contained in the switching device array 313 will be connected to the side of the ground level.

By virtue of the foregoing operational procedure, forming of the arbitrarily selected row of devices is completed. By successively forming other rows of devices by a similar procedure, it is possible to uniformly form all devices of the substrate on which m×n surface-conduction electron-emitting devices are wired in a simple matrix.

In this example, the forming treatment was carried out by applying voltage waveform pulses of the kind shown in FIG. 8 to selected devices using a simple matrix substrate having 100×100 devices. Furthermore, in this example, pulse width T1 was 1 msec, pulse interval T2 was 10 msec, the peak value of the triangular waveform (the peak voltage at the time of forming) was 5 V, and the forming treatment was carried out for 60 sec under a vacuum of about $1\times10^{-6}$ Torr.

Upon using the measuring apparatus of FIG. 9 to measure a typical device in a fabricated electron source, it was found that emission current Ie increased sharply from an device voltage of 8 V. Further, at an device voltage of 14 V, device current If was 2.4 mA, and the emission current Ie was 1.0 μA. Electron emission efficiency η=Ie/If (%) was 0.04%.

When a variance in fissure formation occurs, the above-described uniformity of electron emission efficiency between devices is not obtained. However, in accordance with the forming apparatus of the present invention, the variance in voltage effectively applied to each device becomes small at the instant forming is carried out, and the variance in electron emission efficiency between devices is held below 10% as an device characteristic.

EXAMPLE 5

Next, a specific example will be described in which an electron source is produced by carrying out the forming treatment based upon the aforesaid means A-2 using an electron-source substrate, identical with that fabricated in Example 1, which has not been subjected to the forming treatment.

FIG. 18 is a diagram for describing this embodiment and shows the electrical connections when forming is applied to part of a group of surface-conduction electron-emitting devices wired in the form of a simple matrix in the manner described earlier.

According to the arrangement of FIG. 18, forming is carried out by connecting a forming power supply (a potential of V1 or V2) to row wiring ($D_{X1-m}$) and column wiring ($D_{Y1-n}$). At this time the potential V1 is applied to k-number of the wires among the entirety of row wires, the potential V2 is applied to the remaining (m–k)-number of row wires, the potential V2 is applied to L-number of wires among the entirety of column wires, and the potential V1 is applied to the remaining (n–L)-number of the column wires. As a result, K×L+(m–K)×X(n–L)-number of the surface-conduction electron-emitting devices among the entirety thereof are selected. A voltage of substantially V2–V1 (6 V in this embodiment) is applied to the selected surface-conduction electron-emitting devices to carry out forming.

As for the devices other than the above-mentioned selected devices, a substantially equal potential is applied to the electrodes at both ends of the devices, so that the voltage across each device is approximately 0 V. Naturally, this means that these devices are not subjected to forming. In addition, the thin film for forming the electron emission portions does not deteriorate and is not damaged.

Next, by interchanging the potentials V1 and V2 connected to the column wiring (or row wiring), the remaining surface-conduction electron-emitting devices not selected earlier are selected and forming is carried out in similar fashion.

In order to ascertain the characteristics of the number of surface-conduction electron-emitting devices fabricated in the foregoing process with m, n set at 100, K and L set at 50, the electron emission characteristics were measured using the measuring apparatus of FIG. 9.

As for the measurement conditions, the distance between the anode electrode and the surface-conduction electron-emitting device was made 4 mm, the potential of the anode electrode was made 1 kV, and the degree of vacuum within the evacuated vessel at the time of measurement of the electron emission characteristic was set at $1\times10^{-6}$ Torr, as in the above-described example. As a result, the electron emission efficiency η=Ie/If (%) was 0.04%. Further, substantially uniform characteristics were obtained for all devices. For example, variance in the electron emission efficiency η was less than 8% overall.

EXAMPLE 6

An image forming apparatus fabricated by applying a forming treatment identical with that of Example 5 will now be described with reference to FIG. 24.

Though the arrangement and method of fabrication are similar to those of Example 2 described earlier, here an image forming apparatus that has not been subjected to the electrification treatment is fabricated using an electron-source substrate on which 100×100 devices are wired in the form of a simple matrix, i.e., a substrate identical with that fabricated in Example 5.

The environment within the glass vessel completed as described above was withdrawn through the exhaust pipe (not shown). After a degree of vacuum on the order of $1\times10^{-5}$ Torr was attained, a voltage was applied across the device electrodes through external terminals $D_{OX1}$~$D_{OXm}$, $D_{OY1}$~$D_{OYn}$ according to the scope of Example 5, whereby the above-described electrification treatment (forming treatment) was applied to form the electron-emitting devices and fabricate the surface-conduction electron-emitting devices.

Next, the exhaust pipe (not shown) was heated by a gas burner in a vacuum on the order of $1\times10^{-6}$ Torr, thereby sealing off the vessel by fusing it.

Finally, a getter treatment was applied in order to maintain the vacuum after sealing.

In the image forming apparatus of the invention completed as described above, scanning signals and modulating signals were applied to each of the surface-conduction electron-emitting devices through the external terminals $D_{OX1}$~$D_{OXm}$, $D_{OY1}$~$D_{OYn}$ by signal generating means (not shown), whereby electrons were emitted. A high voltage was applied through the high-voltage terminal Hv to display an image.

In the image forming apparatus fabricated according to this Example, it was confirmed that the device characteristics were uniform and that luminance irregularity of the displayed image was less than 8% owing to the fact that a number of surface-conduction electron-emitting devices wired in the form of a simple matrix could be formed uniformly.

EXAMPLE 7

Described next will be an electron source fabricated by carrying out the forming treatment according to another method based upon means A-2 of the invention using the electron-source substrate, which has not been subjected to the forming treatment, fabricated according to Example 1.

Figure 33:
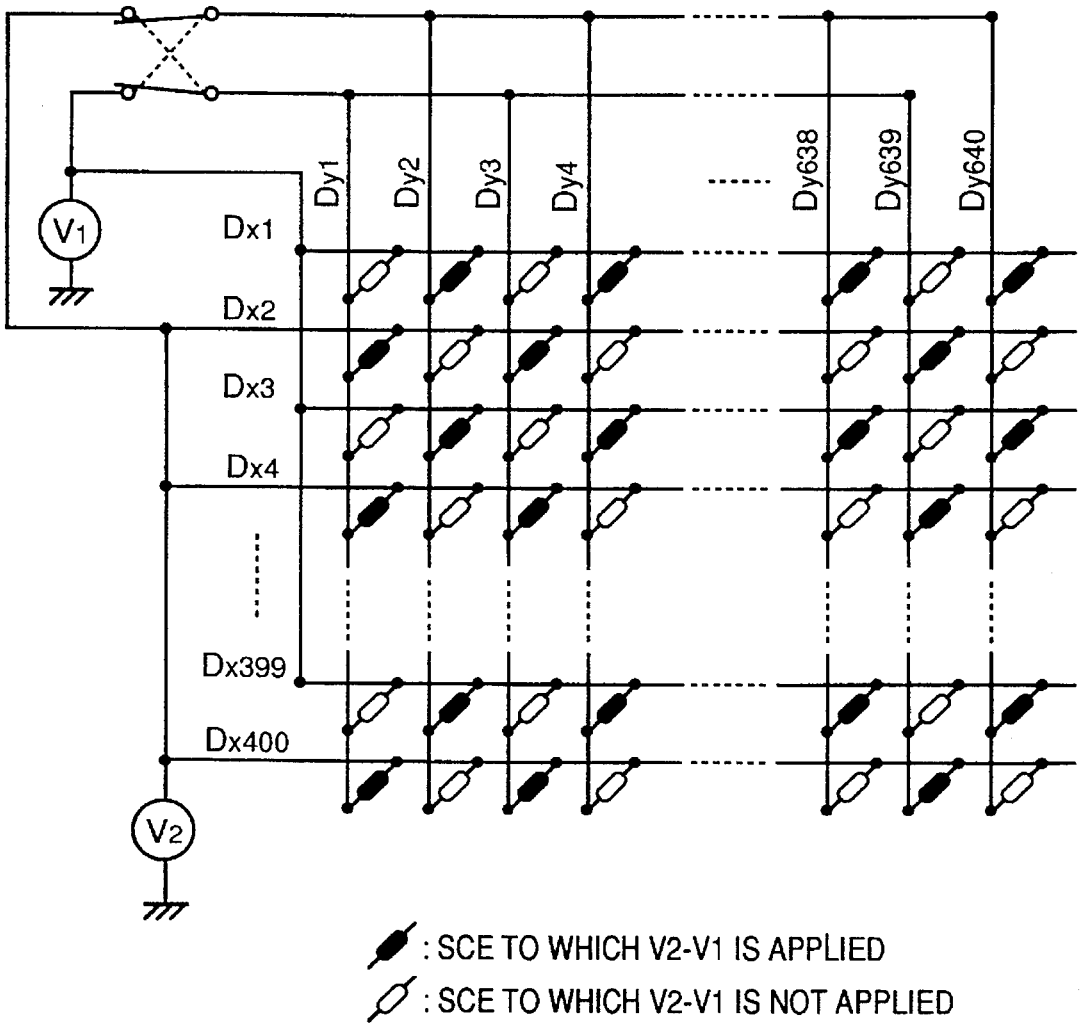
FIG. 33 is a diagram for describing the forming of surface-conduction electron-emitting devices wired in a simple matrix according to the invention.

FIG. 33 illustrates the electrical connections when forming is carried out with regard to half the number of a group of 640×400 surface-conduction electron-emitting devices, which have not been subjected to the forming treatment, wired in a simple matrix array.

In FIG. 33, $D_{x1}$, $D_{x2}$, . . . , $D_{x400}$ and $D_{y1}$, $D_{y2}$, . . . , $Dy_{640}$ represent the individual wires of the simple matrix wiring. Further, V1, V2 denote power supplied for generating forming pulses.

FIG. 33 illustrates a voltage application method for a case where the devices indicated in black are subjected to selective forming. Specifically, V1 is ground level and V2 is a potential $V_{form}$. A voltage of approximately V2–V1, namely $V_{form}$, is applied across both end of the black devices, and approximately 0 V is applied across the white devices. As a result, the black devices undergo forming selectively and the white devices are unchanged.

Figure 34:
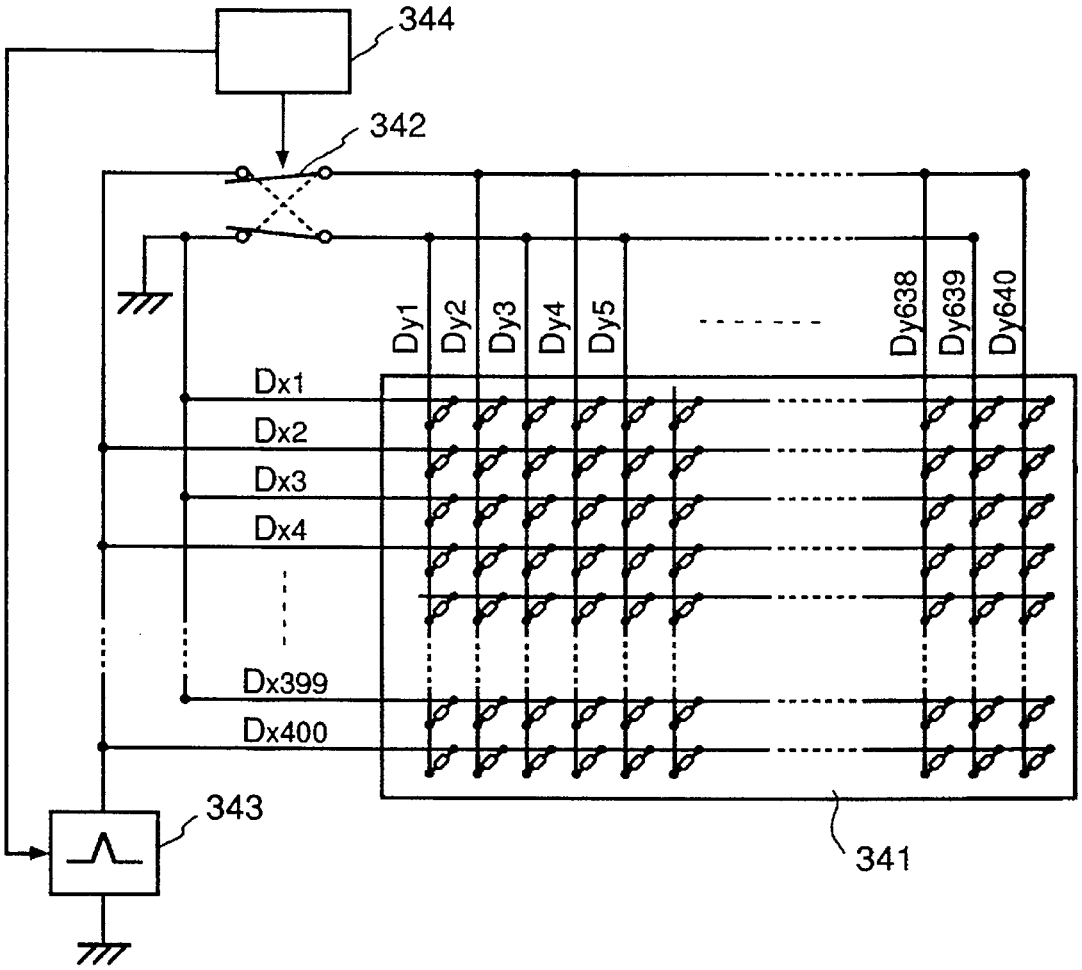
FIG. 34 is a diagram showing a circuit arrangement for carrying out the forming of FIG. 33.

FIG. 34 illustrates an electric circuit arrangement for carrying out the forming treatment by the above-described method. Numeral 341 denotes a substrate of an electron source obtained by wiring, in the form of a simple matrix, 640×400 surface-conduction electron-emitting devices that have not been subjected to the forming treatment. Numeral 342 denotes a switching circuit, 343 a forming pulse generator and 344 a control circuit.

Of the row wires ($D_{x1}$, $D_{x2}$, . . . , $D_{x400}$), the odd-numbered groups are connected to ground level and the even-numbered groups are connected to the output of the forming pulse generator 343. Of the column wires ($D_{y1}$, $D_{y2}$, . . . , $D_{y640}$), the odd-numbered groups are connected to ground level or to the output of the forming pulse generator and the even-numbered groups are connected to ground level or to the output of the forming pulse generator. However, the column wires are not all connected to the forming pulse generator simultaneously.

The switching circuit 342 changes over the connections of the-column wires in response to a signal from the control circuit 344. The forming pulse generator 343 outputs the forming pulses in accordance with a control signal generated by the control circuit 344.

First, prior to the start of forming, all wires are held at ground level. Next, the control circuit 344 sends a signal to the switching circuit 342 so as to connect the odd-numbered groups of the column wires to the output of the timing pulse generator 343 and connected the even-numbered groups of the column wires to ground level. The control circuit 344 then sends a signal to the forming pulse generator 343 so that forming is carried out. The forming pulses are applied to the selected surface-conduction electron-emitting devices. At this time a forming current for 320 devices, which is half the 640 surface-conduction electron-emitting devices in the row direction, flows into each row wire, and current for 200 devices similarly flows into each column wire.

When the forming of all selected devices is completed, the switching circuit 342 is changed over to connect the odd-numbered column wires to ground level and the even-numbered column wires to the output of the timing pulse generator 343, whereby the remaining devices are selected so that the forming pulses may be applied and forming carried out in a similar manner.

In this Example, pulses having a voltage waveform of the kind shown in FIG. 8 were applied to the selected devices and the electric forming treatment was performed in accordance with the procedure set forth above. Furthermore, in this Example, pulse width T1 was 1 msec, pulse interval T2 was 10 msec, the peak value of the triangular waveform (the peak voltage at the time of forming) was 5 V, and the forming treatment was carried out for 60 sec under a vacuum of about $1\times10^{-6}$ Torr.

In this Example, a temperature rise due to the current that flows into each wire at forming time could be suppressed and there was no damage to the wiring or substrate whatsoever. Furthermore, since a number of the matrix-wired surface-conduction electron-emitting devices were formed in staggered fashion, as shown in FIG. 33, a temperature irregularity did not develop and forming could be carried out in excellent fashion.

As a result, as in Example 5, measuring the electron emission characteristics showed that the electron emission efficiency $\eta$=Ie/If (%) was 0.05%. Further, substantially uniform characteristics were obtained for all devices. For example, variance in the electron emission efficiency $\eta$ was less than 13% overall.

Further, With respect to the image forming apparatus, prior to the forming treatment, fabricated with an arrangement similar to that of Example 6, a number of surface-conduction electron-emitting devices wired in the form of a simple matrix could be formed uniformly also in the image forming apparatus fabricated by applying the forming treatment according to the method of this Example. As a result, it was confirmed that the device characteristics were uniform and that the luminance irregularity of the displayed image was less than 13%.

EXAMPLE 8

Examples 1 through 7 relate to a method of supplying current through wiring from external terminals so as to apply a forming voltage to only some of the devices. In this example, however, current is supplied to devices by the aforesaid means B-1 using electrical connecting means other than wiring.

The method used in this Example can be implemented with either the above-described ladder arrangement or simple matrix arrangement independently of the manner in which the wiring is arrayed.

First, the process for fabricating an electron source in which surface-conduction electron-emitting devices are connected in the ladder array will be described with reference to FIG. 65.

A thin film of Ni having a thickness of 1000 angstroms was formed by vacuum deposition on a substrate 651 obtained by forming a film of silicon oxide to a thickness of 0.5 μm on a cleaned sheet of blue glass by means of sputtering. Device electrodes 655, 656 were then formed by photolithography.

A Cr film having a film thickness of 1000 angstroms was deposited by vacuum deposition and subjected to patterning by photolithography using a mask (FIG. 29) having the inter-device electrode gap L1 and an openings in the vicinity thereof. Organic Pd (CCP4230, manufactured by Okuno Seiyaku K.K.) was then rotatively applied to the Cr thin film by a spinner, after which a heating and baking treatment was applied for 10 min at 300° C.

The Cr film and the thin film (the main ingredient of which is Pd) thereon were etched to form a desired pattern. Thus was formed a thin film 652, for forming electron emission portions, comprising fine particles of Pd. The width W2 was made 300 μm.

Figure 35:
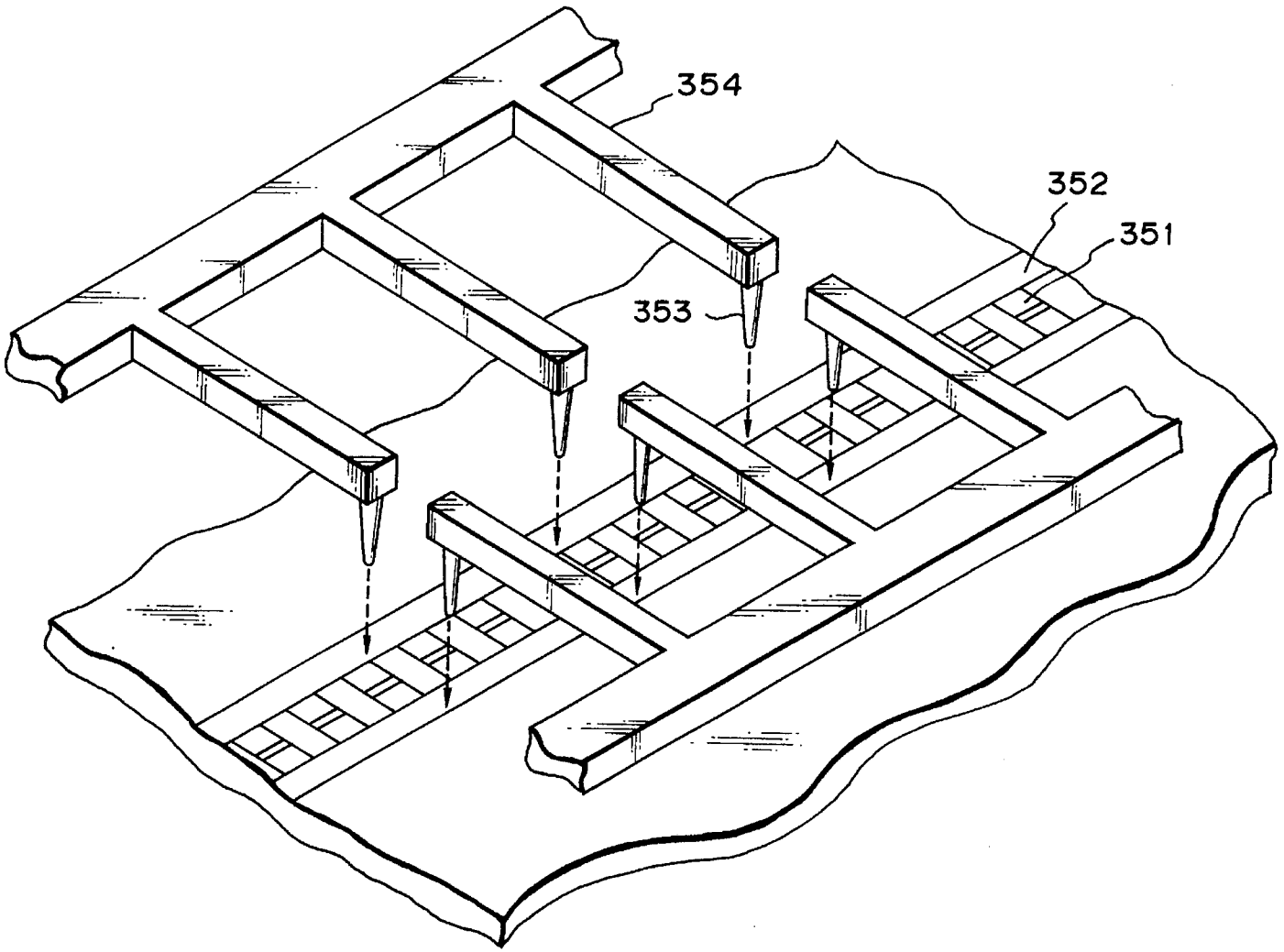
FIG. 35 is a perspective view for describing the passing of current at the time of forming.

FIG. 35 is a perspective view for describing multiple electron sources arranged in a plurality of lines, as well as electrification using forming electrical connecting means, which is a characterizing feature of the present invention. Numeral 351 denotes a surface-conduction electron-emitting device, 1000 of which are arrayed in parallel. Numeral 352 denotes an Ni electrode, which serves as common wiring for passing current through each of the devices. Needle-shaped copper terminals 353 serve as terminals for achieving electrical connection at a plurality of portions of the common wiring 252. Bulk wiring 354 made of copper electrically connects the copper terminals 353 and a forming power supply. The above-mentioned copper terminals are so arranged as to be connected in 332 sets every three surface-conduction electron-emitting devices. The copper terminals are contact-bonded to the common wiring 352 and a voltage necessary for the forming of devices is applied to the common wiring 352 from the forming power supply to form fissures that become electron emission portions.

The sectional area of the bulk copper wiring 354 was made greater than 1 $mm^2$ in order that the resistance of the bulk copper wiring 354 between the devices will be less than 1/1000 that of the common wiring 352.

If a variance develops in fissure formation, which is a problem of the prior art as described earlier, uniformity in electron emission efficiency between devices cannot be obtained. However, when the forming voltage was applied using the forming apparatus of the invention, the variance in the voltage at the portions in contact with the copper terminals (353 in FIG. 35) was held to less than 0.001 V. Variance in the electron emission efficiency between devices was held to less than 5% as an actual characteristic of the devices.

EXAMPLE 9

Here an example will be described in which an image forming apparatus was constructed using the electron-source substrate, fabricated through a process the same as that of Example 8, that has not been subjected to the forming treatment. This will be described with reference to FIGS. 21 and 60.

First, a forming treatment using electrical connecting means was performed in a nitrogen environment in the same manner as in Example 8, and the substrate was fixed to the rear plate.

FIG. 21 is a schematic showing the panel structure of an image forming apparatus equipped with a multiple electron source in a ladder array. In FIG. 21, VC represents a vacuum vessel made of glass, a portion FP of which is a face plate on the front surface side. Transparent electrodes made of ITO, for example, are formed on the inner surface of the face plate FP, and the transparent electrodes are coated with fluorescer for red, green and blue in a mosaic pattern or striped pattern. In order to avoid a complicated diagram, the transparent electrodes and fluorescer are represented collectively by PH in FIG. 21.

A black matrix or black stripes well known in the CRT field may be provided between the fluorescer of each color, and it is also possible to form a well-known metal back layer on the fluorescer. The above-mentioned transparent electrodes are electrically connected to the outside of the vacuum vessel through a terminal EV so that an electron-beam accelerating voltage can be applied. In this Example, a high voltage of 4 kV was applied.

The rear plate S is the substrate of the multiple electron beam source and is secured to the bottom of the vacuum vessel VC. Surface-conduction electron-emitting devices are formed and arrayed on the substrate in the manner described above. In this Example, 200 device rows are provided, in each of which 200 devices are wired in parallel. The two wiring electrodes of each device. row are connected alternately to electrode terminals $D_{p1}$~$D_{p200}$ and $D_{m1}$~$D_{m200}$, which are provided on respective side faces of the panel. Thus, electric driving signals can be applied from outside the vessel.

Further, grid electrodes GR in the form of stripes are provided intermediate the rear plate S and the face plate FP. The grid electrodes GR are 200 independent electrodes provided perpendicular to the device rows (i.e., in the Y direction). Each grid electrode is provided with an opening Gh through which an electron beam is transmitted. The holes Gh are circular and each is provided to correspond to one of the surface-conduction electron-emitting devices. In certain cases, however, a number of them may be provided in the form of a mesh. The grid electrodes are electrically connected with the outside of the vessel by electrode terminals $G_1$~$G_{200}$. As long as the grid electrodes are capable of modulating the electron beams emitted by the surface-conduction electron-emitting devices, the shape at the positions at which they are placed need not necessarily be as shown in FIG. 21. For example, the grid electrodes may be provided at the periphery of the surface-conduction electron-emitting devices or near the periphery.

In this display panel, a 200×200 XY matrix is constructed by the device rows of the surface-conduction electron-emitting devices and the grid electrodes. Accordingly, by simultaneously applying modulating signals for one line of an image to a grid electrode row in synchronism with successively row-by-row drive (scanning) of the device rows, irradiation of the phosphors with each electron beam is controlled to display the image line by line.

Figure 53:
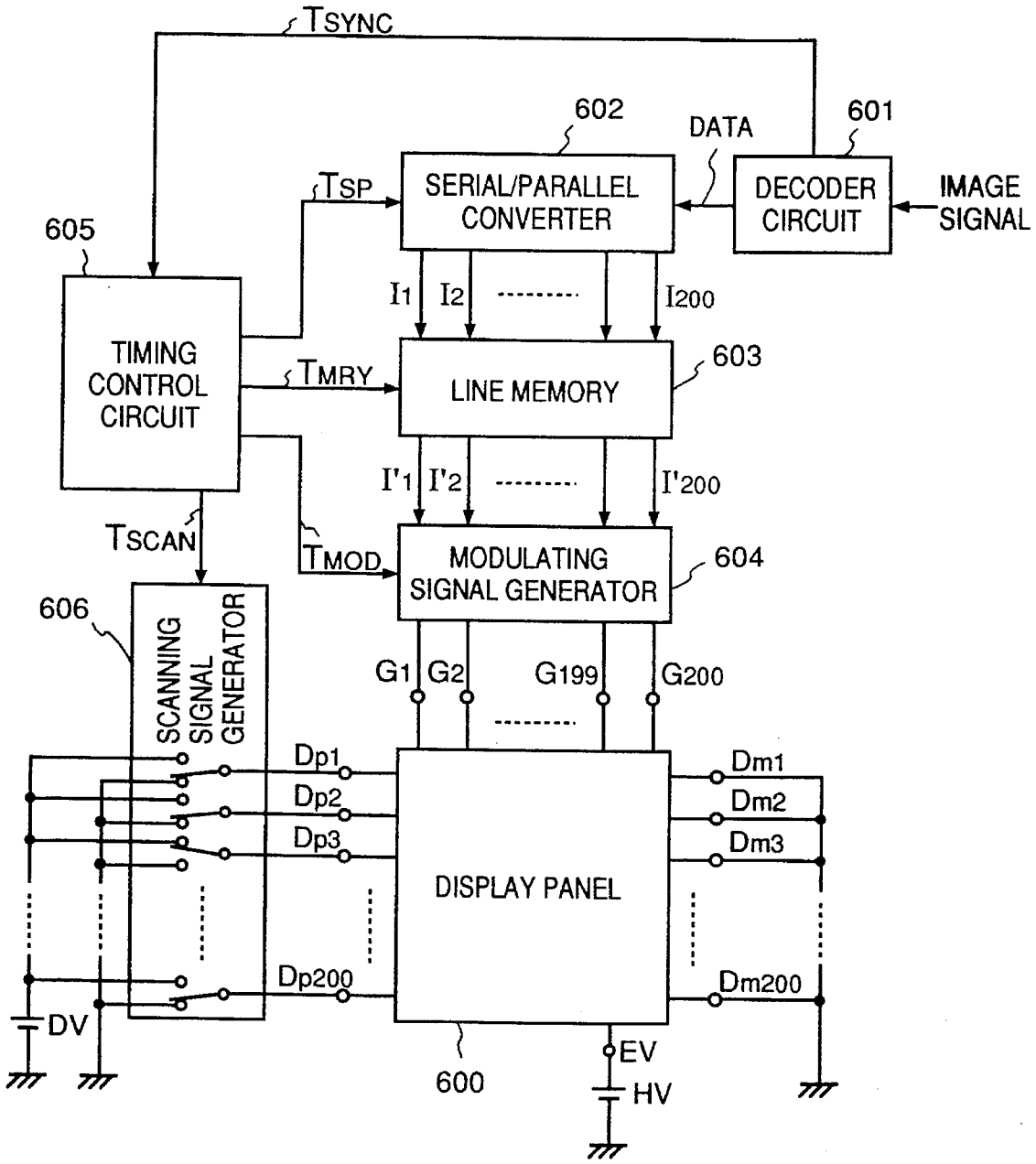
FIG. 53 is a block diagram showing the construction of an image forming apparatus according to the invention.

FIG. 53 is a block diagram illustrating an electric circuit for driving the display panel of FIG. 21. Shown in FIG. 53 are the display panel of FIG. 21, indicated at number 600, a decoding circuit 601 for decoding a composite image signal that enters from the outside, a serial/parallel converting circuit 602, a line memory 603, a modulating signal generating circuit 604, a timing control circuit 605 and a scanning signal generating circuit 606. The electrode terminals of the display panel 600 are connected to various electric circuits. The terminal EV is connected to a high-voltage source HV that generates an accelerating voltage of 10 kV, terminals $G_1$~$G_{200}$ are connected to the modulating signal generating circuit 604, terminals $D_{p1}$~$D_{p200}$ are connected to the scanning signal generating circuit 106, and terminals $D_{m1}$~$D_{m200}$ are connected to ground.

The functions of these components will now be described. The decoding circuit 601 is for decoding a composite image signal, such as an NTSC television signal, that enters from the outside. The decoding circuit 601 separates the composite image signal into a luminance signal component and a synchronizing signal component, outputs the former to the serial/parallel converting circuit 602 as a data signal Data and outputs the latter to the timing control circuit 605 as a synchronizing signal TSYNC. More specifically, the decoding circuit 601 arrays the luminance of each of the R, G, B color components in conformity with the color-pixel array of the display panel 600 and successively outputs the result-to the serial/parallel converting circuit 602. Further, the decoding circuit 601 extracts a vertical synchronizing signal and a horizontal synchronizing signal and outputs these signals to the timing control circuit 605. Using the synchronizing signal $T_{SYNC}$ as a reference, the timing control circuit 605 generates various timing control signals to coordinate the operating timing of each component. In other words, the timing control circuit 605 outputs timing control signals $T_{Sp}$, $T_{MRY}$, $T_{MOD}$ and $T_{SCAN}$ to the serial/parallel converting circuit 602, the line memory 603, the modulating signal generating circuit 604 and the scanning signal generating circuit 606, respectively.

The serial/parallel converting circuit 602 successively samples the luminance signal Data, which enters from the decoding circuit 601, based upon the timing signal $T_{Sp}$ entering from the timing control circuit 605, and outputs the result to the line memory 603 as 200 parallel signals $I_1$~$I_{200}$. The timing control circuit 605 outputs the write timing control signal $T_{MRY}$ to the line memory 605 at the moment one line of data of the image is converted from serial to parallel data. Upon receiving the signal $T_{MRY}$, the line memory 603 stores the contents of the signals $I_1$~$I_{200}$ and outputs this to the modulating signal generating circuit 604 as $I'_1$~$I'_{200}$. However, $I'_1$~$I'_{200}$ is held in the line memory 603 until the next write timing signals $T_{MRY}$ enters.

On the basis of the luminance data of one line of the image that enters from the line memory 603, the modulating signal generating circuit 604 generates a modulating signal that is applied to the grid electrodes of the display panel 600. Specifically, the modulating signal generating circuit 604 applies modulating signals to the terminals $G_1$~$G_{200}$ simultaneously in conformity with the timing control signal TMOD generated by the timing control circuit 605. The modulating signals employ a voltage modulation method for changing the magnitude of voltage in dependence upon the luminance data of the image. However, it is possible to employ a pulse-width modulation method for modulating the width of voltage pulses in dependence upon the luminance data.

The scanning signal generating circuit 606 generates voltage pulses for suitably driving device rows of the surface-conduction electron-emitting devices constituting the display panel 600. A switching circuit within the scanning signal generating circuit 606 is changed over in accordance with the timing control signal $T_{SCAN}$ generated by the timing control circuit 605, thereby selecting either a suitable driving voltage VE [V], which is generated by a constant-voltage source DV and exceeds a threshold value of the surface-conduction electron-emitting devices, or the ground level (i.e., 0 v) and applying the selected potential to the terminals $D_{p1}$~$D_{p200}$.

By virtue of the circuitry described above, drive signals are applied to the display panel 600 at a specific timing. That is, the voltage pulses of amplitude VE [V] are applied to the terminals $D_{p1}$, $D_{p2}$, $D_{p3}$ successively in the order mentioned at the display time of each line of the image. On the other hand, the ground level of 0 V is connected to the terminals $D_{m1}$~$D_{m200}$ at all times. Therefore, the device rows are successively driven by the voltage pulses starting from the first row. The driven devices emit electron beams.

Further, in synchronism with the foregoing, the modulating signal generating circuit 604 applies modulating signals of one line of the image to the terminals $G_1$~$G_{200}$ simultaneously. The modulating signals are changed over successively in synchronism with the changeover of the scanning signals to display one screen of the image. By continuously repeating this operation, it is possible to display a moving television picture.

In the image forming apparatus fabricated according to this Example as well, it was confirmed that the device characteristics were uniform and that luminance irregularity of the displayed image was less than 5% owing to the fact that a number of surface-conduction electron-emitting devices wired in the form of a parallel ladder could be formed uniformly.

EXAMPLE 10

According to this example, a plurality of the needle-shaped copper terminals, which constitute the electrical connecting means described in Example 8, are joined transversely to form a unitary body.

Figure 36:
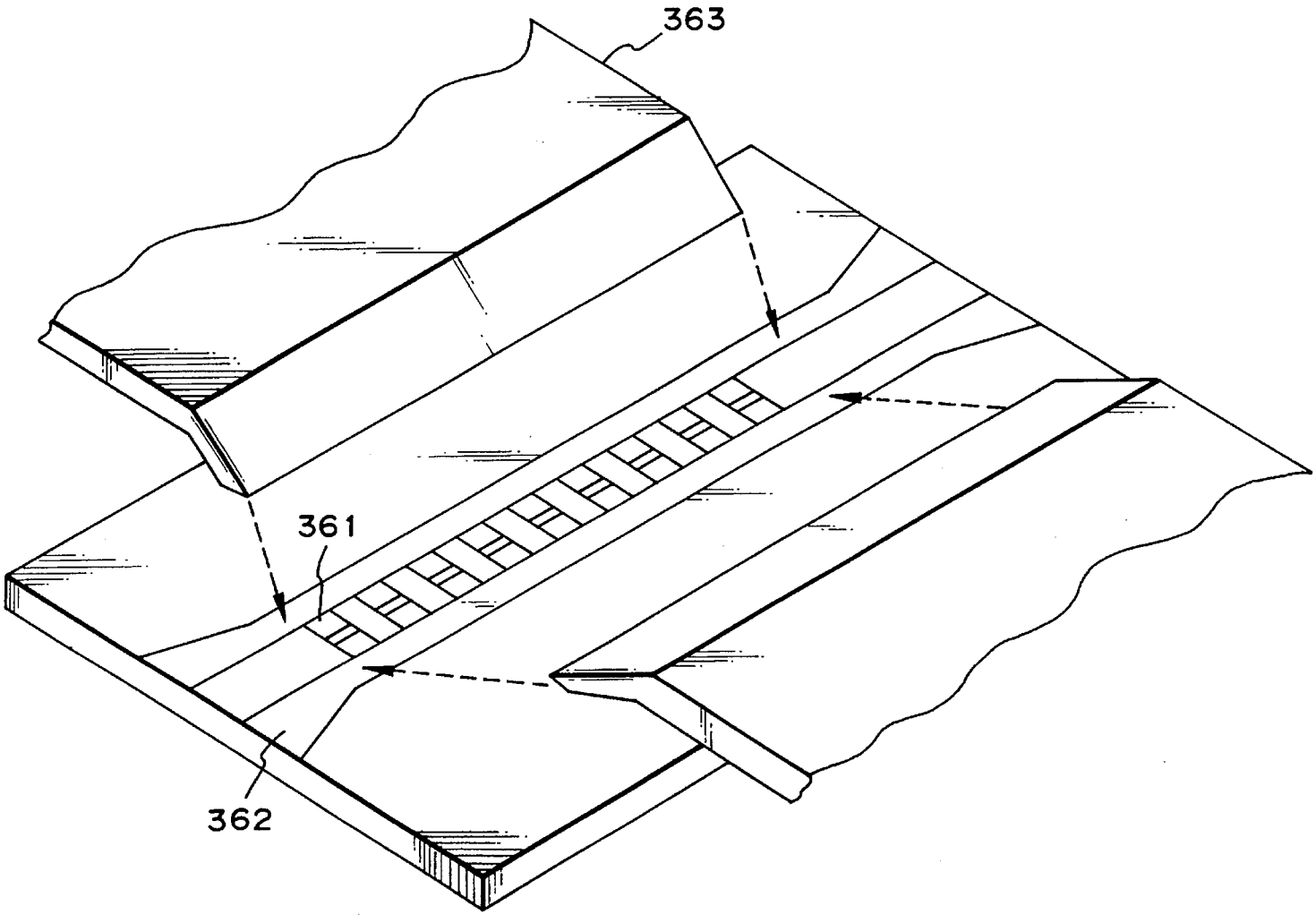
FIG. 36 is a perspective view for describing another example of the supplying of current at the time of forming.

FIG. 36 is a perspective view illustrating an electrical connecting portion for describing this Example. Numeral 361 denotes a surface-conduction electron-emitting device, 362 wiring and 363 a contact terminal for making electrical connection. The latter consists of copper, as in Example 8. As will be understood from FIG. 36, the contact terminals, which were needle-shaped in Example 8, here are joined transversely to form a knife edge. Consequently, the resistance present between electrical connecting terminals becomes substantially zero since they are joined by bulk metal. Furthermore, the wiring resistance between terminals becomes negligible. This means that it is possible to reduce even further the variance in the forming voltage applied to the devices at the time of the electrification process. In a case where an electron-source substrate the same as that used in Example 8 is subjected to forming using the above-mentioned electrical connecting means, the variance in voltage applied to each device at the time of forming was 0.001 V in Example 8. In this example, however, the variance is less than 0.0001 V. As a result, it was confirmed that the variance in electron emission efficiency (0.05%) between devices was held to less than 5% as an actual device characteristic. Further, when the image forming apparatus is formed in the same manner as in Example 9, it was confirmed that the device characteristics were uniform and that luminance irregularity of the displayed image was less than 5% owing to the fact that a number of surface-conduction electron-emitting devices could be formed uniformly.

EXAMPLE 11

Examples 8 and 10 relate to the forming of a multiple electron source composed of surface-conduction electron-emitting devices arrayed in one transverse row. In this Example a case is described in which the aforementioned means B-1 is applied to a multiple electron source in which 100×100 devices are wired two-dimensionally in the form of a simple matrix.

Figure 37A:
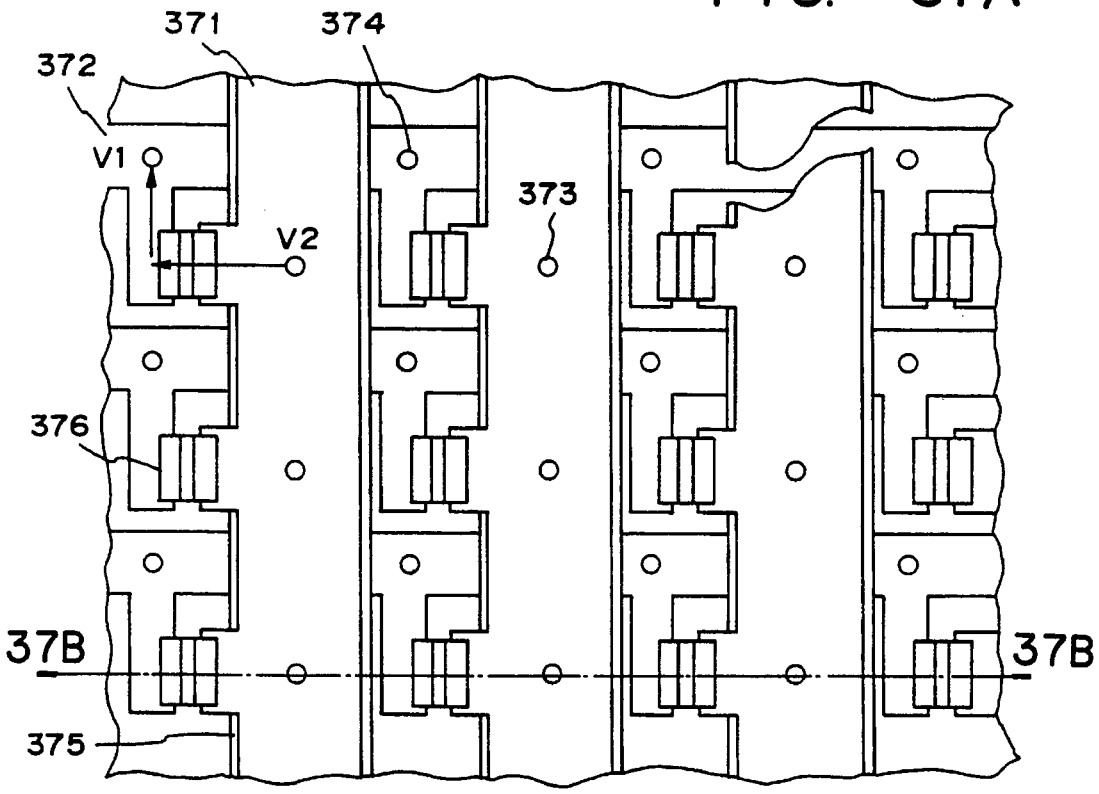
FIGS. 37A~37C are diagrams for describing a process through which forming is carried out in this embodiment.
Figure 37B:
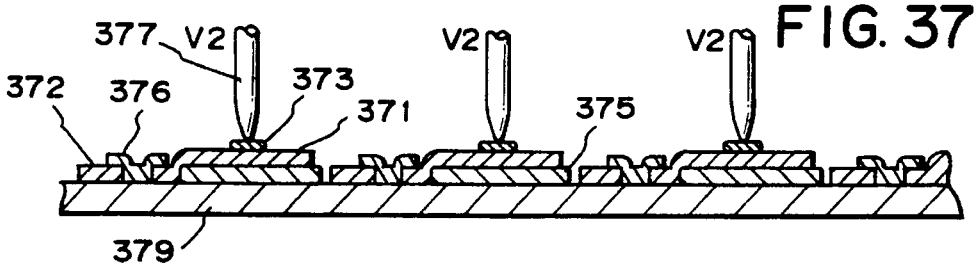
Figure 37C:
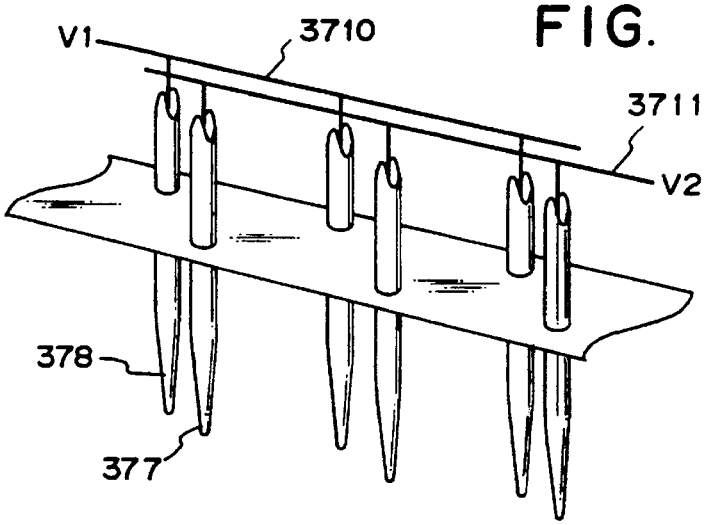

Reference will be had to FIGS. 37A, 37B, 37C to describe a process in which the wiring arrangement and the surface-conduction electron-emitting devices constituting the electron sources are formed in the same manner as set forth in Example 1, and forming is carried out by connecting electrical contact means to an electron-source substrate on which a plurality of surface-conduction electron-emitting devices are arrayed.

As shown in FIG. 37C, electrical connecting means 377, 378 (needle-shaped connecting portions referred to as probes) are arranged in two rows in staggered fashion. The probes are connected to the devices at a ratio of one set per device, and respective probes are connected by low-resistance wires 3710, 3711 to the vicinity of both ends of surface-conduction electron-emitting devices, which are connected in a certain row, so that potentials V1, V2 will be applied to the devices. Each probe is a spring pin made of tungsten the contact resistance of which is less than 0.1Ω when the pin is pressed to apply a load of several tens of grams. In order to reduce contact resistance even further, in this Example the tip of each spring pin and a portion 373 on the wiring contacted by the probe were coated with a low-resistance metal, which is Au in this Example. As a result, contact resistance was made less than 0.01Ω.

These probes are connected to a power supply for generating forming pulses. The forming pulses have the waveform shown in FIG. 8, where T1 was set to 1 msec, T2 to 10 msec and the-peak voltage to 4 V. Upon completion of the forming of one line, the line to which the probes are connected is changed. This process is repeated to carry out forming successively until all of the surface-conduction electron-emitting devices are formed.

Upon applying a forming voltage using the forming apparatus of the invention, it was found that variance in the voltage at the contact portions of the spring pins was held to less than 0.01 V, and that the variance in electron emitting efficiency (0.05%) between devices was held to less than 5% as an device characteristic.

In this Example, one set of probes was connected to one surface-conduction electron-emitting device. However, upon taking into consideration the wiring resistance and the device resistance, the same effects can be obtained even if one set of probes is connected to several devices at a time.

Further, the probe was brought into contact with exposed portion of the wiring surface in this Example. However, in a case where the wiring surface is not exposed, such as when it has been covered by an insulating layer, the same effects can be obtained by fabricating a substrate from which the insulating layer at the probe-contact portion has been removed and carrying out forming in the same manner as in this Example.

EXAMPLE 12

An example of an image forming apparatus constructed using the electron-source substrate, which has not been subjected to the forming treatment, fabricated according to Example 11 will now be described with reference to FIG. 24.

First, a forming treatment similar to that of Example 11 was performed in air or in a nitrogen environment, and the substrate was fixed to the rear plate 241.

Thereafter, an image forming apparatus was fabricated through an arrangement and method similar to those of Example 2. In the image forming apparatus thus completed, scanning signals and modulating signals were applied by signal generating means (not shown) to each of the-surface-conduction electron-emitting devices through the external terminals $D_{x1}$~$D_{xm}$, $D_{y1}$~$D_{yn}$, and a high voltage of 5 kV was applied through the high-voltage terminal Hv to display an image.

In the image forming apparatus fabricated according to this Example as well, it was confirmed that the device characteristics were uniform and that luminance irregularity of the displayed image was less than 5% owing to the fact that a number of surface-conduction electron-emitting devices wired in the form of a simple matrix could be formed uniformly.

EXAMPLE 13

Figure 38:
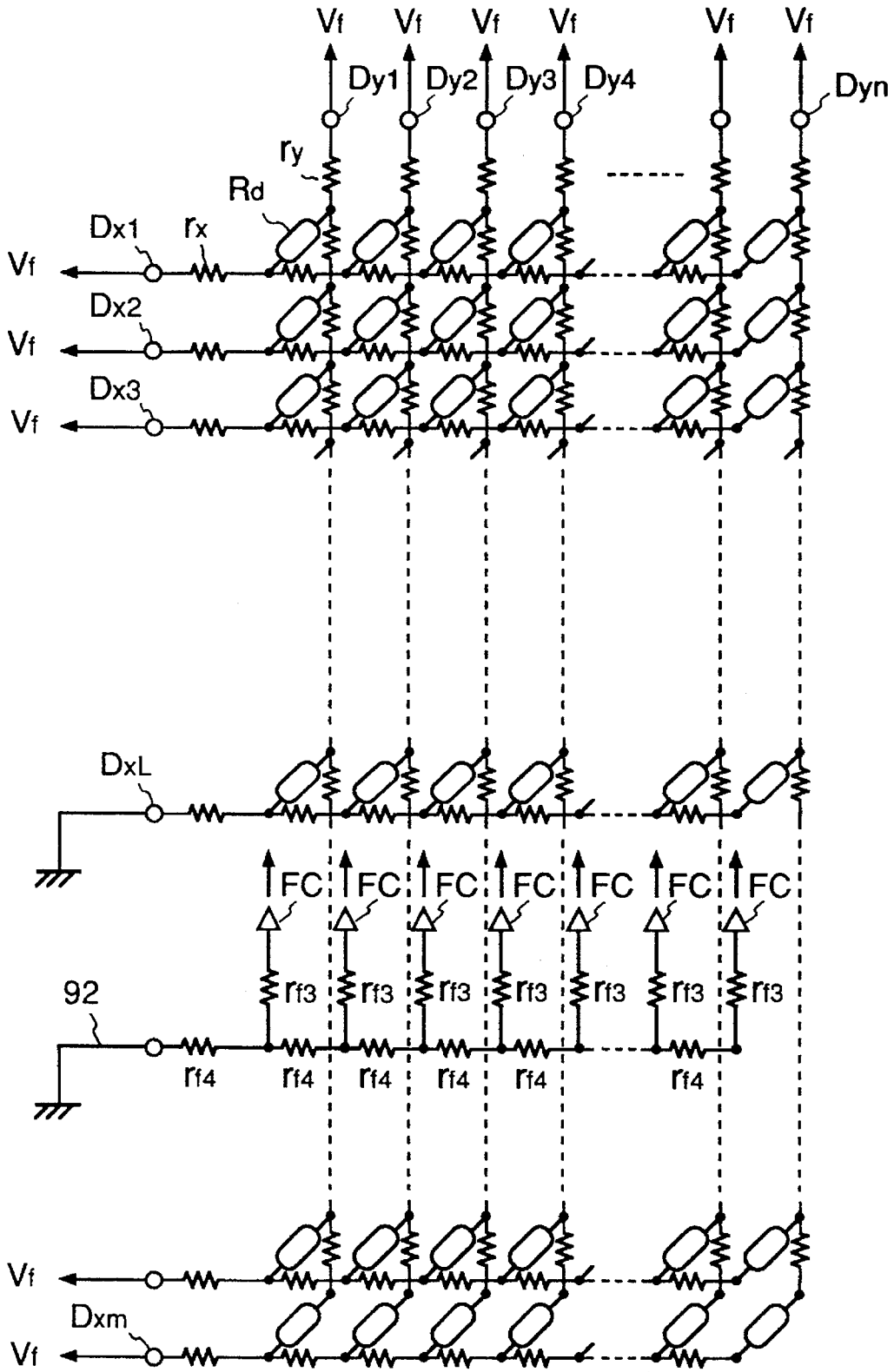
FIG. 38 is an equivalent circuit for describing a process through which forming is carried out in this embodiment.

This Example also relates to a case in which the means B-1 is applied to an electron source in which surface-conduction electron-emitting devices are arranged in the form of a simple matrix. This is a forming method in which electrical connecting means is provided for rows only or columns only. Reference will be had to FIG. 38 to describe a process in which a wiring arrangement and an electron-source substrate, which is equipped with a plurality of devices before not yet subjected to the forming treatment, are formed in the same manner as described in Example 1, and forming is carried out by connecting current injecting terminals to the electron-source substrate.

In Example 8, the surface-conduction electron-emitting devices were electrified by two sets of electrical connecting means. In this Example, however, forming was carried out by selecting devices of one horizontal row as in Example 1. More specifically, the end of the common wiring of one selected row (the $D_{xL}$ line in FIG. 38) was grounded, electrical connecting means similar to that of Example 8 was connected to the portion of this wiring to which each selected device is connected, and this means also was grounded. Further, the wiring of each column wire ($D_{y1}$~$D_{yn}$ in FIG. 38) and the row wiring other than that of the $D_{xL}$ line (namely $D_{x1}$~$D_{xm}$ with the exception of $D_{xL}$) was connected to a forming power supply having a potential Vf. Since the voltage Vf is applied in parallel at the same parallel resistance to each individual device on the anode side, variance in the forming voltage is sufficiently suppressed even though the electrical connecting means of the invention is provided on the ground side. All of the devices can be subjected to forming by successively changing the lines selected.

Upon applying the electric forming treatment according to the above-described method to an electron-source substrate in which m, n were each set at 1000, it was found that variance in the voltage at the contact portions of the spring pins was held to less than 0.01 V, and that the variance in electron emission efficiency (0.05%) between devices was held to less than 5% as an actual device characteristic.

Further, with respect to the image forming apparatus fabricated in the same manner as described in Example 12, using the electron-source substrate fabricated according to this Example, a number of surface-conduction electron-emitting devices wired in the form of a simple matrix could be formed uniformly. As a result, it was confirmed that the device characteristics were uniform and that the luminance irregularity of the displayed image was less than 5%.

Though the electrical connecting means was provided for each selected device at a ratio of 1:1 in this Example, it is possible to improve upon the variance in applied voltage even in a case where the connection point of the electrical connecting means is one point. For example, the variance in the electron emission efficiency between the fabricated devices could be held to less than 10% even in a case where the forming treatment was carried out by grounding both ends of the row wire $D_{xL}$ in FIG. 38 and connecting the electrical contact means solely to the central portion of this wire.

EXAMPLE 14

This Example relates to an arrangement in which the final stage of the copper terminals serving as the electrical connecting means described in Example 8 is provided with a portion having a high thermal capacity to embrace a heating/cooling apparatus.

Figure 39:
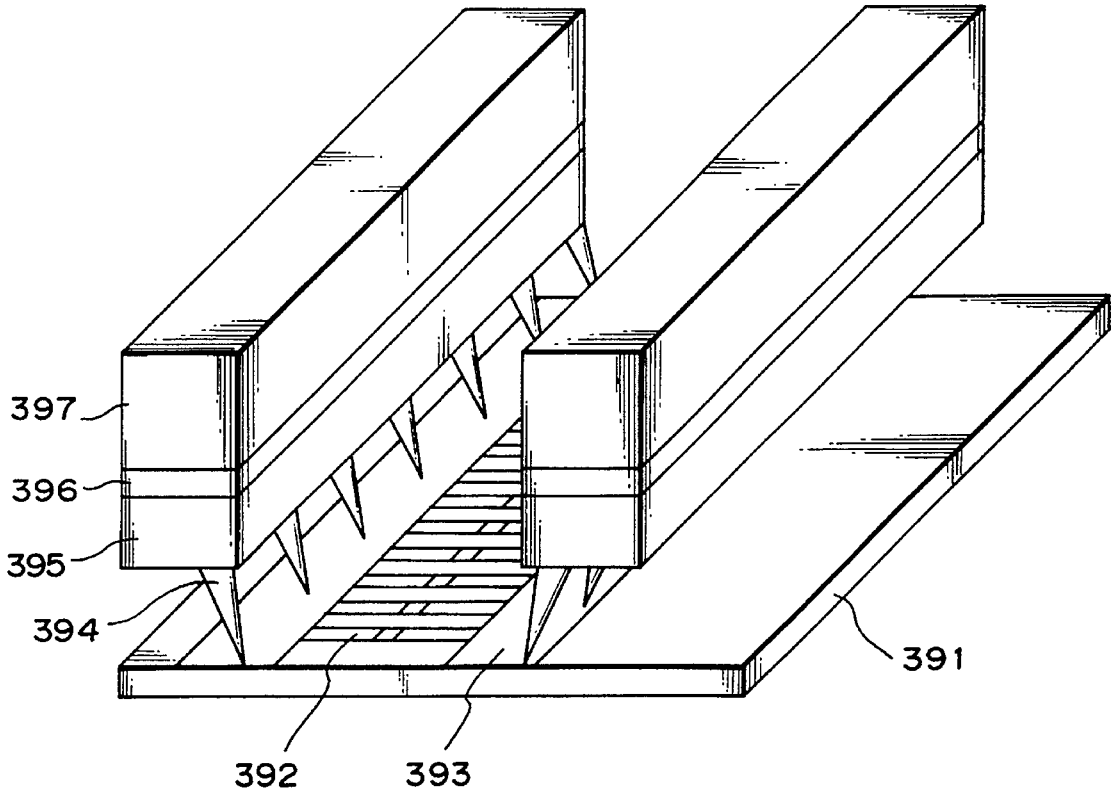
FIG. 39 is a perspective view showing electrical connections for forming according to another embodiment.
Figure 40:
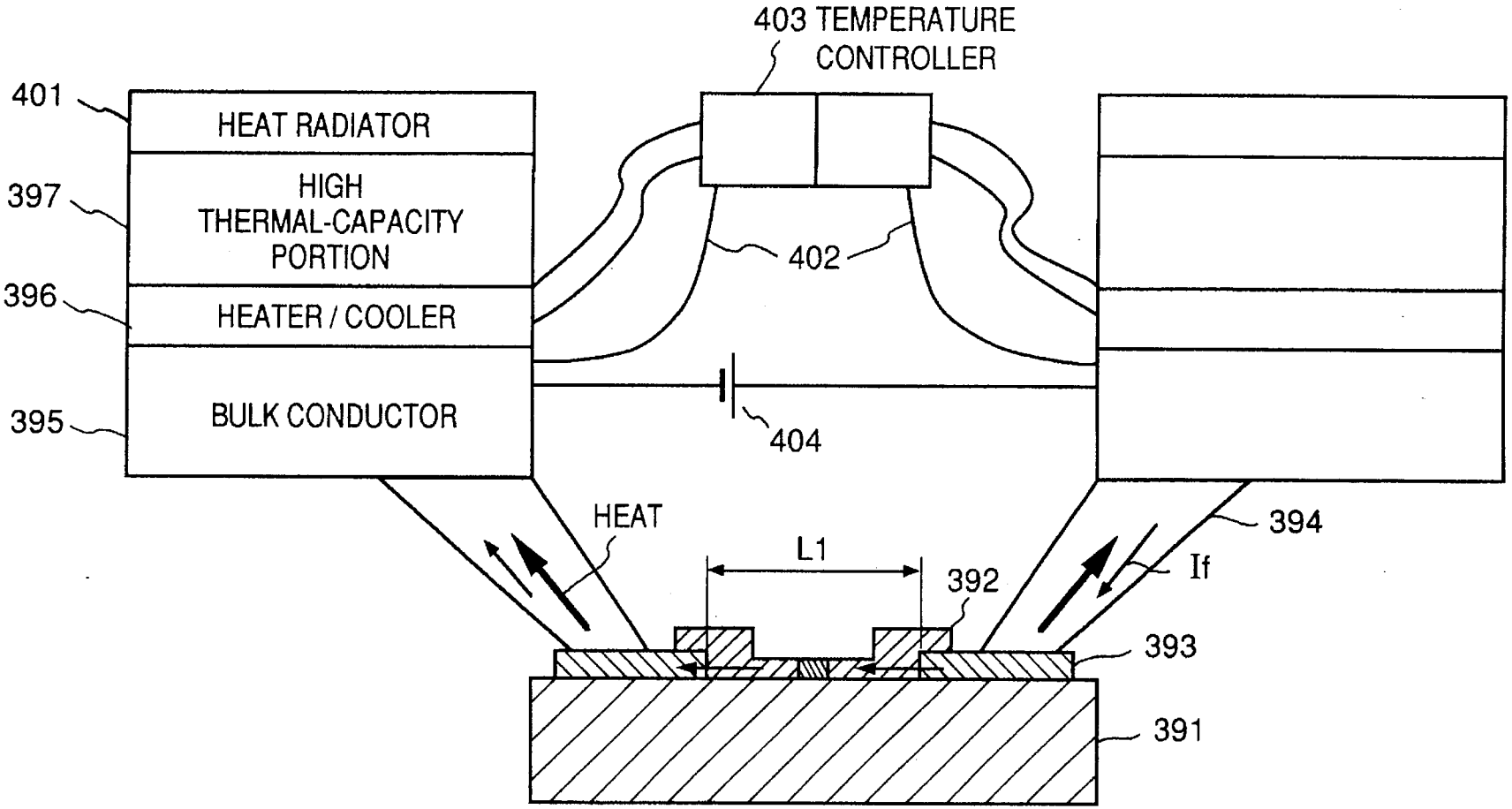
FIG. 40 is a block diagram showing the principal features of the apparatus shown in FIG. 39.

FIG. 39 is a perspective view of an apparatus for describing this Example, and FIG. 40 is a block diagram for describing the general features of the apparatus. Numeral 391 denotes a glass substrate and 392 a film of fine particles constructing surface-conduction electron-emitting devices fabricated through a process similar to that of Example 8. The electrode gap L1 is 20 μm, and 1000 of the devices are formed in one row. Numeral 393 denotes an Ni electrode pattern for commonly passing a current through a plurality of the surface-conduction electron-emitting devices, and numeral 394 denotes a needle-shaped copper terminal serving as an electric contact terminal that applies the forming voltage. Here 332 sets of the copper terminals are arrayed for every three devices.

Numeral 395 denotes a bulk conductor joined to the copper terminals 394 both electrically and thermally. Here a copper bar having a cross section of 5 mm×20 mm is used. Numeral 396 designates a Peltier device serving as a heating/cooling apparatus, and 397 a copper bar, which has a cross section of 20 mm×20 mm, serving as a conductor of a high thermal capacity. Numeral 401 denotes a heat radiator, 402 a detector (here a thermocouple is used) for detecting the temperature of the bulk conductor 395, 403 a temperature controller for driving the heading/cooling apparatus and 404 a forming power supply.

In the arrangement described above, the copper terminals 394 are contact-bonded to the common wiring 393 and a voltage necessary for the electric forming of devices is applied to the common wiring 393 from the forming power supply 404 to form fissures that become electron emission portions.

At this time the resistance of the copper bar 395 between devices becomes less than 1/1000 that of the common wiring 393, as a result of which the variance in forming voltage applied to the devices vanishes in the same manner as described in Example 8.

Further, since the thermal capacity of the copper bar is very much larger than that of the common wiring 393, the temperature at the portions of contact between the common wiring and the copper terminals remains constant at all times. Even if the devices are heated by Joule heat resulting from electric forming, monitoring is performed by the thermocouple 402 and the Peltier device 396 is controlled by the temperature controller 403 to cool the copper bar 395, whereby it is possible to hold the multiple electron source at a substantially constant temperature. Furthermore, since the temperature of the electrodes is held low at all times without variance between devices the temperature profile of the film 392 of fine particles becomes steep and a temperature peak is obtained. As a result, the region at which thermal breakdown occurs is narrowed and the relative position of this region between devices is rendered constant. Consequently, variance in the position and shape of the fissure is kept small.

In a case where forming voltage was applied to an electron-source substrate similar to that of Example 8 suing the forming apparatus of this Example, variance in voltage at the contact portion of the copper terminal 394 was held to less than 0.01 V and the variance in the temperature of each device also was held to less than 1° C. Despite the fact that the interelectrode gap L1 was widened to 20 μm, the variance in electron emission efficiency between terminals was held to less than 5% as an actual device characteristic.

Further, in the image forming apparatus fabricated in the same manner as described in Example 12 using the electron-source substrate fabricated according to this Example, a number of surface-conduction electron-emitting devices could be formed uniformly. As a result, it was confirmed that the device characteristics were uniform and that the luminance irregularity of the displayed image was less than 5%.

EXAMPLE 15

This Example relates to an apparatus for actually implementing means B-1.

Figure 41:
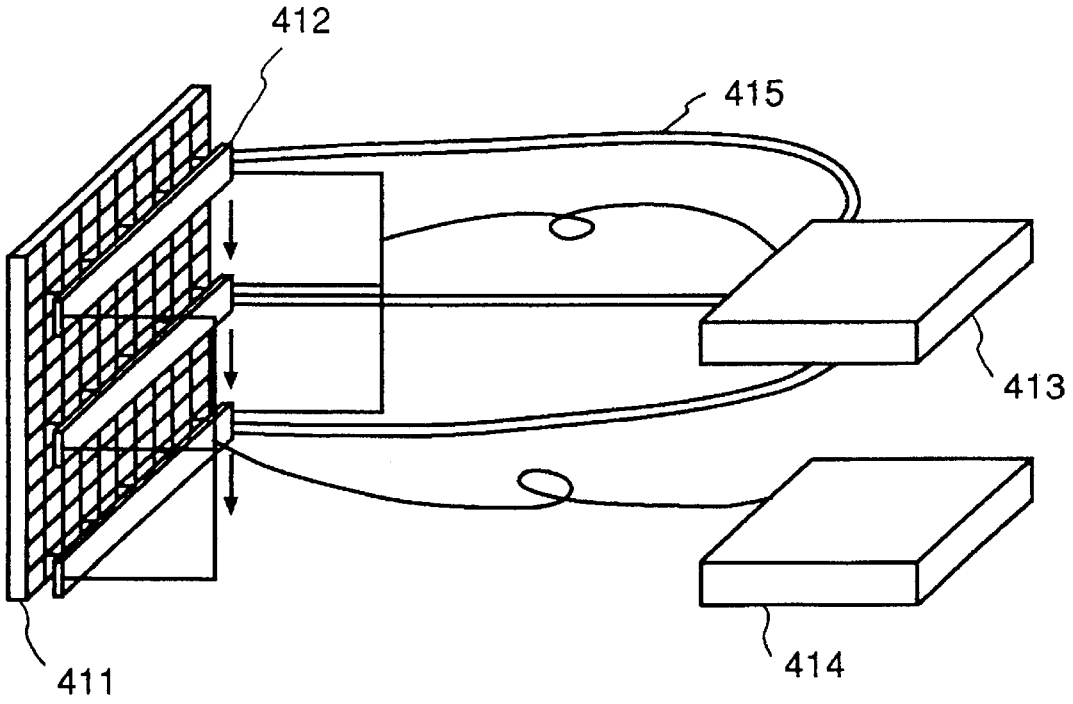
FIG. 41 is a diagram showing the connection of an apparatus for forming according to another embodiment.

Here an electron-source substrate, on which a wiring arrangement and surface-conduction electron-emitting devices, to which the forming treatment has not yet been applied, are formed in the same manner as in Example 1, is provided with electrical contact means, in which a plurality of the electrical contact means are provided on one wire on which devices are arrayed in one row. Forming is carried out using this arrangement. With regard to one horizontal row having 300 of these devices, forming can be carried out by the above-described apparatus. However, in a case where 200 rows of the devices are arrayed in the vertical direction, as in this Example, the process requires too much time if this operation is repeated one row at a time. This is inconvenient in terms of mass production. Accordingly, a plurality of the above-described forming mechanisms are prepared, these are arranged in parallel and driven simultaneously to shorten process time. FIG. 41 is a perspective view showing the apparatus, in which numeral 411 denotes a multiple electron source whose devices are arranged in the form of a simple matrix array, 412 a forming mechanism in which three of the aforesaid electrical connecting means are arranged in parallel, 413 a temperature controller, and 414 a forming power supply. Though the arrangement of FIG. 41 has three of the electrical connecting means, the number can be selected suitably depending upon space on the substrate and the allowable current capacity of the forming power supply. The greater the number of electrical connecting means, the more the time required for the process is shortened.

When the forming operation described in Example 12 was carried out, variance in the electron emission efficiency of each surface-conduction electron-emitting device was held to less than 5% and forming was carried out in one third the time in comparison with the case in which forming was performed repeatedly one row at a time.

Though an arrangement having three electrical connecting means is shown in FIG. 41, the number can be selected suitably depending upon space on the multiple electron source and the allowable current capacity of the forming power supply. The greater the number of electrical connecting means, the more the time required for the process is shortened.

Examples 8 through 15 relate to a multiple electron source arrayed in one row or a multiple electron source arrayed two-dimensionally in the form of a simple matrix. However, the electrification method of the invention using the electrical connecting means can be used in a similar manner with regard to other ordinary wiring patterns.

EXAMPLE 16

An example based upon means B-2 of the invention will now be described.

Here a simple matrix-wired pattern is fabricated through a procedure similar to that of steps (a)~(e) of Example 1 described above. However, parts of the row wiring are provided with gaps 423, as shown in FIG. 42.

A process for connecting the gaps 423 by high-impedance wiring 424 will be described with reference to FIGS. 43A~43D.

Figure 42:
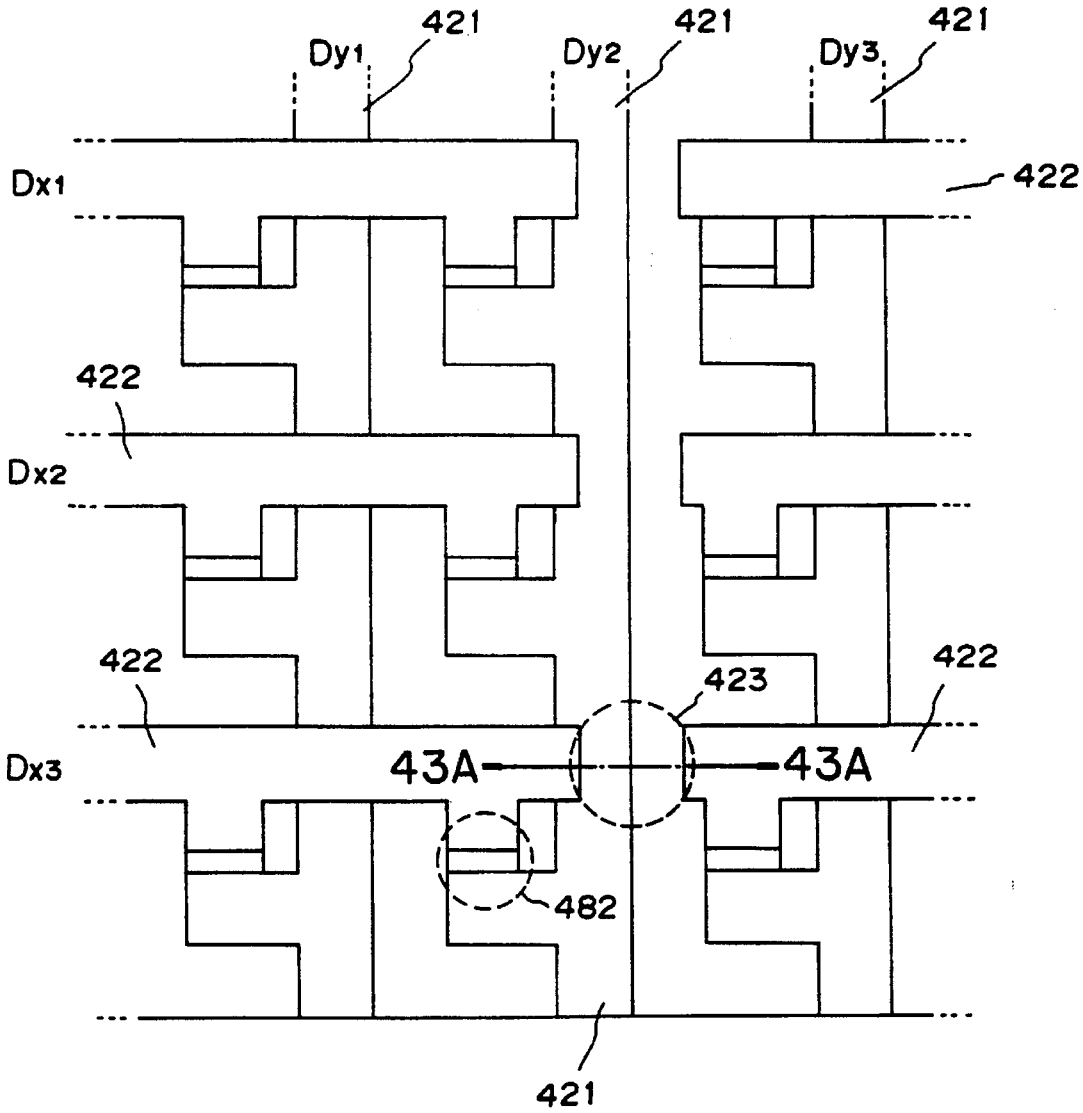
FIG. 42 is a partial plan view of electron sources arrayed in a matrix according to another embodiment.
Figure 43A:
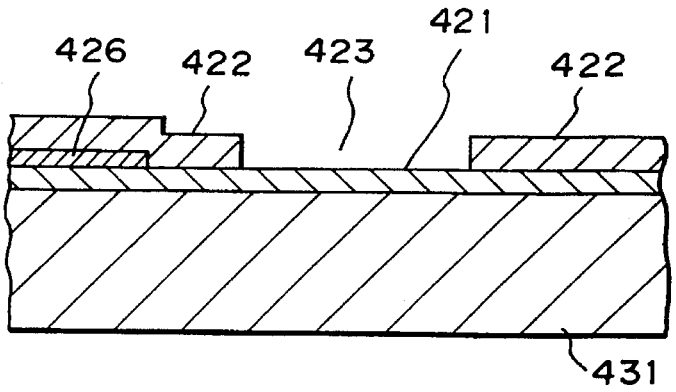
FIGS. 43A~43D are diagrams for describing a process through which gaps are connected by high-impedance wiring.
Figure 43B:
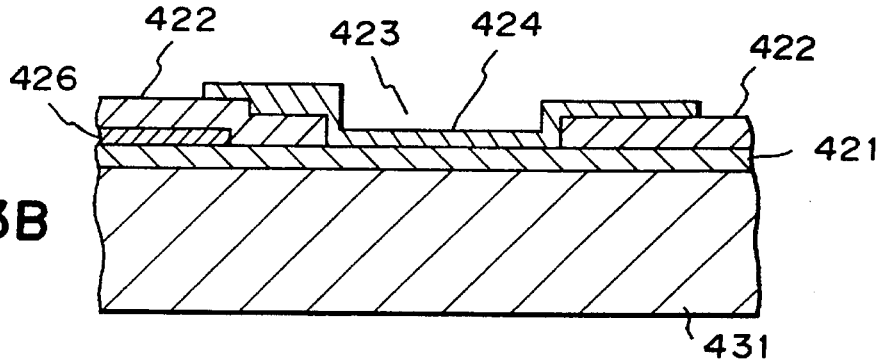
Figure 43C:
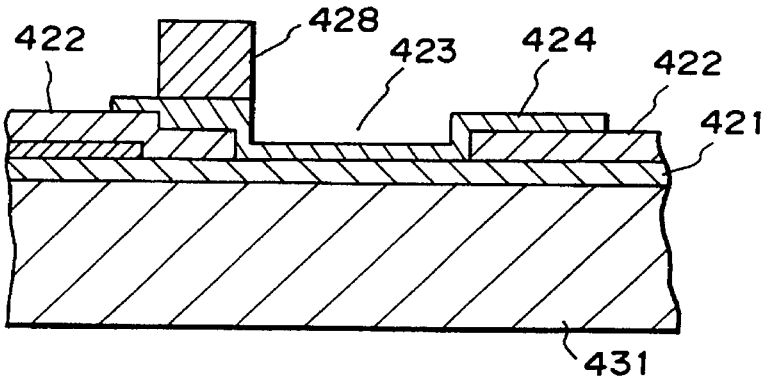
Figure 43D:
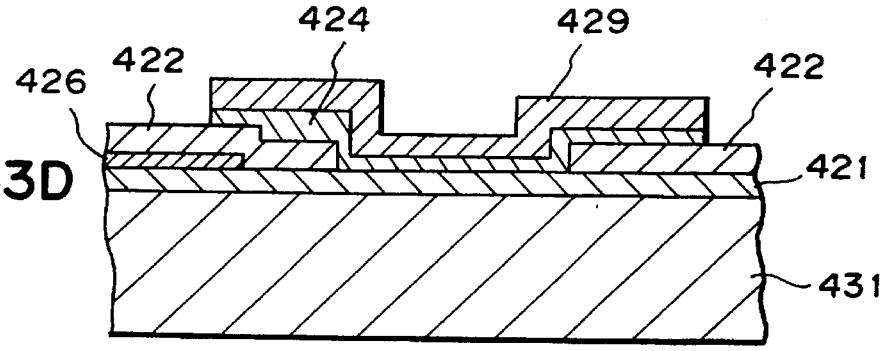
Figure 44:
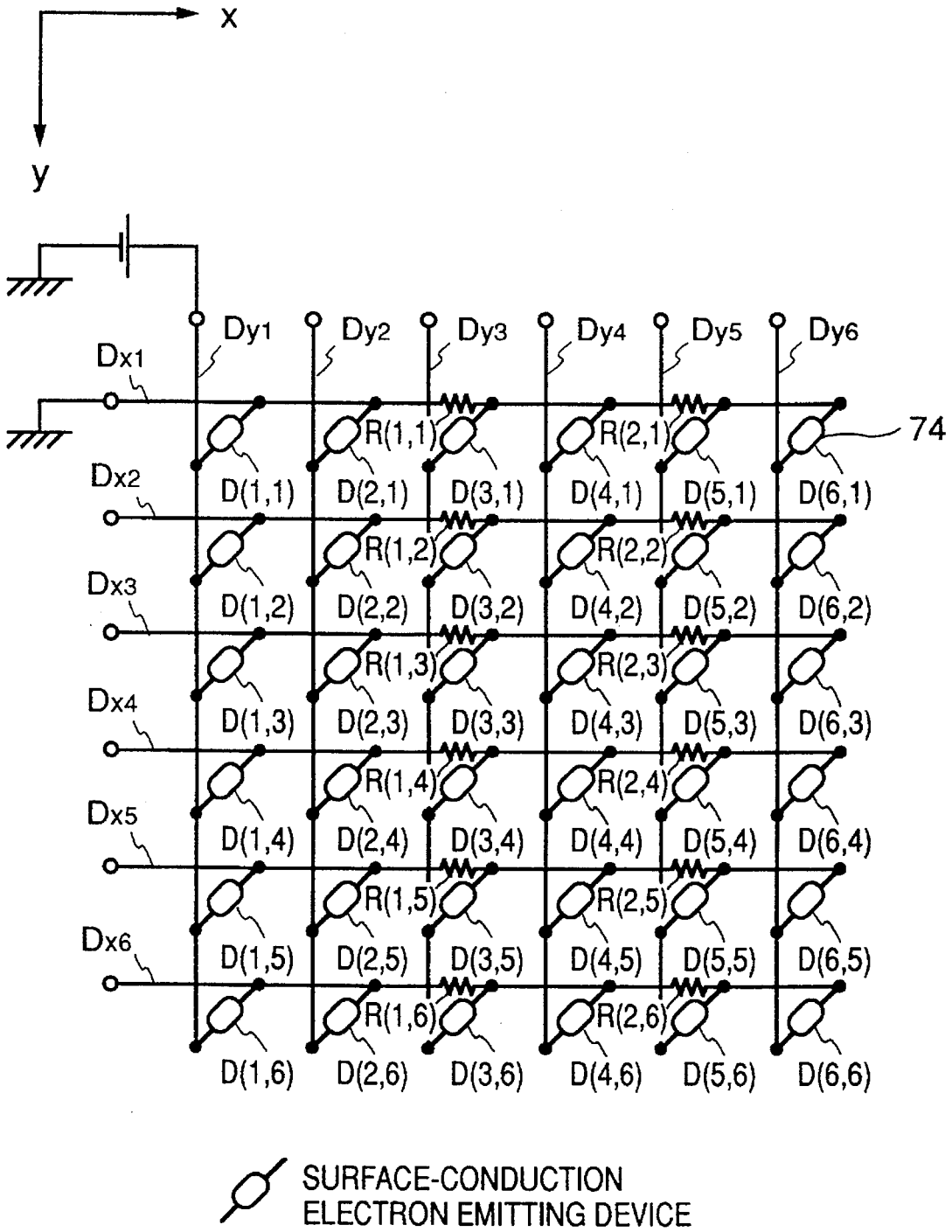
FIG. 44 is a diagram for describing forming treatment of simple matrix wiring.

FIG. 43A is a sectional view taken along line A–A' of FIG. 42. Next, a nickel-chrome alloy is vacuum-deposited to a thickness of about 2000 A using the sputtering method, patterning is carried out by lithography and a high-impedance portion 424 is provided on the gap 423 [see FIG. 43B]. Next, one side of the gap portion 423 is coated with gold-silver paste 428 using a micro-dispenser [FIG. 43C]. FIG. 44 shows the relevant circuit diagram in simple form. For the sake of simplicity, the electron source of this example comprises 6×6 devices. However, an actual electron source according to this Example is composed of 1000×1000 devices. Each wire of the X-direction lines $D_{x1}$~$D_{x1000}$ is provided with high-impedance portions (split portions) at 10 equally spaced locations (i.e., every 100 devices).

Next, an electron-source substrate, which has not been subjected to the forming treatment, is fabricated through a process similar to that of steps (f)~(h) in Example 1.

Next, devices situated on the side near the power supply portion relative to the high-impedance portions, namely devices D(1,1)~D(1,6) and D(2,1)~D(2,6), are formed device by device. The method of applying voltage at this time is as shown in FIG. 44. The latter shows the state in which voltage is impressed across $D_{x1}$ and $D_{y1}$ in order to carry out the forming of device D(1,1). The voltage applied has a pulsed waveform similar to that of Example 8 described earlier. As a result, at a forming voltage of 5 V, the current at such time is one-fourth of the current value that prevails when forming treatment is line forming, as examples.

Figure 45:
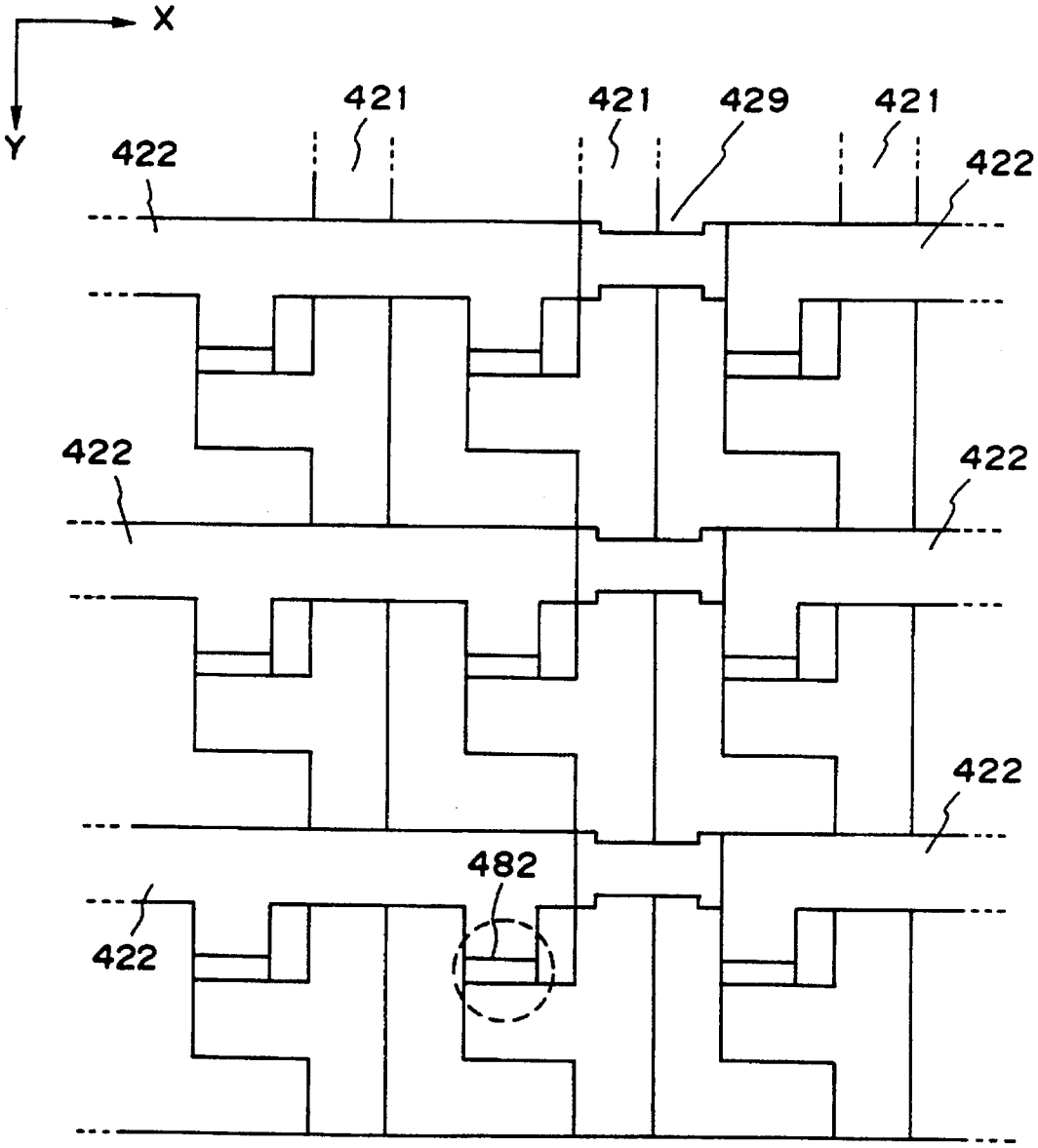
FIG. 45 is a partial plan view of electron sources arrayed in a matrix according to another embodiment.
Figure 46:
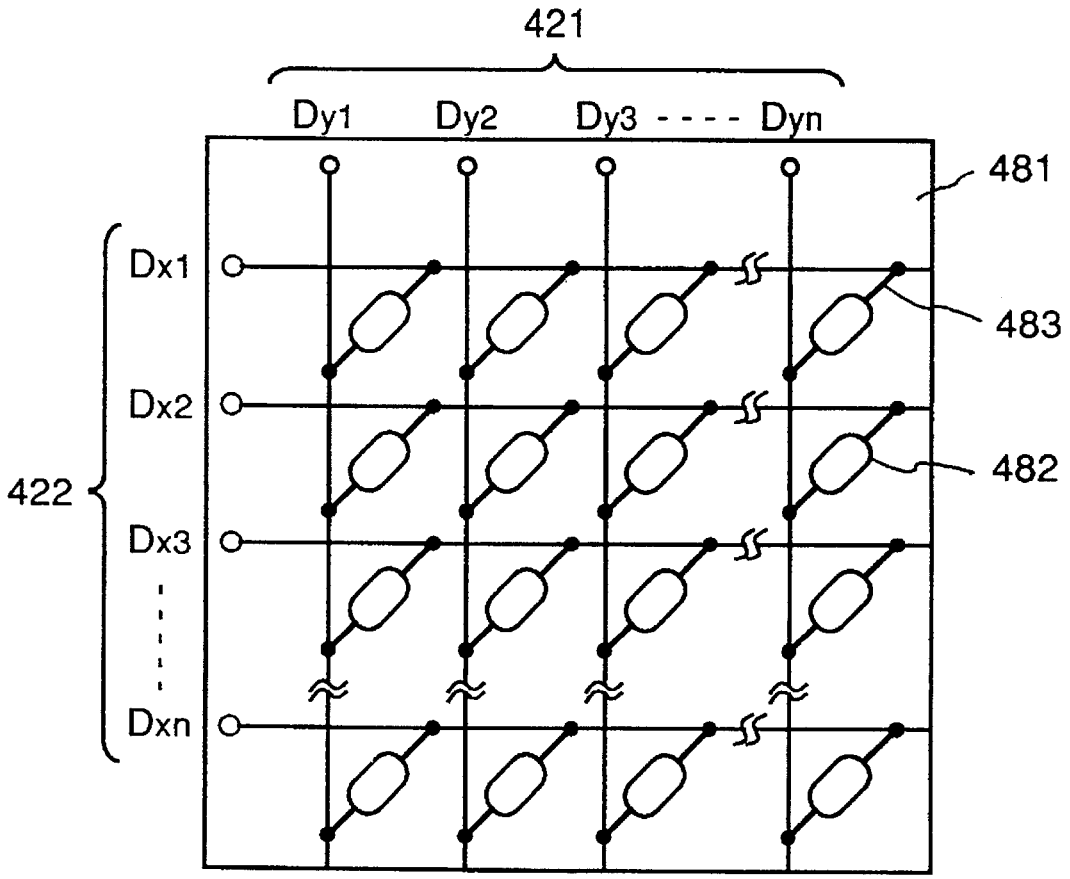
FIG. 46 is a diagram showing electron sources arrayed in the form of a simple matrix.

This is followed by applying laser light from the underside of the substrate to raise the temperature of the nickel-chrome thin film 424 at R(1,1)~R(1,6) and melt the paste 428. Numeral 429 illustrates the portion of the melted paste [see FIG. 45D]. By repeating the same process for the other gap portions as well, the split portions at R(1,1)~R(1,6), shown in FIG. 44, on each X-direction line are connected by low-resistance conductors. Thereafter, the forming treatment is performed in the same manner with regard to the next region, namely the devices at D(3,1)~D(3,6), D(4,1)~D(4,6). The split portions R(2,1)~R(2,6) are then made low-resistance portions. This is repeated to subject all devices to the forming treatment. As a result, there is obtained an electron source having surface-conduction electron-emitting devices 482 arrayed in the form of a simple matrix of the kind shown in FIG. 46.

The electron source thus created has its electron emission characteristic measured by the above-described apparatus. Variance in the electron emission efficiency $\eta$=Ie/If (%) was 0.05%. The variance of the efficiency was less than 7% for the overall panel. In this Example, a case is described in which forming is carried out device by device in the regions divided by the high-impedance portions. However, it is possible to select one line in the region and carry out line forming, as in Example 1. In such a case the variance in the electron emission efficiency was held to less than 5% for the substrate overall.

EXAMPLE 17

An example of an image forming apparatus constructed using the electron-source substrate, which has not been subjected to the forming treatment, fabricated according to Example 16 will now be described with reference to FIG. 24.

First, a forming treatment similar to that of Example 16 was performed in air or in a nitrogen environment, and the substrate was fixed to the rear plate 241 to fabricate the image forming apparatus.

In the image forming apparatus thus completed, scanning signals and modulating signals were applied by signal generating means (not shown) to each of the surface-conduction electron-emitting devices through the external terminals $D_{x1}$~$D_{xm}$, $D_{y1}$~$D_{yn}$, and a high voltage of 5 kV was applied through the high-voltage terminal Hv to display an image.

In the image forming apparatus fabricated according to this Example as well, it was confirmed that the device characteristics were uniform and that luminance irregularity of the displayed image was less than 3% owing to the fact that a number of surface-conduction electron-emitting devices wired in the form of a simple matrix could be formed uniformly.

In the Example described above, the image forming apparatus is fabricated by carrying out the forming treatment and then fixing the substrate to the rear plate. However, the variance in the device characteristics was held to less than 5% as in the previous Example even by constructing the image forming apparatus using an electron-source substrate not yet subjected to the forming treatment, then carrying out forming by supplying current through the external terminals $D_{x1}$~$D_{xm}$, $D_{y1}$~$D_{yn}$ and making the change from the high-impedance portions to the low-resistance portions by applying heating through the rear plate using laser light.

EXAMPLE 18

Figure 47:
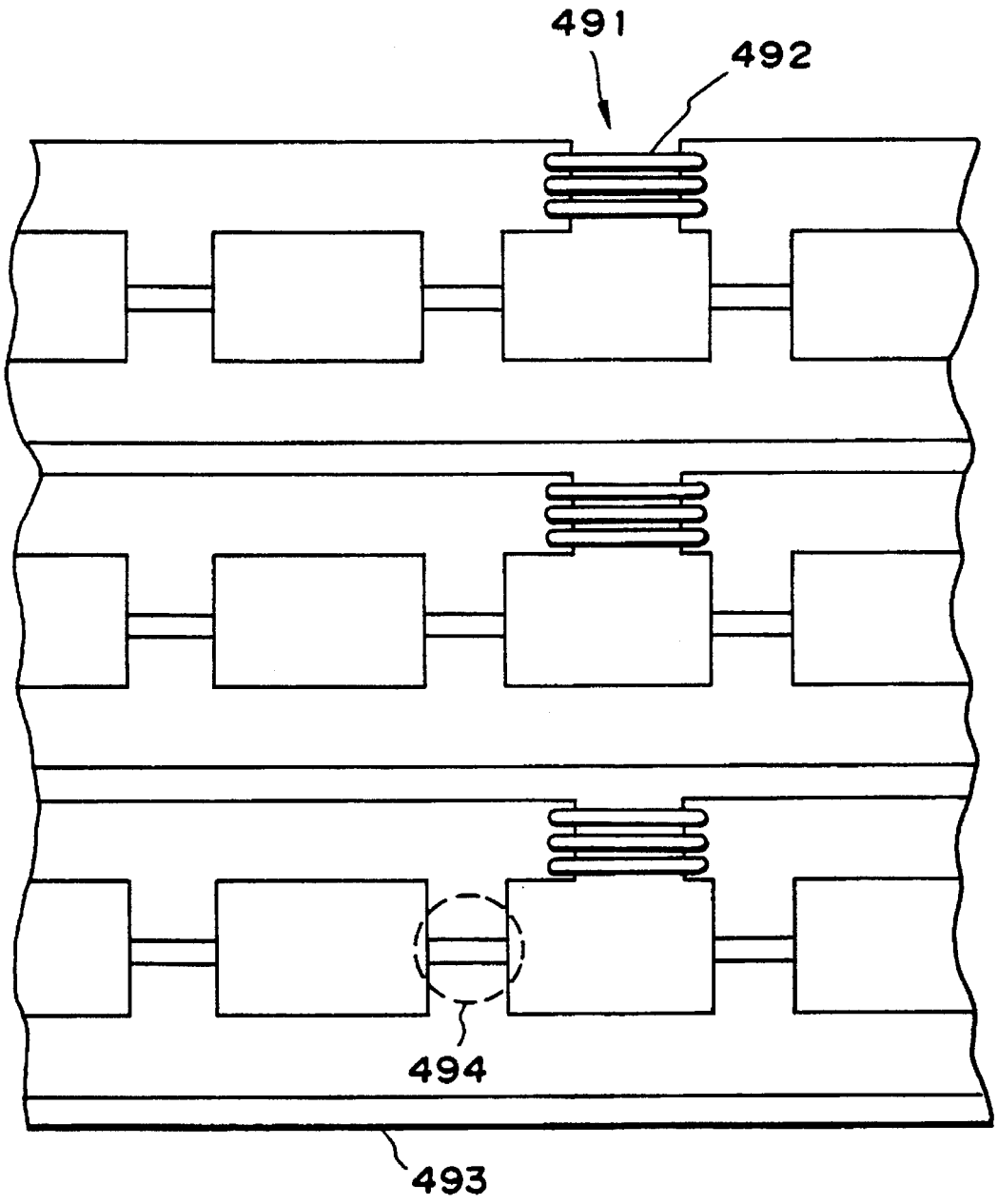
FIG. 47 is a plan view showing part of a multiple electron source according to another embodiment.

FIG. 47 is a plan view of an electron source according to another example applying means B-2.

In this Example, surface-conduction electron-emitting devices are wired one-dimensionally in the form of a ladder, as shown in FIG. 47, and a portion of the wiring is provided with a gap. The process for fabricating wiring with a gap will be described in line with Example 16.

Accordingly, the forming treatment and a process for connecting gaps 491 after implementation of the forming treatment will be described with reference to FIG. 47 and FIGS. 48, 49A, 49B.

FIG. 20B is a simple circuit diagram showing the completed wiring with gaps. For the sake of simplicity, the number of pixels in the display panel is 6×6, and the blocks are divided every two devices. However, the electron source used here is composed of 1000 rows in each of which 1000 devices are wired, and the wiring is split at ten equally spaced locations (every 100 devices).

Figure 49B:
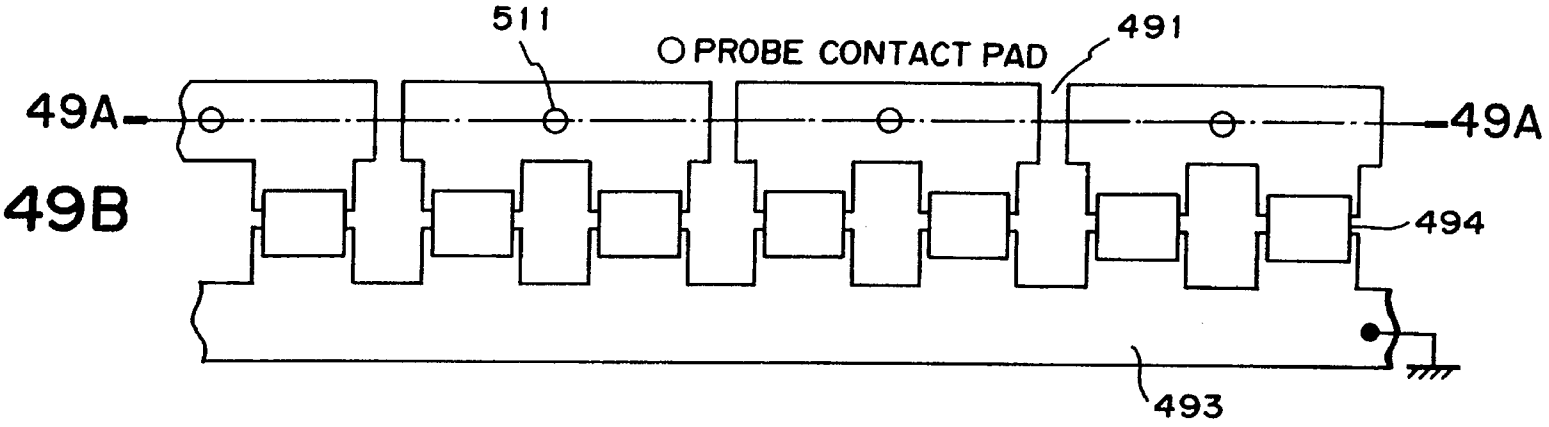
FIGS. 49A, 49B are diagrams for describing forming using probes.
Figure 49A:
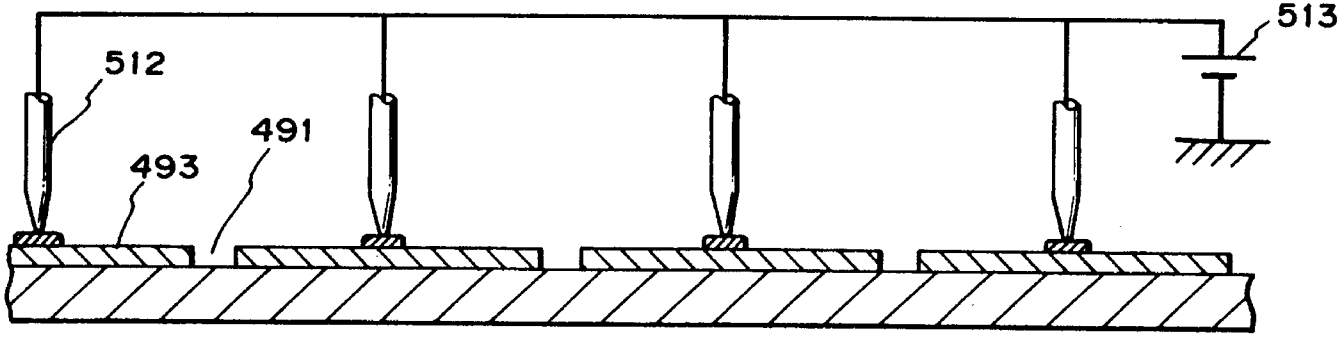

FIG. 49A illustrates a cross section of the gaps. Probes 512 identical with those of Example 6 are connected to probe connection points 511 in FIG. 49B, a forming power supply 513 is connected and the forming treatment is carried out for the devices on one line simultaneously. The method of applying voltage is shown in FIG. 49.

Each forming voltage was 5 V, and the current for each block (100 devices) at this time was about 3.0 A. This is equivalent to one-tenth of that in the case where the wiring is not split.

Figure 48A:
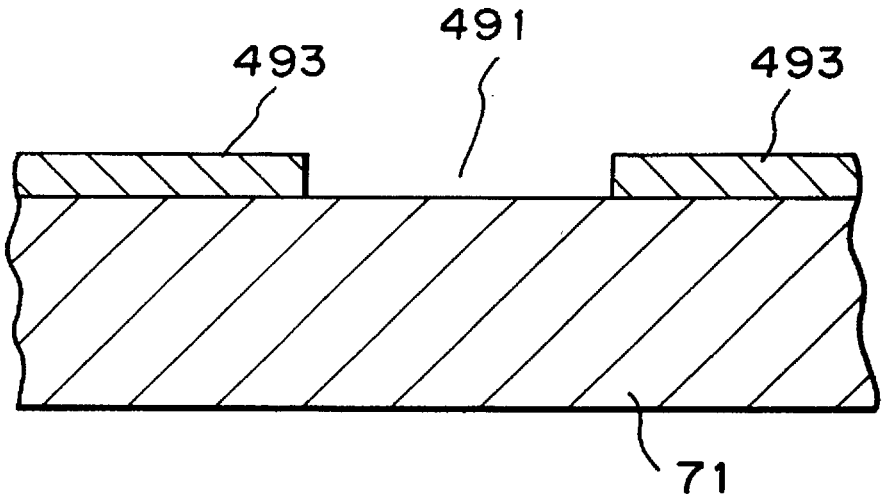
FIGS. 48A, 48B are a sectional view of a gap and a diagram showing the connection thereof, respectively.
Figure 48B:
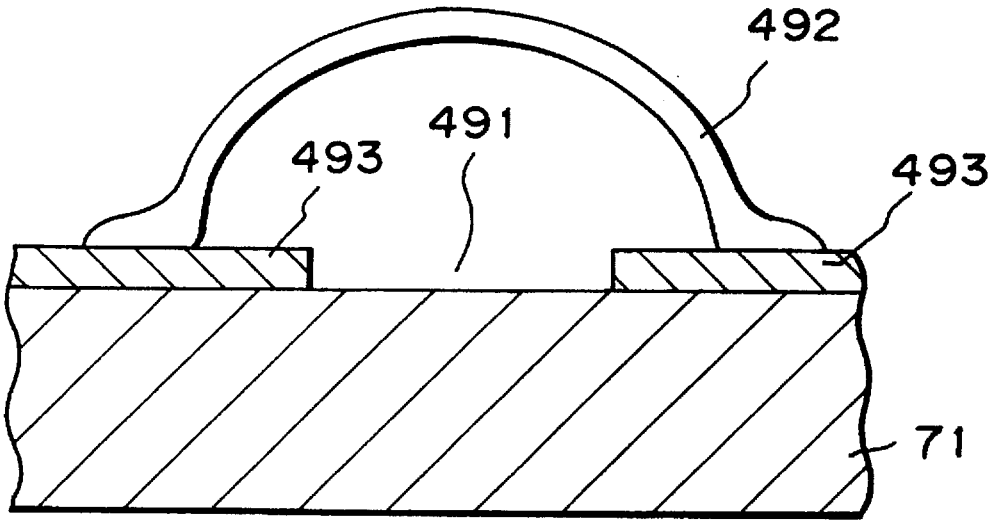

Next, as shown in FIG. 48B, the gap 491 is connected by being bonded using three gold wires 492, each of which has a diameter of 30 μm, per location, thereby completing the multiple electron-source substrate.

In accordance with the basic concept of the invention, as described above, the structure of the devices, the material and the method of manufacture are not necessarily limiting. Accordingly, the size of the divisions may be decided in dependence upon the forming current per device.

When the device characteristics per pixel were actually measured in the same manner as in Example 16, it was found that the electron emission efficiency $\eta$=Ie/If (%) was 0.05% on average. Further, the variance thereof was held to less than 6% for the panel overall.

In an image forming apparatus formed in the same manner as in Example 9 using the forming method of this Example, it was confirmed that the device characteristics were uniform and that luminance irregularity of the displayed image was less than 6% owing to the fact that a number of surface-conduction electron-emitting devices wired in the form of a simple matrix could be formed uniformly.

EXAMPLE 19

Another example will now be described in which the means B-3 is applied to fabricate an electron source having surface-conduction electron-emitting device wired in the form of a simple matrix.

Through a process similar to that of Example 1, an electron-source substrate on which surface-conduction electron-emitting devices not yet subjected to the forming treatment are wired in the form of a simple matrix is fabricated. In this Example, a simple matrix arrangement having devices wired in a 100×100 array was fabricated. The resistance of each device was about 1 kΩ in the state prior to forming, and the resistance of the upper and lower wiring per device was about 0.01Ω. Two of the electron-source substrates thus fabricated were prepared and forming was carried out through two different methods described below.

(Forming Method 1)

Figure 55:
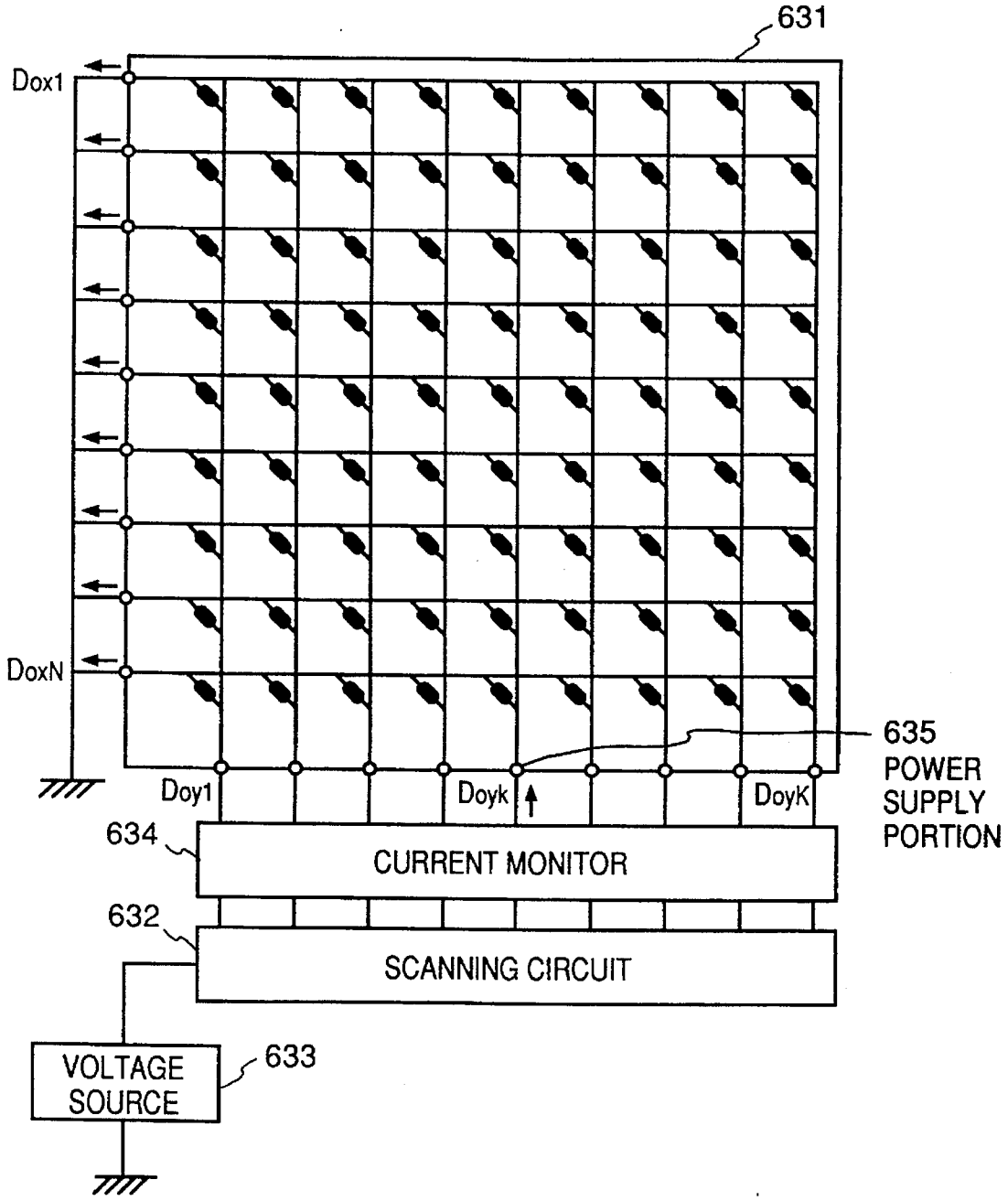
FIG. 55 is a diagram for describing a forming method according to the present invention.
Figure 56A:
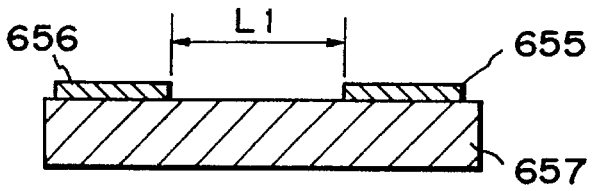
FIG. 56A~56D are diagrams for describing a process for forming surface-conduction electron-emitting devices in a ladder array according to the present invention.
Figure 56B:
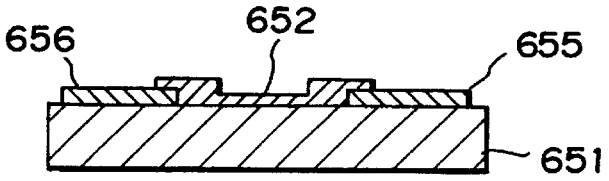
Figure 56C:
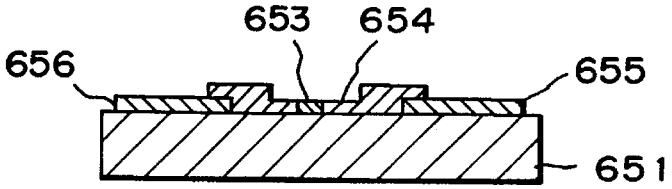
Figure 56D:
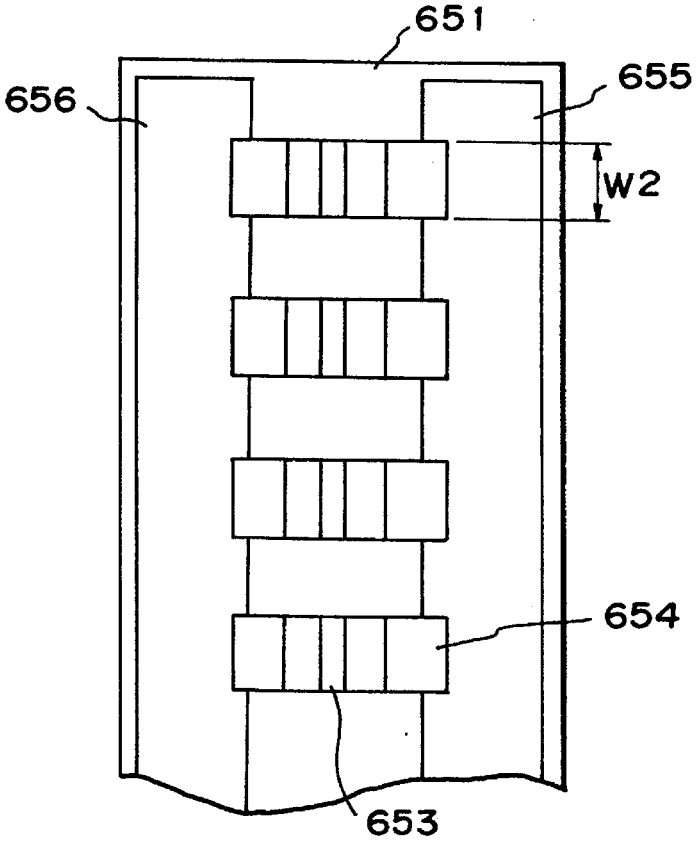

First, the forming method of the present invention will be described with reference to FIG. 55. An external scanning circuit 632 and a voltage source 633 are connected for controlling connections in such a manner that connection terminals $D_{oy1}$~$D_{oyK}$, which lead to the upper wiring of an electron-source substrate 631 completed in the manner described above, become power supply portions 635 in successive fashion ($D_{oyk}$ is the power supply portion in FIG. 55). Connection terminals $D_{ox1}$~$D_{oxN}$ leading to the lower wiring are grounded. Here the current that flows through the power supply portion is capable of being monitored by a current monitoring circuit 634. The arrangement is such that the impedance of one line to be subjected to the forming treatment is capable of being sensed.

Figure 54A:
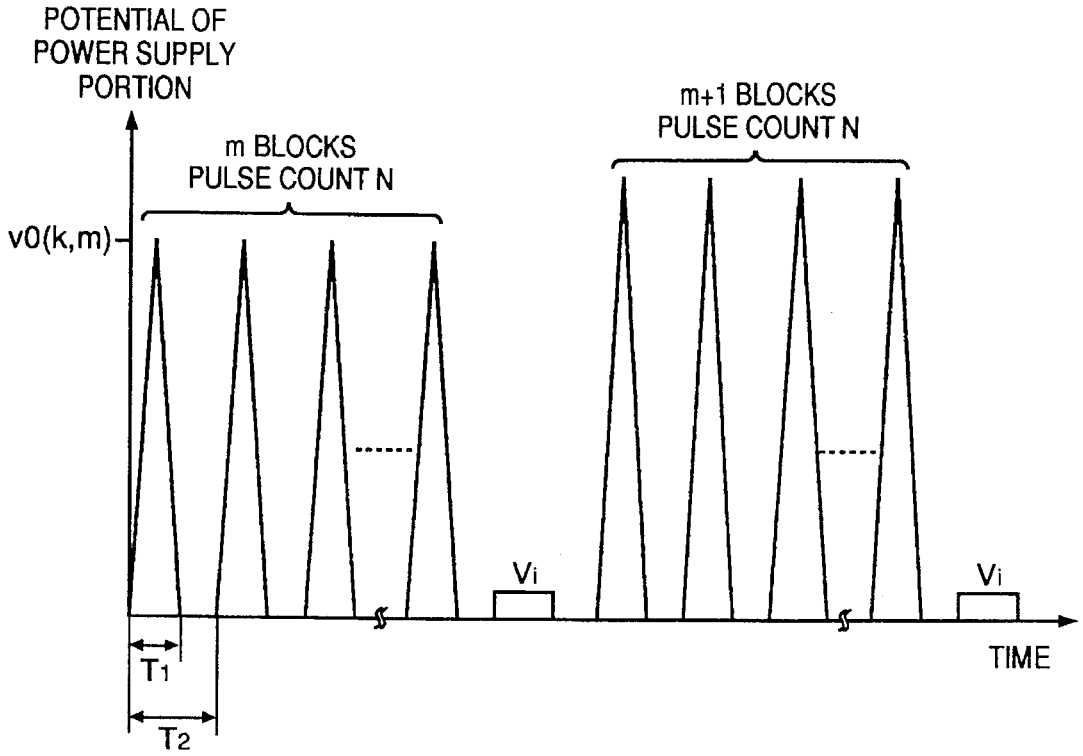
FIGS. 54A, 54B are diagrams illustrating examples of forming waveforms.

A forming waveform shown in FIG. 54 was applied to carry out forming. Here T1, T2 and N were set at 1 msec, 10 msec and 10, respectively. The number of blocks was ten. When forming is carried out for k lines and m blocks, the voltage (peak value) applied to the current power supply portion $D_{oyk}$ was made $$v0\ (k,m)=8.5\times[1+k/10000+0.05m-0.001m\times m];m=1\sim10$$

Figure 54B:
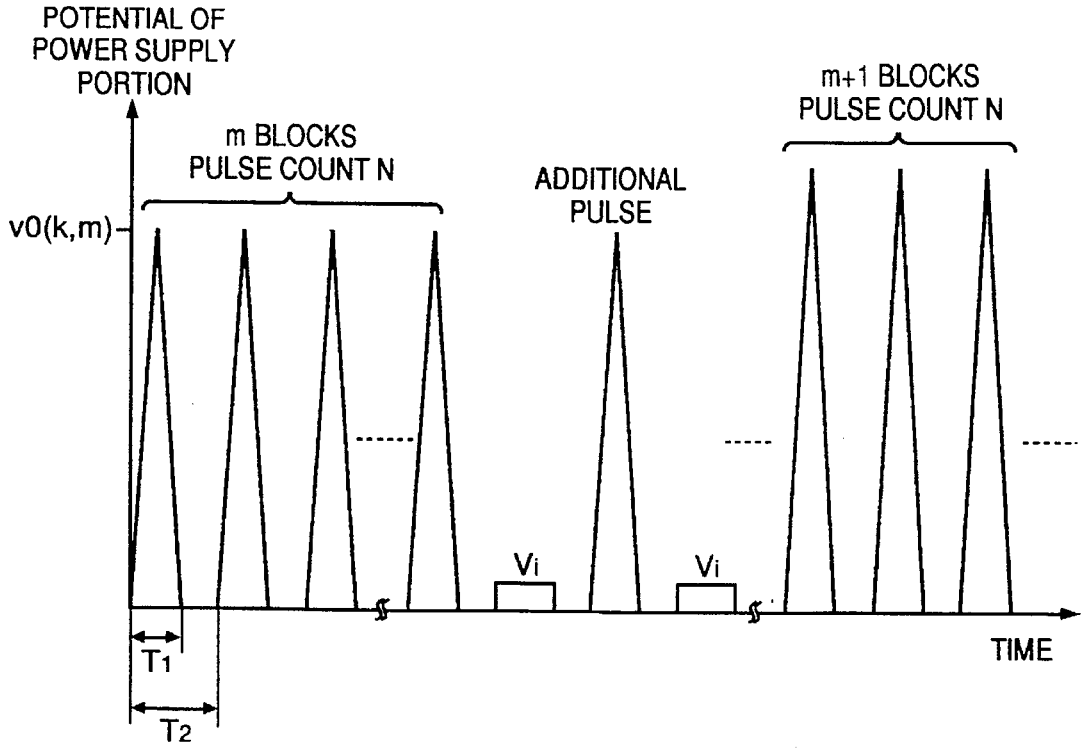

Impedance was measured by applying a voltage Vi less than the applied voltage v0 (k,m) after application of N-number of the forming pulses of FIG. 54. The measurement of impedance was performed without influencing devices not yet subjected to forming. In a case where the measured impedance is less than that which prevails when it is judged that k lines and m blocks, which are object of forming, have been formed, it is judged that the devices that are. the object of forming have not yet been formed, and an additional forming pulse is generated [FIG. 54B].

(Forming Method 2: Example for Comparison)

A circuit is connected by an arrangement similar to that of Forming Method 1 to one more electron-source substrate prepared in the manner set forth above. In this method, however, the current monitor circuit did not operate and line forming was carried out using the forming waveform of FIG. 18, with T1 set at 1 msec, T2 at 10 msec and at a constant applied voltage having a peak voltage value of 9.3 V.

In the multiple surface-conduction electron-emitting device electron source completed as described above (according to both Forming Methods 1 and 2), the device characteristics per surface-conduction electron-emitting device were measured, in the same manner as in Example 16, through the terminals $D_{x1}$~$D_{xm}$, $D_{y1}$~$Dy_n$. With Forming Method 1, the electron emission efficiency η=Ie/If (%) was 0.1%. The variance thereof was less than 5% for the panel overall. With Forming Method 2, on the other hand, the electron emission efficiency η=Ie/If (%) was 0.05%. The variance thereof was greater than 10% for the panel overall.

Figure 51A:
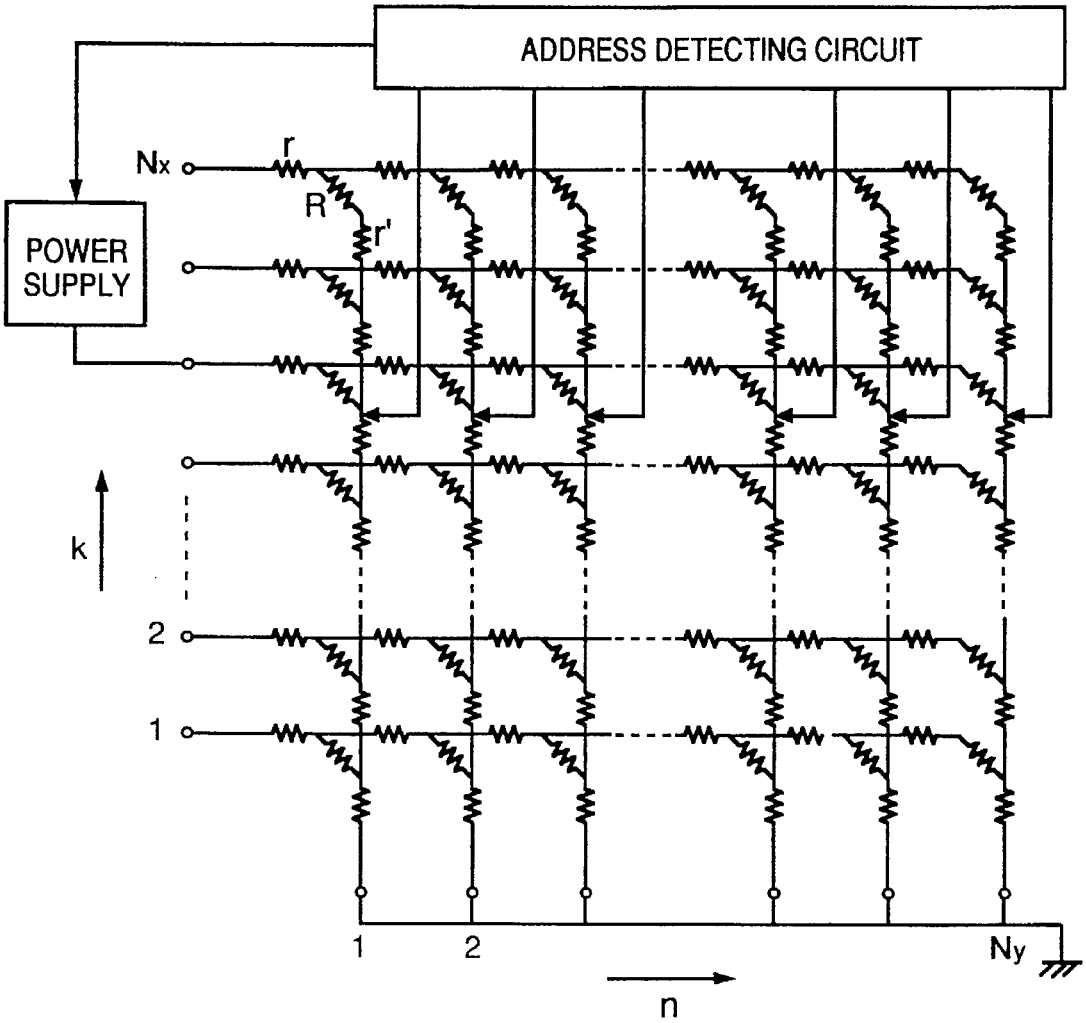
FIGS. 51A, 51B are diagrams for describing a method of sensing addresses of electron sources based upon potential on wiring.

Address detection was carried out by measurement of impedance in this Example. Means for detecting addresses based upon the potential distribution of wiring will be described with reference to FIGS. 51A and 51B.

Figure 51B:
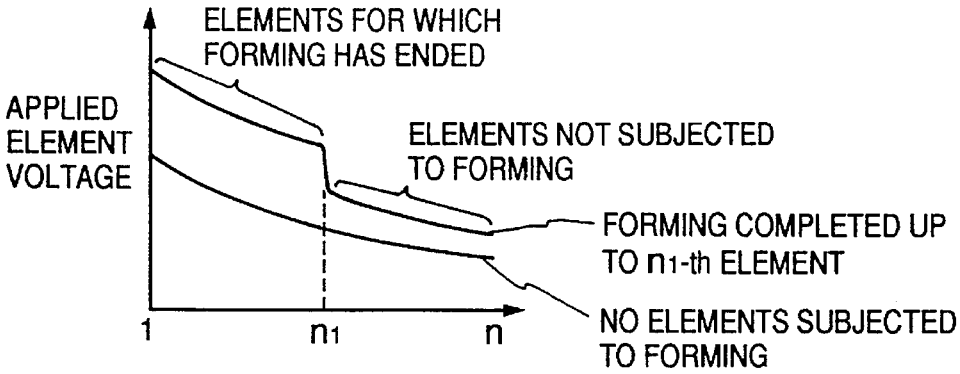

Owing to a change in the impedance of each device before and after forming, potential of the wiring in the vicinity of the device undergoes a large change when forming is concluded [see FIG. 51B)]. The address of an device that has undergone forming can be detected also by detecting this change, namely by connecting probe pins 531 to wiring and detecting the change in the potential distribution of the wiring.

EXAMPLE 20

An example of an image forming apparatus constructed using the electron-source substrate, which has not been subjected to the forming treatment, fabricated according to Example 5 will now be described with reference to FIG. 24.

The electron-source substrate 111, which has not been subjected to the aforementioned forming treatment, was secured to the rear plate 241, after which the face plate 246 was disposed above the electron-source substrate via the supporting frame 242. The joints of the face plate 246, supporting frame 242 and rear plate 241 were coated with frit glass, which was then baked in the atmosphere or in a nitrogen environment at 400° C. for no less than 15 min to effect sealing. Fixing of the electron-source substrate 111 to the rear plate 241 was also accomplished by using frit glass.

The environment within the glass vessel completed as described above was withdrawn through an exhaust pipe (not shown) using a vacuum pump. After a degree of vacuum greater than $1\times10^{-5}$ Torr was attained, a voltage was applied across the device electrodes through external terminals $D_{x1}$~$D_{Xm}$, $D_{y1}$~$D_{yn}$ according to the Example 19, whereby the above-described electrification treatment (forming treatment) was applied according to two methods identical with those of Example 19 to form the electron emission portions and fabricate the surface-conduction electron-emitting devices.

Next, the exhaust pipe (not shown) was heated by a gas burner in a vacuum on the order of $1\times10^{-6}$ Torr, thereby sealing off the vessel by fusing it.

Finally, a getter treatment was applied in order to maintain the vacuum after sealing.

In the image forming apparatus off the invention completed as described above, scanning signals and modulating signals were applied to each of the surface-conduction electron-emitting devices through the external terminals $D_{x1}$~$D_{xm}$, $D_{y1}$~$D_{yn}$ by signal generating means (not shown), a high voltage of 6 kV was applied through the high-voltage terminal Hv and an image was displayed.

Figure 50A:
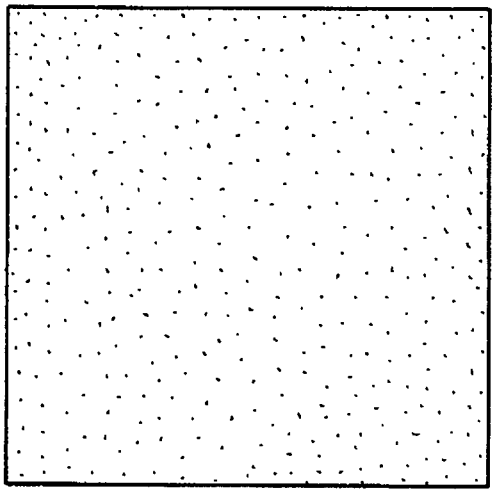
FIG. 50 is a diagram showing luminance irregularity according to a Forming Method 1 and a Forming Method 2.
Figure 50B:
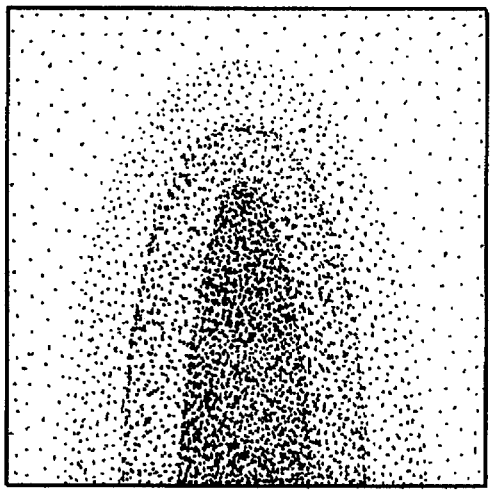

When the luminance of all pixels was measured, the results shown in FIG. 50 were obtained. Specifically, with Forming Method 1 of the present invention as set forth in Example 19, it was found that irregular luminance was very small across the entire panel. contrast, with Forming Method 2 it was found that luminance was high along three edges of the screen but very low along the middle of the screen. In other words, by controlling the voltage value applied to the power supply portions in dependence upon the address of each device, irregularity in luminance was reduced to less than 5% and a high-quality image forming apparatus could be obtained.

EXAMPLE 21

Next, an image forming apparatus constructed using an electron source, in the form of a ladder array, fabricated by applying the aforesaid means B-3 will be described with reference to FIG. 21. Surface-conduction electron-emitting devices not yet subjected to forming were fabricated on the insulative substrate 21. The fabrication process was the same as that of Example 8, and the dimensions of the surface-conduction electron-emitting devices (prior to forming) also were the same as those in Example 8. The number of devices in one row was 200, and the electrode power supply portion and grounded portion were provided at one location each at both ends of the line. The equivalent circuit is as shown in FIG. 16E.

Figure 52:
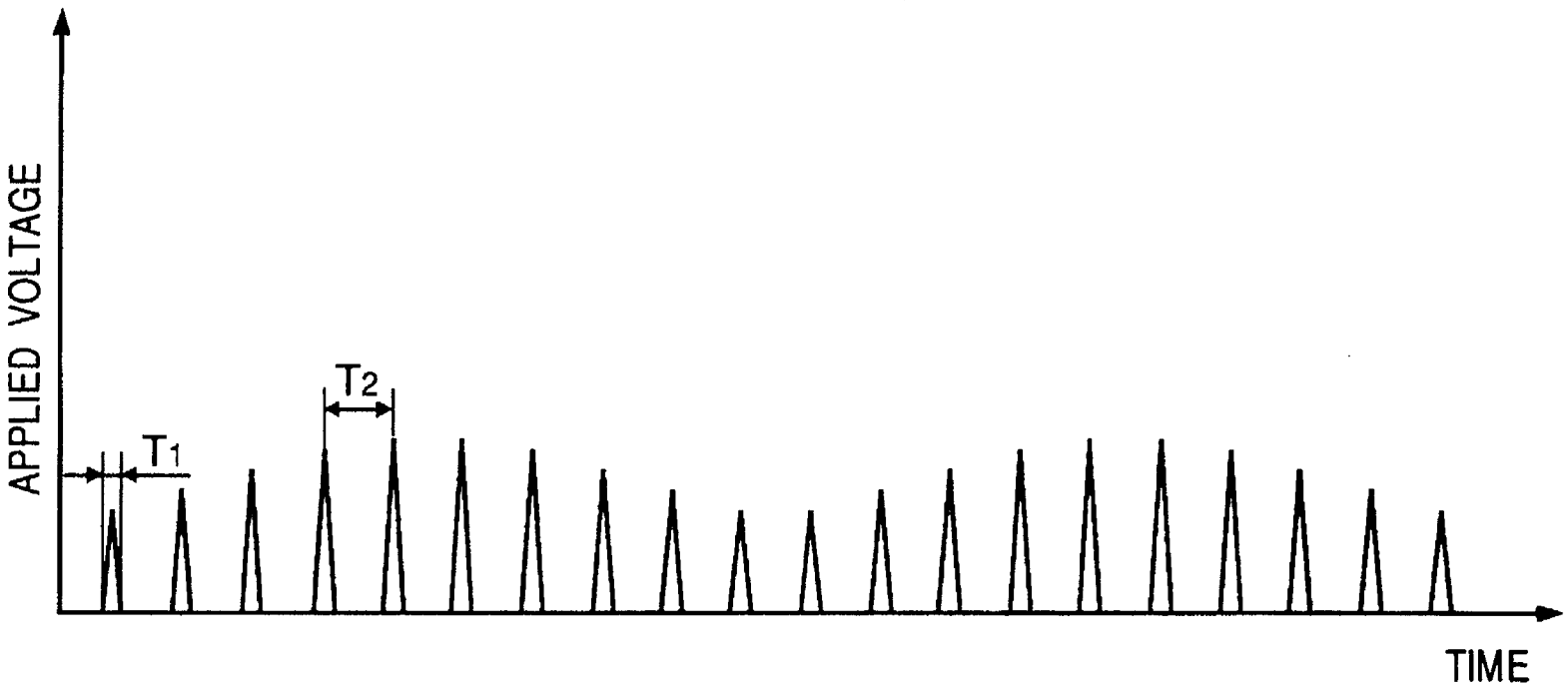
FIG. 52 is a diagram illustrating an example of a forming waveform according to this embodiment.

The electron-source substrate thus fabricated was subjected to forming using the forming waveforms shown in FIG. 52. The peak value of this pulse group gradually increases from 8 V, reaches a maximum of 9 V, then gradually decreases and returns to 8 V. This process is repeated twice. T1 was set at 1 msec and T2 at 10 msec, and the overall process for the two repetitions was about 5 sec. The voltage value used here was the most suitable selected from a variety of considered conditions. As a result, the variance in electron emission efficiency was less than 7% and highly uniform electron emission characteristics were obtained for each device. In this Example, excellent line forming was carried out without detecting the address of devices already subjected to forming.

In Examples 1 to 21 described above, it is illustrated that several of the aforementioned means A-1, A-2, B-1, B-2 and B-3 can be combined. However, combinations other than those illustrated also are possible.

In the Examples described above, the forming treatment is carried out by applying triangular pulses across the device electrodes. However, the waveforms applied across the device electrodes are not limited to triangular waves; any desired waveform such as a square wave may be used and the peak value, pulse width and pulse interval thereof are not limited to the above-mentioned values. Desired values can be selected as long as the electron emission portions are formed in favorable manner.

Similar results were obtained in the foregoing Examples in a case where step-type surface conduction emission device were used as the surface-conduction electron-emitting devices.

Further, application of the invention is not limited to surface-conduction electron-emitting devices. The invention can be used in other devices requiring forming, such as MIMs.

Thus, according to the present invention as described above, there are provided an electron source having a plurality of electron-emitting devices arrayed on a substrate, an image forming apparatus and a method of manufacturing the same. In the forming process for forming the electron emission portions of the plurality of electron-emitting devices, (A) an external current supplying mechanism is provided in such a manner that voltage is applied solely to groups of the devices at desired portions and not to other groups of devices, whereby forming is carried out not simultaneously for all electron-emitting devices on the substrate but successively by dividing the devices into a plurality of groups, and (B) a mechanism is provided so that when a group of devices at a desired portion is subjected to forming, each device undergoes forming at substantially the same voltage or at substantially the same power and forming is carried out in successive fashion. Accordingly, the following effects are obtained:

(1) Destruction due to static electricity during forming does not occur, as a result of which a higher manufacturing yield is obtained.

(2) Diversion of voltage and current to the surface-conduction electron-emitting devices during forming does not occur, and a decrease; in the distribution of forming voltage or power due to a potential drop in the wiring is reduced. As a result, it is possible to create an electron source in which a distribution in electron emission characteristics is reduced.

(3) As a result of (2) above, it is possible to obtain an image forming apparatus having little irregularity in luminance, thus making it possible to display a high-quality picture.

(4) The limitation upon the number of devices capable of being connected to one line of wiring is alleviated, thus making it possible to obtain an image forming apparatus that displays a high-quality picture of large area.

(5) It is unnecessary to use comparatively costly materials such as gold or silver in order to lessen wiring resistance. There is greater degree of freedom in terms of selecting the material, and less expensive material can be used.

(6) It is unnecessary to form thick wiring in order to lessen wiring resistance. As a result, the time required for the manufacturing process, namely for the forming and patterning of the electrodes, is shortened and it is possible to reduce the cost of the equipment required.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing an electron source having a plurality of surface-conduction electron-emitting devices arranged in a matrix form with a plurality of row-direction wires and a plurality of column-direction wires on a substrate, each of the plurality of surface-conduction electron-emitting devices being connected to one of the plurality of row-direction wires and one of the plurality of column-direction wires, comprising the steps of:

dividing a plurality of conductive films connected to the plurality of row-direction wires and column-direction wires in the matrix form into a plurality of groups; and supplying electric current to each of the plurality of groups through some of the plurality of row-direction wires or column-direction wires in each group to form electron emission portions of the surface-conduction electron-emitting devices.

2. The method according to claim 1, wherein the size of the matrix is M×N, each of the plurality of groups includes a plurality of conductive films connected to M' wires ($1 \leqq M' < M$) of the row-direction wires and N' wires ($1 \leqq N' < N$) of the column-direction wires, the electric current is supplied to the plurality of conductive films in each group.

3. The method according to claim 2, wherein, in said supplying step, a potential V1 is applied to both the M' wires of the row-direction wires and the wires of the column-direction wires other than the N' wires, and a potential V2, which differs from the potential V1, is applied to both the N' wires of the column-direction wires and the wires of the row-direction wires other than the M' wires.

4. The method according to claim 2, wherein, in said supplying step, the electric current is supplied from power supply portion connected to one end of the row-direction wires or the column-direction wires.

5. The method according to claim 2, wherein, in said supplying step, the electric current is supplied from power supply portions connected to both ends of the row-direction wires or the column-direction wires.

6. The method according to claim 1, wherein each of the plurality of groups includes a plurality of conductive films connected to the row-direction wires or column-direction wires, and the electric current is successively supplied to the conductive films through every row-direction wire or column-direction wire.

7. The method according to claim 6, wherein the electric current is supplied from power supply portions connected to both ends of the row-direction wires or the column-direction wires.

8. The method according to claim 6, wherein in said supplying step, potential V2 is applied to some of either the row-direction wires or the column-direction wires, a potential V1, which differs from the potential V2, is supplied to the remaining wires of the row-direction wires and the column-direction wires.

9. The method according to claim 8, wherein the potential V2 is applied to the wires of the said row-direction wires or the column-direction wires that exhibit a smaller variance in electric power when the electric power is applied to either the row-direction wires or the column-direction wires.

10. The method according to claim 6, wherein the electric current is supplied from a power supply portion connected to one end of the row-direction wires or the column-direction wires.

11. The method according to claim 10, wherein, in said supplying step, the potential V2 is applied to the row-direction wires when $$(N_x \times N_x - aN_x) \times r_x \leqq (N_y \times N_y - aN_y) \times r_y$$

holds, and to the column-direction wires when $$(N_x \times N_x - aN_x) \times r_x > (N_y \times N_y - aN_y) \times r_y$$

holds, where $N_x$ represents the number of surface-conduction electron-emitting devices connected to the row-direction wire, $N_y$ represents the number of surface-conduction electron-emitting devices connected to the column-direction wires, $r_x$ represents wiring resistance per one surface-conduction electron-emitting device in the row-direction wire and $r_y$ represents wiring resistance per one surface-conduction electron-emitting device in the column-direction wire, and further, a=8 when the power supply portion is connected to end of said row-direction wires or column-direction wires, and a=24 when the power supply portions are connected to both ends of said row-direction wires or column-direction wires.

12. A method of manufacturing an electron source having a plurality of surface-conduction electron-emitting devices connected to a plurality of wires on a substrate, comprising the steps of:

dividing a plurality of conductive films connected to the plurality of wires into a plurality of groups by forming at least one high-impedance portion on each of the plurality of wires;

supplying electric current to conductive films in each group to form electron emission portions; and electrically short-circuiting the at least one high-impedance portion after forming the electron emission portions.

13. The method according to claim 12, wherein said short-circuiting step is performed by wire-bonding using a low-resistance metal material.

14. The method according to claim 12, wherein said short-circuiting step is performed by heating and melting a metal exhibiting a low melting point.

15. The method according to claim 12, wherein the high-impedance portion comprises a metal exhibiting a high resistivity.

16. The method according to claim 12, wherein each high-impedance portion includes a thin film of a nickel-chrome alloy.

17. The method according to claim 12, wherein each high-impedance portion has a width less than the width of the portion of the wire other than the high-impedance portion.

18. The method according to claim 12, wherein each high-impedance portion has a thickness less than the width of the portion of the wire other than the high-impedance portion.

19. The method according to claim 12, wherein the plurality of wires include a plurality of row-direction wires and column-direction wires, and the plurality of surface-conduction electron-emitting devices are arranged in a matrix form to connect with the plurality of row-direction wires and column-direction wires.

20. The method according to claim 12, wherein the wires are arranged parallel to each other, and each of the surface-conduction electron-emitting devices is connected between parallel ones of the wires.

21. The method according to claim 12, wherein each wire is cut at the high-impedance portions.

22. A method of manufacturing an electron source, comprising the steps of:

connecting a plurality of surface-condition electron-emitting devices to a plurality of wires on a substrate; and supplying electric power to a plurality of conductive films connected to the plurality of wires from electrical connecting portions arranged to contact the plurality of wires at a plurality of locations thereof.

23. The method according to claim 22, wherein the electrical connecting portions have a plurality of contact terminals arranged to contact the plurality of wires at a plurality of locations thereof.

24. The method according to claim 22, wherein the electrical connecting portions have contact surfaces capable of contacting the plurality of wires over the surface thereof.

25. The method according to claim 22, where said electrical connecting portions comprise members exhibiting a resistance lower than that of the wires.

26. The method according to claim 22, wherein in said supplying step of electric power, a temperature of the electrical connecting portions is monitored and is controlled to be approximately constant.

27. The method according to claim 22, wherein surface portions of the wires to which the electrical connecting portions are arranged to contact are covered with a metal exhibiting a low resistance.

28. The method according to claim 22, wherein the plurality of wires are respectively covered with insulating members except at contact holes through which the electrical connecting portions are capable of contacting the wire.

29. The method according to claim 22, wherein, in the supplying step, electric power is supplied from a power supply portion connected to one end of each of the plurality of wires in addition to supplying electric power from the electrical connecting portions arranged to contact the wires.

30. The method according to claim 22, wherein, in said supplying step, electric power is supplied from power supply portions connected to both ends of each of the plurality of the wires in addition to supplying electric power from the electrical connecting portions arranged to contact the wires.

31. A method of manufacturing an electron source having a plurality of surface-conduction electron-emitting devices arranged on a substrate and connected by a plurality of wire, comprising the steps of:

supplying electric power to each of a plurality of thin films through the plurality of wires to form electron-emitting portions of the plurality of surface-conduction electron-emitting devices; and controlling an applied power or an applied voltage applied to each of the thin films so that the applied power or applied voltage is substantially constant for all of the devices.

32. The method according to claim 31, wherein the plurality of wires included a plurality of row-direction wires and column-direction wires, and the plurality of surface-conduction electron-emitting devices are arranged in a matrix form to connect with the plurality of row-direction wires and column-direction wires.

33. The method according to claim 32, wherein, in said controlling step, the applied power or the applied voltage is controlled prior to forming an electron-emitting portion of each of the plurality of surface-conduction electron-emitting devices.

34. The method according to claim 32, wherein, in said controlling step, a position of a device that has been subjected to forming among a plurality of surface-conduction electron-emitting devices connected to the wires is sensed, and depending upon the sensed position, the applied power or the applied voltage for forming the other devices is controlled.

35. The method according to claim 32, wherein, in said supplying step, the electric power is supplied from a power supply portion connected to one end of the wires, and the applied voltage is controlled in such a manner that the voltage applied to the power supply portion is greater in devices situated at both ends of one of the plurality of wires than in devices situated near the middle of the one wire among a plurality of devices connected to the one wire.

36. The method according to claim 32, wherein, in said supplying step, the electric power is supplied from power supply portions connected to two ends of one of the plurality of wires, and the applied voltage is controlled in such a manner that the voltage applied to the power supply portions is greater in devices situated at one end of the one wire and in devices near the middle of the wire than in devices situated in the vicinity of one-quarter inward from both ends of the one wire.

37. The method according to claim 22, wherein the plurality of wires are arranged in parallel, and each of the surface-conduction electron-emitting devices is connected between parallel ones of the wires.

* * * * *

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 1

Line 54, "noted-that" should read --note that--.

COLUMN 2

Line 24, "a" should read --an--.
Line 32, "NO." should read --No.--.

COLUMN 3

Line 45, "has" should read --have--.

COLUMN 4

Line 39, "It" should read --It is--.
Line 44, "is" should read --in--.
Line 58, "an" should read --a--.

COLUMN 5

Line 28, "order-to" should read --order to--.

COLUMN 7

Line 3, "is" should read --is a--.
Line 5, "is" should read --is a--.

COLUMN 8

Line 55, "this" should read --this is--.

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 9

Line 22, "potion" should read --portion--.
Line 62, "an" should read --a--.

COLUMN 10

Line 25, "sodalime" should read --soda lime--.
Line 28, "sodalime" should read --soda lime--.
Line 53, "Angstroms" should read --angstroms--.

COLUMN 11

Line 2, "appropriated" should read --appropriately--.

COLUMN 12

Line 47, "an" should read --a--.
Line 48, "an" should read --a--.

COLUMN 13

Line 63, "use" should read --used--.

COLUMN 20

Line 7, "in" should read --in the--.
Line 8, "in" should read --in the--.
Line 40, "to" should read --to be--.

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 21

Line 19, "$Py=[p(1,1)-p(N_x,N_y/2)]p0\sim2XN_xX(r_x/R)+(N_yxN_y/2-2xN_y)x(r_y/R)(22)$" should read --$Py=[p(1,1)-p(N_x,N_y/2)]p0\sim2XN_xX(r_x/R)+(N_yxN_y/2-2xN_y)x(r_y/R)$ (22)--.

Line 22, "$r_x<(N_yxN_y-8xN_y)xr_y$" should read --$r_x\leq(N_yxN_y-8xN_y)xr_y$--.

Line 41, "$(D_{y1.n})$" should read --$(D_{y1\sim n})$--.

COLUMN 23

Line 25, "by provided" should read --by providing--.

COLUMN 25

Line 62, "an" should read --a--.

COLUMN 29

Line 7, "an" should read --a--.
Line 41, ".The" should read --The--.
Line 54, "Ie:" should read --Ie.--.

COLUMN 31

Line 31, "sodalime" should read --soda lime--.
Line 65, "tile" should read -the--.

COLUMN 33

Line 5, "DX2," should read --$DX_2$,--.
Line 50, "an" (both occurrences) should read --a--.

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 36

Line 20, "functions-of" should read --functions of--.
Line 67, "an" should read --a--.

COLUMN 37

Line 1, "an" should read --a--.
Line 11, "an" should read --a--.

COLUMN 39

Line 22, "the-column" should read --the column--.
Line 31, "connected" should read --connect--.

COLUMN 40

Line 4, "With" should read --with--.
Line 40, "openings" should read --opening--.

COLUMN 41

Line 55, "device." should read --device--.

COLUMN 42

Line 41, "Data" should read --DATA--.
Line 46, "result-to" should read --result to--.
Line 60, "Data," should read --DATA--.
Line 43, "TSYNC." should read --$T_{SYNC}$.--.
Line 61, "$T_{Sp}$" should read --$T_{SP}$--.

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 43

Line 12, "TMOD" should read --$T_{MOD}$--.

COLUMN 44

Line 60, "the-peak" should read --the peak--.

COLUMN 45

Line 4, "an" should read --a--.
Line 32, "the-surface" should read --the surface--.

COLUMN 47

Line 34, "suing" should read --using--.

COLUMN 49

Line 31, "panel. In" should read --panel. ¶ In--.

COLUMN 51

Line 41, "object" should read --objects--.
Line 43, "are." should read --are-- and
"object" should read --objects--.

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 52

Line 4, "an" should read --a--.
Line 42, "off" should read --of--.
Line 54, "contrast," should read --By contrast,--.

COLUMN 53

Line 40, "device" should read --devices--.

COLUMN 54

Line 3, "decrease;" should read --decrease--.
Line 63, "from" should read --from a--.

COLUMN 56

Line 41, "where" should read --wherein--.
Line 55, "wire." should read --wires.--.

COLUMN 57

Line 1, "wire," should read --wires,--.
Line 11, "wherein" should read "wherein,--.
Line 17, "claim 32," should read --claim 31,--.
Line 22, "claim 32," should read --claim 31,--.

UNITED STATES PATENT AND TRADEMARK OFFICE

CERTIFICATE OF CORRECTION

PATENT NO. : 5,593,335

DATED : January 14, 1997

INVENTOR(S) : HIDETOSHI SUZUKI ET AL.

It is certified that error appears in the above-identified patent and that said Letters Patent is hereby corrected as shown below:

COLUMN 58

Line 4, "claim 32," should read --claim 31,--.
Line 12, "claim 32," should read --claim 31,--.

Signed and Sealed this

Twenty-eighth Day of April, 1998

Bruce Lehman

*Attest:*

BRUCE LEHMAN

*Attesting Officer*

*Commissioner of Patents and Trademarks*